US007630657B2

(12) United States Patent
Ehara et al.

(10) Patent No.: US 7,630,657 B2
(45) Date of Patent: Dec. 8, 2009

(54) METHOD, APPARATUS, AND PROGRAM FOR IMAGE FORMING CAPABLE OF EFFECTIVELY ADJUSTING POSITIONAL DEVIATION

(75) Inventors: Yasuhisa Ehara, Kamakura (JP); Kazuhiko Kobayashi, Tokyo (JP); Joh Ebara, Kamakura (JP); Seiichi Handa, Tokyo (JP); Noriaki Funamoto, Tokyo (JP); Toshiyuki Uchida, Kawasaki (JP); Keisuke Sugiyama, Yokohama (JP); Kouji Amanai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 11/742,379

(22) Filed: Apr. 30, 2007

(65) Prior Publication Data

US 2007/0274746 A1 Nov. 29, 2007

(30) Foreign Application Priority Data

Apr. 28, 2006 (JP) ..... 2006-124802

(51) Int. Cl.
*G03G 15/00* (2006.01)
*G03G 15/01* (2006.01)

(52) U.S. Cl. ..... 399/45; 399/72; 399/301

(58) Field of Classification Search ..... 399/45, 399/299, 300, 301, 389, 72; 347/115, 116
See application file for complete search history.

(56) References Cited

U.S. PATENT DOCUMENTS 5,383,004 A * 1/1995 Miller et al. ..... 399/24
6,708,017 B2 3/2004 Yamanaka et al.
6,920,303 B2 7/2005 Yamanaka et al.
6,934,498 B2 8/2005 Kobayashi et al.
6,952,557 B2 10/2005 Kobayashi
6,999,713 B2 2/2006 Kobayashi (Continued)

FOREIGN PATENT DOCUMENTS

EP 1 369 749 A2 12/2003

(Continued)

OTHER PUBLICATIONS

U.S. Appl. No. 11/972,136, filed Jan. 10, 2008, Funamoto, et al.

*Primary Examiner*—David M Gray
*Assistant Examiner*—Gregory H Curran
(74) *Attorney, Agent, or Firm*—Oblon, Spivak, McClelland, Maier & Neustadt, P.C.

(57) ABSTRACT

An image forming apparatus, in which a program for carrying out an image forming method is provided, includes a transfer member to receive respective images formed on a plurality of image bearing members, an image detecting unit to detect the images conveyed on the transfer member, a paper length detecting unit to detect a length of a recording medium in a sheet travel direction, a counting unit to count the number of recording media and to change a count up value according to a detection result by the paper length detecting unit, and a control unit to control an image forming timing with respect to the image bearing members based on a detection timing of the image and to perform a positional deviation adjustment each time a counted value increases by a predetermined amount so as to reduce an amount of a positional deviation of the image.

20 Claims, 28 Drawing Sheets

U.S. PATENT DOCUMENTS

| | | | | |
|---|---|---|---|---|
| 7,050,737 | B2 | 5/2006 | Kobayashi | |
| 7,130,551 | B2 | 10/2006 | Kobayashi | |
| 7,136,600 | B2 | 11/2006 | Yamanaka et al. | |
| 7,206,537 | B2 | 4/2007 | Funamoto et al. | |
| 2002/0051666 | A1* | 5/2002 | Asai et al. | 399/391 |
| 2004/0033090 | A1* | 2/2004 | Yamanaka et al. | 399/301 |
| 2004/0136025 | A1* | 7/2004 | Moriyama et al. | 358/1.14 |
| 2005/0053388 | A1 | 3/2005 | Yokoyama et al. | |
| 2005/0238372 | A1* | 10/2005 | Shinohara et al. | 399/44 |
| 2006/0110189 | A1 | 5/2006 | Matsuda et al. | |
| 2006/0165442 | A1 | 7/2006 | Kobayashi et al. | |

FOREIGN PATENT DOCUMENTS

| | | | |
|---|---|---|---|
| EP | 1 586 955 | A1 | 10/2005 |
| JP | 8-137336 | | 5/1996 |
| JP | 2001-228670 | | 8/2001 |
| JP | 2003-149904 | | 5/2003 |
| JP | 2003-149905 | | 5/2003 |
| JP | 2004-013101 | | 1/2004 |

* cited by examiner

METHOD, APPARATUS, AND PROGRAM FOR IMAGE FORMING CAPABLE OF EFFECTIVELY ADJUSTING POSITIONAL DEVIATION

CROSS REFERENCE TO RELATED APPLICATIONS

The present application claims priority under 35 U.S.C. § 119 to Japanese patent application no. 2006-124802, filed in the Japan Patent Office on Apr. 28, 2006, the entire contents of which are herein incorporated by reference.

BACKGROUND OF THE INVENTION

1. Field of the Invention

The present invention relates to an image forming apparatus, an image forming method performed in the image forming apparatus, and a program used in the image forming apparatus. More particularly, the present invention relates to an image forming apparatus that can effectively conduct color misregistration adjustment for forming a high quality image by sequentially overlaying respective single color images formed on a plurality of image bearing members to directly or indirectly transfer onto a recording medium, an image forming method used for the image forming apparatus, and a program used to perform the image forming method in the image forming apparatus.

2. Discussion of the Related Art

Related art image forming apparatuses for forming a color image employ a tandem type configuration in which respective single color toner images are carried on a plurality of image bearing members and transferred onto a transfer member such as a recording medium or an intermediate transfer member so as to form a full color image.

Such color image forming apparatuses may cause a color misregistration or color misregistration problem. Specifically, when at least one image bearing member of a plurality of image bearing members transfers the single color toner image carried thereon onto a position relatively off its correct position, a color misregistration on a full color image may occur.

Such color misregistration can be caused by various positional deviations. The positional deviations include a vertical scanning misregistration or scanning misregistration in a sub-scanning direction of each toner image and a misregistration due to skew.

FIGS. 1 and 2 are views for explaining color misregistration.

FIG. 1 shows a vertical (sub-scanning direction) scanning color misregistration, which is a deviation on a transfer member in the vertical scanning direction or in a transfer member travel direction from an ideal image formation line (position at which toner image is to be properly formed) indicated by a solid line in FIG. 1.

FIG. 2 shows an inclination of an image on the transfer member in the vertical scanning direction or in the transfer member travel direction from an ideal image line indicated by a solid line that extends in a direction perpendicular to the transfer member travel direction in FIG. 2.

The above-described positional deviations can be results of a positional misregistration of replaced components or parts of an image forming apparatus. Actually, the positional deviation most frequently occurs due to expansion and contraction of image writing parts, such as reflection mirrors, according to temperature change.

The misregistration in the sub-scanning direction can be reduced by adjusting an image writing timing. The misregistration due to skew can be reduced by changing the installed condition, which includes setting the values of the angle, direction, position, etc., by a drive unit. It is known that periodical adjustment of positional deviations of an image forming apparatus can contribute to a reduction in frequency of color misregistration due to expansion and contraction of image writing components or parts caused by the temperature change.

That is, after respective single color toner images formed on the plurality of image bearing members have been transferred onto a transfer member, optical sensors provided in the image forming apparatus may read the respective toner images and detect relative positional deviation to each other. Based on the detection results, the image forming apparatus may adjust the image writing timing and/or the installed condition of the image writing components or parts.

One technique has been proposed for use in an image forming apparatus, in which a timing of positional deviation adjustment is determined based on the detection result obtained by a temperature sensor (or temperature sensors) disposed in the image forming apparatus.

By employing this technique, the color misregistration can be reduced by conducting the next positional deviation adjustment at the point in which the temperature inside the image forming apparatus has changed and reached a predetermined amount from a point that the positional deviation adjustment is performed. In other words, in a case in which the next positional deviation adjustment is conducted when the temperature has reached the point in which a target image writing component or part has expanded or contracted by a predetermined degree, the color misregistration can be reduced. The above-described technique, however, has a disadvantage that a temperature sensor may increase the cost.

Different techniques have proposed to cause a related art image forming apparatus to conduct the above-described positional deviation adjustment each time after a predetermined amount of prints are output.

Such related art image forming apparatus can reduce the color misregistration without the above-described temperature sensor(s), which can avoid an increase in cost. However, even when the temperature inside the image forming apparatus does not change remarkably, the positional deviation adjustment can be conducted. This can undesirably increase the number of operations of the positional deviation adjustment.

As described above, there are the positional deviation adjustment based on the detection result obtained by the temperature sensor(s) and the positional deviation adjustment based on the predetermined amount of printouts. Consequently, both of these techniques have advantages and disadvantages. Therefore, it is preferable to employ the positional deviation adjustment based on the predetermined amount of printouts because this positional deviation adjustment can be performed at a lower cost. Further, an image forming apparatus including the positional deviation adjustment based on the predetermined amount of printouts can be mass-produced for a general user.

However, even though it is expected to mass-produce such image forming apparatuses for the general user, it is not preferable to increase the amount of color misregistration and the number of times to force users to wait, which may be referred to as "the number of waits" because of the positional deviation adjustment. Accordingly, the number of waits and the amount of color misregistration may need to be limited to respective allowable ranges.

Unfortunately, in order to surely maintain the amount of color misregistration within its allowable range when the positional deviation adjustment is performed based on the predetermined amount of printouts, the general user has to wait the number of times that is greater than the allowable number of waits.

Specifically, the inventors of the present invention have found that the expansion and contraction of the image writing components or parts may be caused due to the change of temperature inside an image forming apparatus, particularly inside an image writing device in an image forming apparatus.

The inventors of the present invention have also found that when the image forming apparatus is installed in a normal indoor environment, the temperature inside the image writing device in a standby mode does not remarkably change.

The temperature inside the image writing device may remarkably change when a large amount of a serial printing job is performed. During the serial printing job, the temperature inside the image writing device keeps increasing according to an increase of the number of prints.

According to a result of a test performed by the inventors of the present invention, the temperature inside the image writing device increased while conducting a serial printing job from the first sheet to the 1000th sheet.

In a case in which no positional deviation adjustment is conducted during the printing operation, the amount of the color misregistration keeps increasing according to an increase of the temperature inside the image writing device.

On the other hand, in a case in which a positional deviation adjustment is conducted by a predetermined amount of print sheets, the amount of color misregistration can be adjusted and reset to the initial value.

Further, it is natural that the increasing amount of color misregistration per one print sheet for a serial printing job can vary according to the size of the print sheet. Specifically, as the size of a print sheet is larger, the driving period of the image writing device per one print sheet becomes longer, and an amount of increase of the temperature inside the image writing device for one print sheet becomes greater.

Therefore, in order to maintain the amount of color misregistration within the allowable range, the number of trigger print sheets that are a start condition of the positional deviation adjustment may need to be set based on the assumption that the maximum size of various sizes of usable print sheets is generally used.

With the above-described condition, it has been found that the number of trigger print sheets needs to be set to a significantly small number to prevent the general user from waiting longer than the allowable range of the number of waits.

Alternative to the number of trigger print sheets, a count value of the driving period of the image writing device can be used. With the above-described count value, the positional deviation adjustment can be conducted at an appropriate timing with the increase amount of the temperature inside the image writing device, without increasing the number of waits.

To perform the positional deviation adjustment with the above-described condition, however, a new configuration or structure for counting the driving period of the image writing device may be additionally required, which can cause an increase in cost.

SUMMARY OF THE INVENTION

Exemplary aspects of the present invention have been made in view of the above-described circumstances.

Exemplary aspects of the present invention provide an image forming apparatus that can effectively adjust positional deviation to produce a high quality image without providing additional units.

Other exemplary aspects of the present invention provide an image forming method that can be performed in the above-described image forming apparatus to effectively perform the adjustment of the positional deviation for producing a high quality image.

Other exemplary aspects of the present invention provide a program for carrying out the above-described image forming method in the above-described image forming apparatus.

In one exemplary embodiment, an image forming apparatus includes a plurality of image bearing members configured to bear respective images thereon, a transfer device configured to transfer the respective images formed on the plurality of image bearing members and include a transfer member in a form of an endless loop and configured to receive the respective images on one of a surface of the transfer member and a recording medium carried by the transfer member, an image detecting unit configured to detect the respective images conveyed on the transfer member, a paper length detecting unit configured to detect a length of a recording medium in a sheet travel direction, a counting unit configured to count the number of recording media including the recording medium conveyed to the transfer device and to change a count up value for each recording medium according to a detection result obtained by the paper length detecting unit, and a control unit configured to control an image forming timing with respect to the plurality of image bearing members based on a detection timing of the image detected by the image detecting unit and to perform a positional deviation adjustment each time a counted value obtained by the counting unit increases by a predetermined amount, so as to reduce an amount of a positional deviation of the image caused when the image is superimposed on the transfer member or on the recording medium.

The above-described image forming apparatus may further include an optical writing device configured to optically write the respective image on the plurality of image bearing members, and a developing device configured to separately develop the respective images to respective visible toner images.

The count up value obtained when a reference size sheet having a predetermined size is conveyed toward the transfer member with a short side of the reference size sheet along a sheet travel direction may be regarded as a reference count value. In addition, the counting unit may be configured to determine the count up value by multiplying the reference count up value with an integer when a length of the recording medium in the sheet travel direction exceeds the short side of the reference sheet according to the detection result by the paper length detecting unit.

The reference sheet may include an A-size paper, and the counting unit may be configured to determine the count up value by multiplying the reference count value by two when a length of the recording medium in the sheet travel direction exceeds the short side of the A4-size paper according to the detection result by the paper length detecting unit.

The reference sheet may include a letter-size paper, and the counting unit may be configured to determine the count up value by multiplying by the reference count value by two when a length of the recording medium in the sheet travel direction exceeds the short side of the letter-size paper according to the detection result by the paper length detecting unit.

The above-described image forming apparatus may further include an amount setting unit configured to cause a user to set a variable amount of the count up value according to the detection result obtained by the paper length detecting unit. In addition, the counting unit may be configured to change the count up value by an amount obtained according to the input result of the amount setting unit.

The above-described image forming apparatus may further include a mode selecting unit configured to cause a user to select one of a count up operation mode for performing a count up operation to change the count up value according to the detection result obtained by the paper length detecting unit and a non count up operation mode for performing a count up operation to remain the count up value unchanged. In addition, the counting unit may be configured to select the count up mode according to an input result of the mode selecting unit.

The counting unit may clear a counted value to zero each time the counted value reaches a predetermined value.

The control unit may be configured to controllably form with the positional deviation adjustment a plurality of patterns on the plurality of respective image bearing members, transfer the plurality of patterns onto the transfer member, and adjust image forming conditions based on the detection result obtained by the image detecting unit.

The optical writing device may be configured to include a light deflecting unit configured to deflect light separately with respect to plurality of image bearing members.

Further, in one exemplary embodiment, an image forming method includes transferring respective images formed on a plurality of image bearing members to a transfer member included thereof, detecting the respective images conveyed on the transfer member, detecting a length of a recording medium in a sheet travel direction, counting the number of recording media including the recording medium conveyed to the transfer member, controlling an image forming timing with respect to the plurality of image bearing members based on a detection timing of the detected image, changing a count up value for each recording medium according to a result of the detecting of the length of the recording medium in the sheet travel direction, and performing a positional deviation adjustment each time a counted value obtained by the counting increased by a predetermined amount.

The above-described method may further include setting a variable amount of the count up value according to the result of the detecting of the length of the recording medium in the sheet travel direction. In addition, the counting may change the count up value by an amount obtained according to the input result of the setting.

The above-described method may further include selecting one of a count up operation mode for performing a count up operation to change the count up value according to the result of detecting the length of the recording medium and a non count up operation mode for performing a count up operation to keep the count up value unchanged. In addition, the counting may select the count up mode according to an input result of the selecting step.

Further, in one exemplary embodiment, a program for carrying out the above-described image forming method, the method includes transferring respective images formed on a plurality of image bearing member to a transfer member included thereof, detecting the respective images conveyed on the transfer member, detecting a length of a recording medium in a sheet travel direction, counting the number of recording media including the recording medium conveyed to the transfer member, controlling an image forming timing with respect to the plurality of image bearing members based on a detection timing of the detected image, changing a count up value for each recording medium according to a result of the detecting of the length of the recording medium in the sheet travel direction, and performing a positional deviation adjustment each time a counted value obtained by the counting increased by a predetermined amount.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
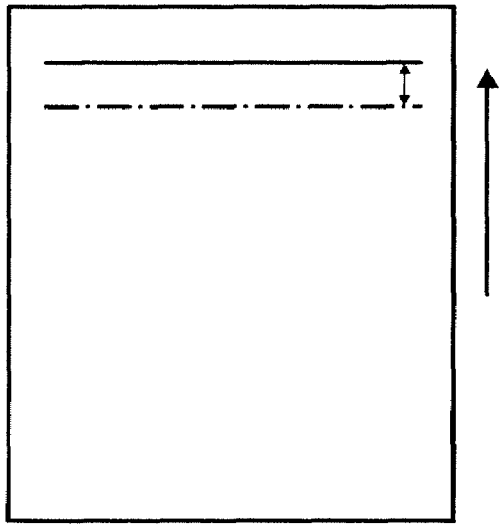
FIG. 1 BACKGROUND ART
FIG. 1 is a view for explaining color misregistration in a sub-scanning direction.
Figure 2:
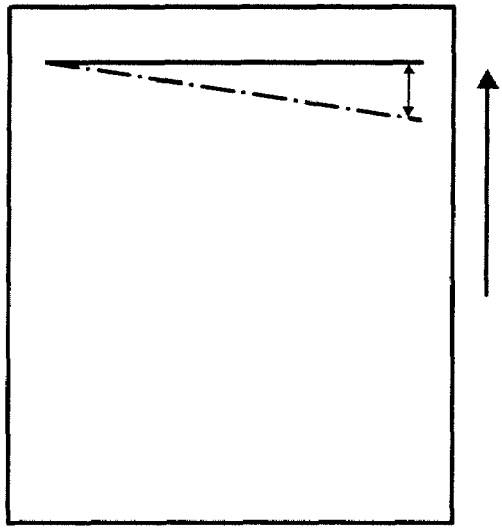
FIG. 2 BACKGROUND ART
FIG. 2 is a view for explaining skew shift.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 3:
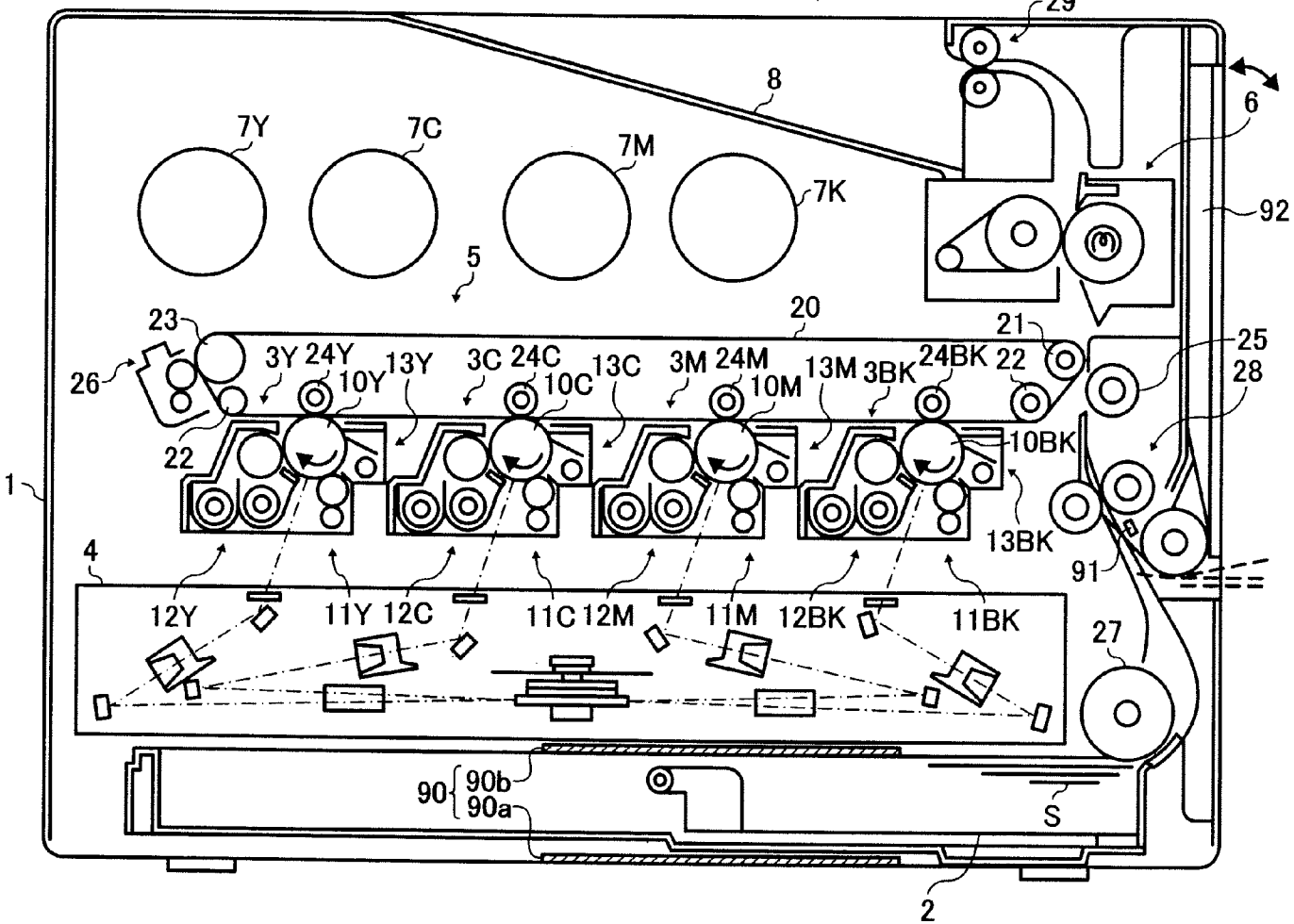
FIG. 3 is a schematic configuration of a printer according to at least one exemplary embodiment of the present invention.
Figure 4:
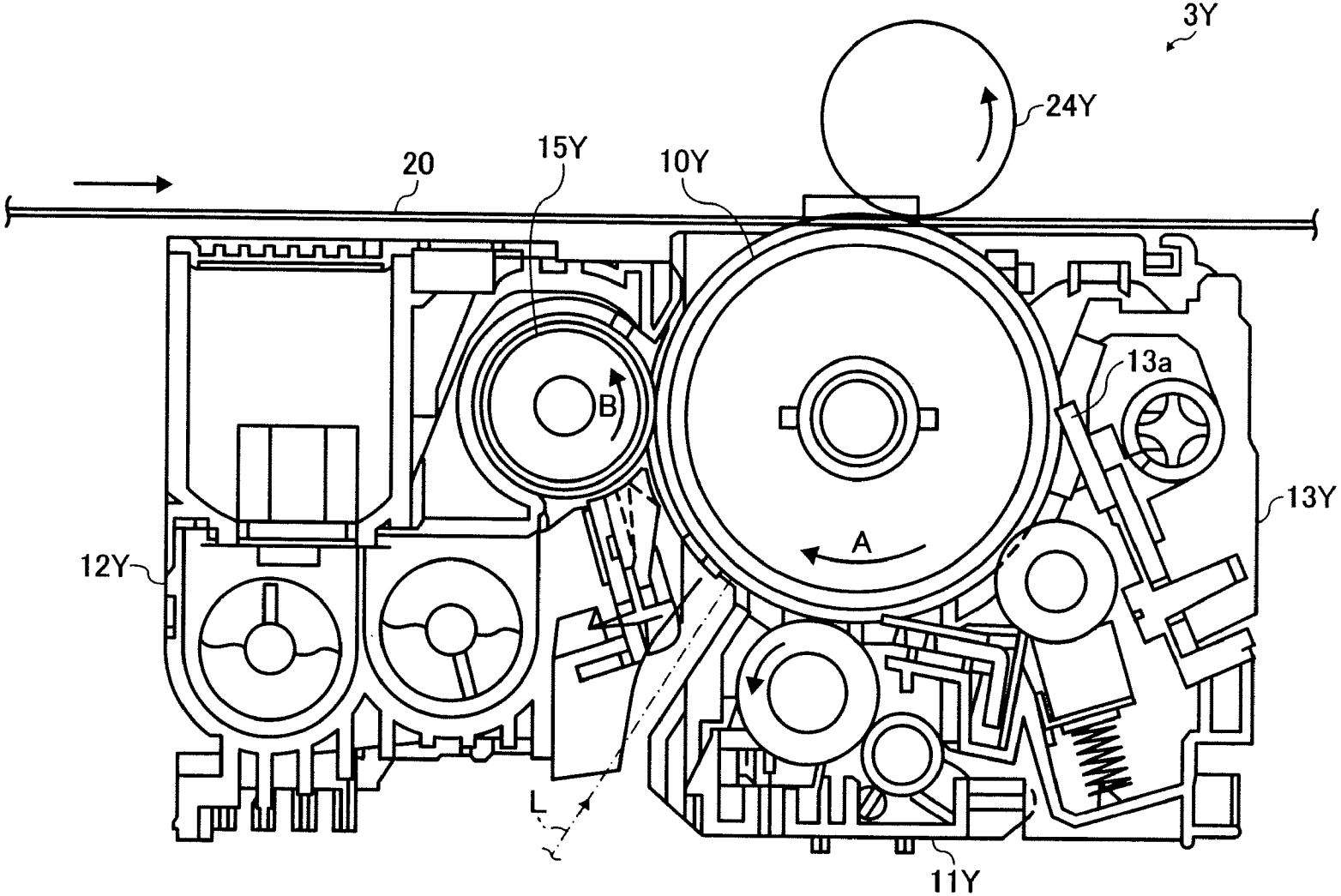
FIG. 4 is a schematic structure of an image forming section of the printer of FIG. 3.

Referring to FIGS. 3 and 4, schematic structures of a printer 100 according to an exemplary embodiment of the present invention is described.

FIG. 3 shows a schematic configuration of the printer 100 according to an exemplary embodiment of the present invention.

The printer 100 of FIG. 3 includes a main body 1 and a sheet feeding cassette 2 that can be inserted into or pulled out from the main body 1.

In a center part of the main body 1, the printer 100 includes image processing devices 3Y, 3C, 3M, and 3BK for forming images in yellow (Y), cyan (C), magenta (M), and black (BK).

Hereinafter, the suffixes "Y", "C", "M", and "BK" in any reference numerals represent members for forming yellow (Y), cyan (C), magenta (M), and black (BK) images, respectively.

Specifically, the suffixes of these reference numbers correspond to respective colors of toner. For example, "Y" corresponds to yellow color toner, "C" corresponds to cyan color toner, "M" corresponds to magenta color toner, and "BK" corresponds to black color toner.

FIG. 4 shows a schematic configuration of the image processing device 3Y. Since the image processing devices 3Y, 3C, 3M, and 3BK have similar structure and functions, except for different toner colors, the image processing device 3Y is focused in FIG. 4.

As shown in FIG. 3, the image processing devices 3Y, 3C, 3M, and 3BK include photoconductors 10Y, 10C, 10M, and 10BK, respectively.

The photoconductors 10Y 10C, 10M, and 10BK are formed as a drum shape and serve as image bearing members. A drive unit (not shown) drives each of the photoconductors 10Y, 10C, 10M, and 10BK to rotate in a direction indicated by arrows in FIG. 3, which is the same direction indicated by arrow A for the photoconductor 10Y shown in FIG. 4.

Each of the photoconductors 10Y 10C, 10M, and 10BK is formed of an aluminum cylindrical base having a diameter of approximately 40 mm and a photoconductive layer of e.g., organic photo semiconductor (OPC) covering the surface of the base.

The image processing devices 3Y, 3C, 3M, and 3BK have charging units 11Y, 11C, 11M, and 11BK, developing units 12Y, 12C, 12M, and 12BK, and cleaning units 13Y, 13C, 13M, and 13BK around the photoconductors 10Y 10C, 10M, and 10BK, respectively.

The charging units 11Y, 11C, 11M, and 11BK uniformly charge the surfaces of the photoconductors 10Y 10C, 10M, and 10BK, respectively.

The developing units 12Y, 12C, 12M, and 12BK develop respective electrostatic latent images formed on the surfaces of the photoconductors 10Y, 10C, 10M, and 10BK, respectively, into single color toner images. The developing units 12Y, 12C, 12M, and 12BK includes developing rollers 15Y, 15C, 15M, and 15BK, respectively, to carry yellow toner, cyan toner, magenta toner, and black toner, respectively. It is noted that only the developing roller 15Y is shown in FIG. 4 and the developing rollers 15C, 15M, and 15BK are not shown. However, the developing rollers 15Y, 15C, 15M, and 15BK have the similar structure and function to each other, except the colors of toner to carry thereon.

The cleaning units 13Y, 13C, 13M, and 13BK remove residual toner remaining on the surfaces of the photoconductors 10Y 10C, 10M, and 10BK, respectively.

An optical writing device 4 is disposed under the image processing devices 3Y, 3C, 3M, and 3BK. The optical writing device 4 is an optical scanner capable of emitting a laser light beam L in FIG. 4 (i.e., respective laser light beams La, Lb, Lc, and Ld in FIG. 5) to the photoconductors 10Y, 10C, 10M, and 10BK, respectively.

An intermediate transfer device 5 is provided above the image processing devices 3Y, 3C, 3M, and 3BK.

The intermediate transfer device 5 includes an intermediate transfer belt 20 onto which respective single color toner images formed by the image processing devices 3Y, 3C, 3M, and 3BK are to be transferred.

A fixing device 6 is also provided to fix the toner images transferred to the intermediate transfer belt 20 onto a transfer sheet S that serves as a recording medium.

In an upper part of the main body 1 of the printer 100 according to an exemplary embodiment of the present invention, toner bottles 7Y, 7C, 7M, and 7BK are provided.

The toner bottles 7Y, 7C, 7M, and 7BK accommodate the toner colors yellow (Y), cyan (C), magenta (M), and black (BK).

The toner bottles 7Y, 7C, 7M, and 7BK are detachable from the main body 1 by opening a sheet discharging tray 8 provided in an upper part of the main body 1.

The optical writing device 4 sequentially emits the laser light beam L toward the photoconductors 10Y, 10C, 10M, and 10BK to irradiate the respective surfaces of the photoconductors 10Y, 10C, 10M, and 10BK. The laser light beam L is emitted from a laser diode that is an optical source and is deviated in a main scanning direction by a polygon mirror or the like.

The details of the optical writing device 4 will be described later.

The intermediate transfer belt 20 of the intermediate transfer device 5 is formed in an endless shape and is extended by and spanned around a driving roller 21, tension rollers 22, and a driven roller 23.

The outer surface of the lower part of the endless shape of the intermediate transfer belt 20 is held in contact with the photoconductors 10Y, 10C, 10M, and 10BK to form respective primary transfer nips. While forming the respective primary transfer nips, the intermediate transfer belt 20 is driven to rotate in a counterclockwise direction in FIG. 3 and in a direction as indicated by an arrow in FIG. 4, according to the rotations of the driving roller 21 that is driven by a drive unit (not shown).

The intermediate transfer device 5 includes primary transfer rollers 24Y, 24C, 24M, and 24BK, a secondary transfer roller 25, and a belt cleaning unit 26.

The primary transfer rollers 24Y, 24C, 24M, and 24BK are held in contact with the inner surface of the lower part of the endless shape of the intermediate transfer belt 20. The primary transfer rollers 24Y, 24C, 24M, and 24BK are applied with a primary transfer bias to form primary transfer electric fields between the photoconductors 10Y, 10C, 10M, and 10BK and the primary transfer rollers 24Y, 24C, 24M, and 24BK, respectively. Under the above-described condition, the primary transfer rollers 24Y, 24C, 24M, and 24BK attract the toner images formed on the photoconductors 10Y 10C, 10M, and 10BK and transfer the toner images sequentially onto the intermediate transfer belt 20 in an overlaying manner.

The secondary transfer roller 25 is disposed to face the driving roller 21 with the intermediate transfer belt 20 therebetween. Similar to the primary transfer nips, a grounded secondary transfer nip is formed between the secondary transfer roller 25 and the driving roller 21. At the secondary transfer nip, a secondary transfer electric field is formed to attract and transfer the toner image formed on the intermediate transfer belt 20 to a transfer sheet S.

The belt cleaning unit 26 removes residual toner remaining on the intermediate transfer belt 20.

The printer 100 further includes a pair of paper size detection sensors 90 having a lower board 90*a* and an upper board 90*b*, a paper detection sensor 91, and a manual sheet feeding tray 92, all of which will be described later.

Next, operations of producing a color image in the printer 100 having the above-described the structure will be described.

First, in the image processing devices 3Y, 3C, 3M, and 3BK, the charging devices 11Y, 11C, 11M, and 11BK uniformly charge respective surfaces of the photoconductors 10Y, 10C, 10M, and 10BK. Then, the laser beam L (see FIG. 4) is exposed for scanning by the optical writing device 4 according to the image data, and electrostatic latent images are formed on the surfaces of the photoconductors 10Y, 10C, 10M, and 10BK. Then, the electrostatic latent images formed on the photoconductors 10Y, 10C, 10M, and 10BK are developed with toner of respective colors carried on the developing rollers 15Y, 15C, 15M, and 15BK of the developing devices 12Y, 12C, 12M, and 12BK and visualized as respective single color toner images. The developing rollers 15Y, 15C, 15M, and 15BK respectively rotate in a direction indicated by arrow B shown in FIG. 4.

The respective single color toner images on the photoconductors 10Y, 10C, 10M, and 10BK are sequentially transferred onto the intermediate transfer belt 20 so that the respective single color toner images are overlaid or superimposed on the intermediate transfer belt 20 rotating in the counterclockwise direction, under action of the respective primary transfer rollers 24Y, 24C, 24M, and 24BK.

At this time in the image formation operation, the image forming action of each color is executed while shifting the timing from upstream to downstream in the travel direction of the intermediate transfer belt 20 so that these single color toner images may be transferred and overlaid at the same position on the intermediate transfer belt 20.

After the primary transfer operations, residual toner remaining on the respective surfaces of the photoconductors 10Y, 10C, 10M, and 10BK are removed by a cleaning blade 13*a* (see FIG. 4) of the cleaning devices 13Y, 13C, 13M, and 13BK, so as to clean the respective surfaces of the photoconductors 10Y, 10C, 10M, and 10BK to be ready for the next image formation.

The respective color toners packed in the toner bottles 7Y, 7C, 7M, and 7BK are supplied in appropriate amounts to the developing devices 12Y, 12C, 12M, and 12BK of the respective image processing devices 3Y, 3C, 3M, and 3BK as necessary via a toner conveying path (not shown).

The transfer sheet S that is accommodated in the sheet feeding cassette 2 is conveyed into the main body 1 by a sheet feeding roller 27 provided in the vicinity of the sheet feeding cassette 2, and conveyed at a predetermined timing to the secondary transfer nip by a pair of registration rollers 28.

Then, at the secondary transfer nip, the overlaid or superimposed toner image formed on the intermediate transfer belt 20 is transferred onto the transfer sheet S.

The transfer sheet S, bearing the toner image transferred thereon, is conveyed to the fixing device 6 to fixedly form the toner image on the surface thereof, and is then discharged to the sheet discharging tray 8 by a sheet discharging roller 29.

Likewise, in the case of the photoconductors 10Y, 10C, 10M, and 10BK, residual toner remaining on the intermediate transfer belt 20 is removed by the belt cleaning device 26 that is held in contact with the intermediate transfer belt 20.

Figure 5:
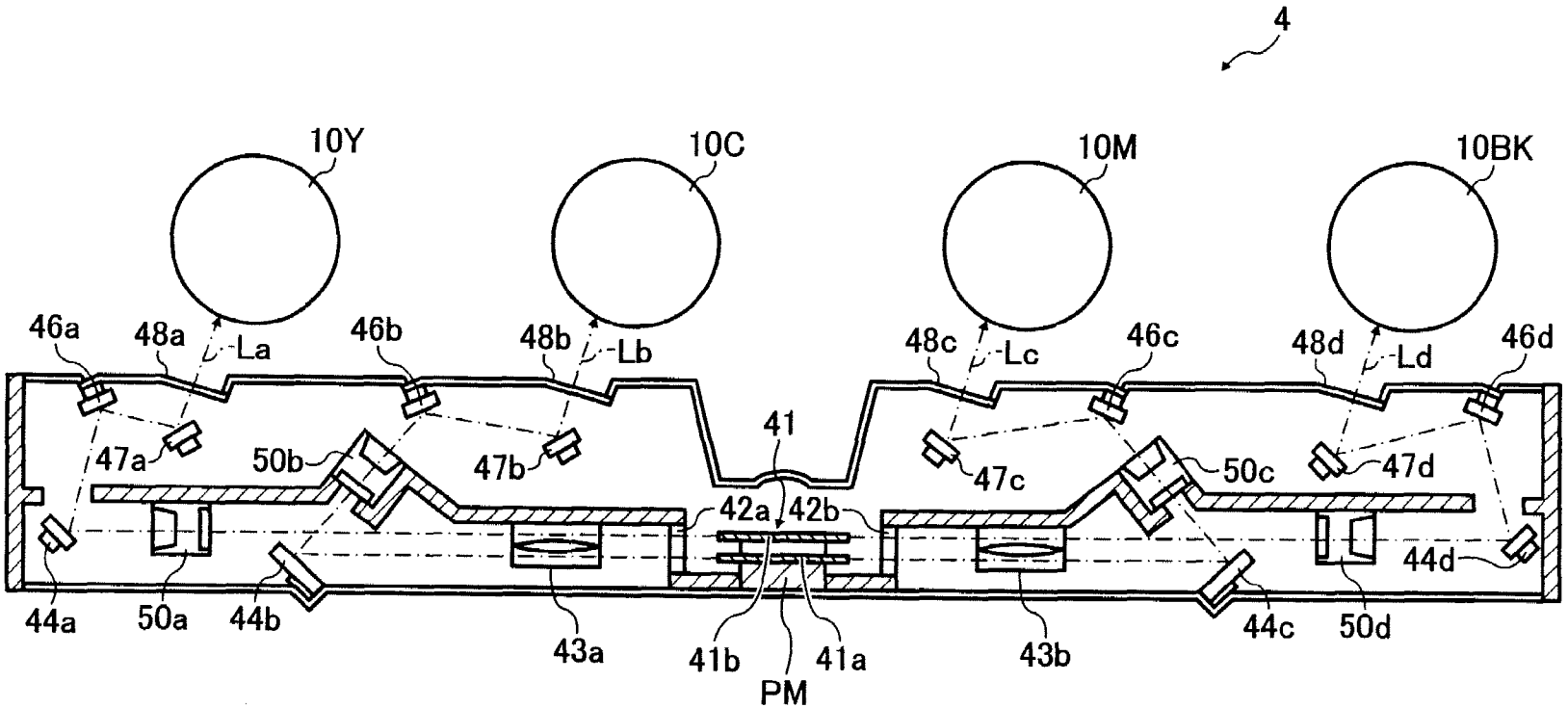
FIG. 5 is a schematic structure of an optical writing unit.

Referring now to FIG. 5, a structure of the optical writing device 4 is described.

In FIG. 5, the optical writing device 4 includes a polygon mirror unit 41 having two polygon mirrors 41*a* and 41*b* in the shape of a regular polygonal column.

The polygon mirrors 41*a* and 41*b* are integrally formed in the polygon mirror unit 41 in a multi-stage manner and have reflection mirrors on their lateral faces, and rotate at a high velocity about the center axis of the regular polygonal column as a center of rotation by means of a polygon motor PM.

When a laser light beam emitted from a laser diode (optical source, not shown) enters the lateral faces of polygon mirrors 41*a* and 41b, the laser light beam is deflected and scanned.

The optical writing device 4 also includes sound proof glasses 42*a* and 42*b* for achieving noise insulation effect of the polygon motor (e.g., the polygon mirrors 41*a* and 41*b*), f-theta lenses 43*a* and 43*b* that convert isometric motion of laser scanning to uniform linear motion by the polygon mirrors 41*a* and 41*b*, mirrors 44*a*, 44*b*, 44*c*, 44*d*, 46*a*, 46*b*, 46*c*, 46*d*, 47*a*, 47*b*, 47*c*, and 47*d* that guide the laser light beams La, Lb, Lc, and Ld to the photoconductors 10Y, 10C, 10M, and 10BK, respectively, long lens unit 50*a*, 50*b*, 50*c*, and 50*d* serving as adjustable members for connecting face tangle error of polygon mirror, and anti-dust glasses 48*a*, 48*b*, 48*c*, and 48*d* that prevent dust and the like from dropping into the housing of the optical writing device 4.

In FIG. 5, the numerals La, Lb, Lc, and Ld respectively indicate optical paths of writing the laser light beams emitted to the photoconductors 10Y, 10C, 10M, and 10BK.

The optical writing device 4 has an adjusting mechanism that adjusts curve and inclination of a scanning line. Inclination of the scanning line is adjusted by changing positions of the long lens units 50*a*, 50*b*, 50*c*, and 50*d* that are optical devices including respective long focal length lenses. The adjusting mechanism, by which inclination of scanning line is adjusted, is provided in the long lens units 50*a*, 50*b*, and 50*c* corresponding to the photoconductors 10Y, 10C, and 10M for yellow (Y), cyan (C), and magenta (M). However, the adjusting mechanism is not provided in the long lens unit 50*d* for black (BK) because the curves and inclinations of scanning lines of colors Y, C, and M are adjusted based on the curve and inclination of color BK.

Figure 6A:
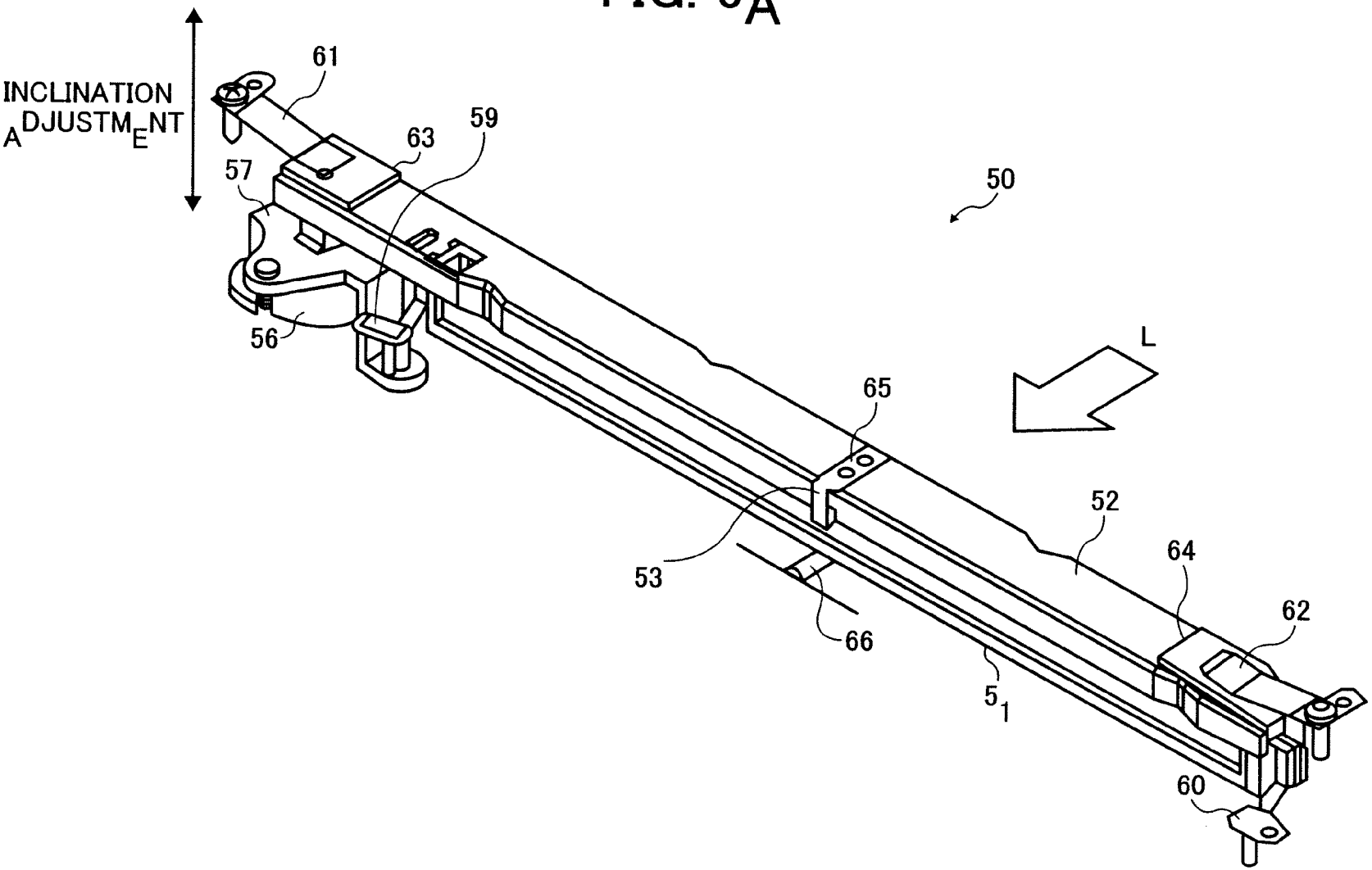
FIG. 6A is a perspective view of a long lens unit mounted in the optical writing unit.
Figure 6B:
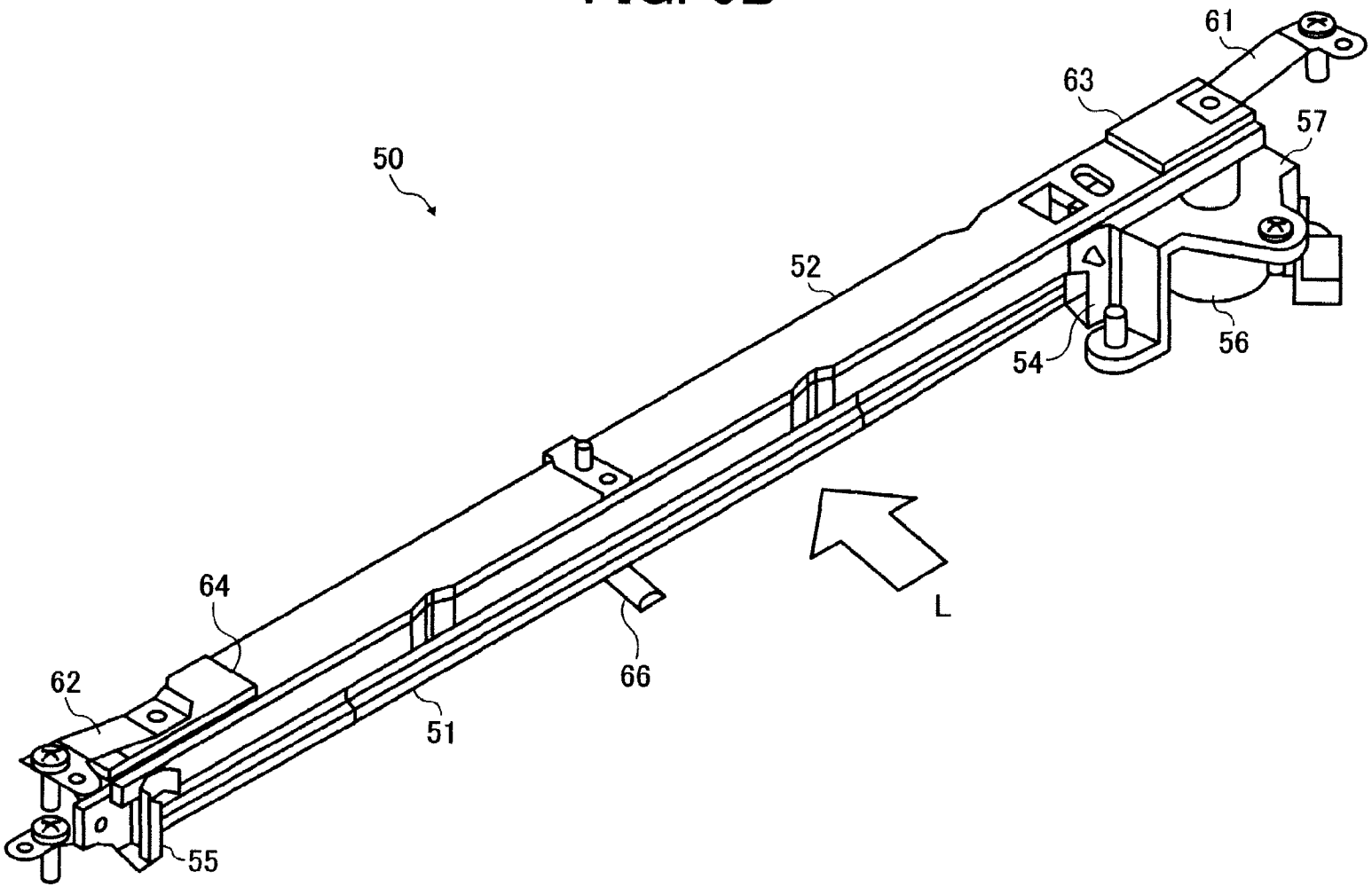
FIG. 6B is a perspective view of the long lens unit mounted in the optical writing unit.

Referring to FIGS. 6A and 6B, different views showing the adjusting mechanism are described. Hereinafter, the description of the adjusting mechanism will be made while taking the long lens unit 50*a* corresponding to the photoconductor 10Y for yellow (Y) as an example. In the description below, suffixes for representing color will be omitted.

FIGS. 6A and 6B are perspective views of the long lens unit 50, which is any of the long lens units 50*a*, 50*b*, 50*c*, and 50*d*.

FIGS. 6A and 6B are perspective views of different angles of the long lens unit 50 mounted in the optical writing device 4.

The long lens unit 50 has a long lens 51 that corrects face tangle errors of the polygon mirrors 41*a* and 41*b*, a bracket 52 that holds the long lens 51, a curve adjusting plate spring 53 (see FIG. 6A), securing plate springs 54 and 55 (see FIG. 6B) for securing the long lens 51 and the bracket 52, a driving motor 56 for automatically adjusting inclination of scanning line, a driving motor holder 57, a housing securing member 59 (see FIG. 6A), unit supporting plate springs 60, 61, and 62, smooth surface members 63 and 64 serving as a friction coefficient reducing unit, and a curve adjusting screw 65 (see FIG. 6A).

For adjusting an inclination of a scanning line, a rotation angle of the driving motor 56 is controlled based on a skew amount calculated by control of correction or adjustment of positional deviation as will be described later.

As a result, a lifting screw attached to the rotation axis of the driving motor 56 moves up and down and an end of the long lens unit 50 on the side of the driving motor 56 moves in the direction of the arrow indicated by a bidirectional arrow in FIG. 6A.

To be more specific, when the lifting screw moves up, the end on the side of the driving motor 56 of the long lens unit 50 rises against the force applied by the unit supporting plate spring 61. As a result, the long lens unit 50 swivels in the clockwise direction in FIG. 6A about a supporting base 66, and thus changes its position.

On the other hand, when the lifting screw moves down, the end of the side of the driving motor 56 of the long lens unit 50 moves down by the help of the force applied by the unit supporting plate spring 61. As a result, the long lens unit 50 swivels in the counterclockwise direction in FIG. 6B, supported on the supporting base 66, and thus changes the position.

When the position of the long lens unit 50 changes in the manner as described above, the position at which the laser light beam L enters the entrance face of the long lens 51 also changes.

The long lens 51 has the following characteristic: when the entrance position of the laser light beam L on the entrance face of the long lens 51 changes the direction that is perpendicular to the longitudinal direction and the direction of optical path of the long lens 51 (vertical direction), the angle relative to the vertical direction of the laser light beam L outgoing from the outgoing face of the long lens 51 (outgoing angle) changes.

Due to this characteristic, when the position of the long lens unit 50 changes by means of the lifting screw, the outgoing angle of the laser light beam L outgoing from the outgoing face of the long lens 51 changes correspondingly, with the result that the inclination of the scanning line on the photoconductor 10 by this laser light beam L changes.

Figure 7:
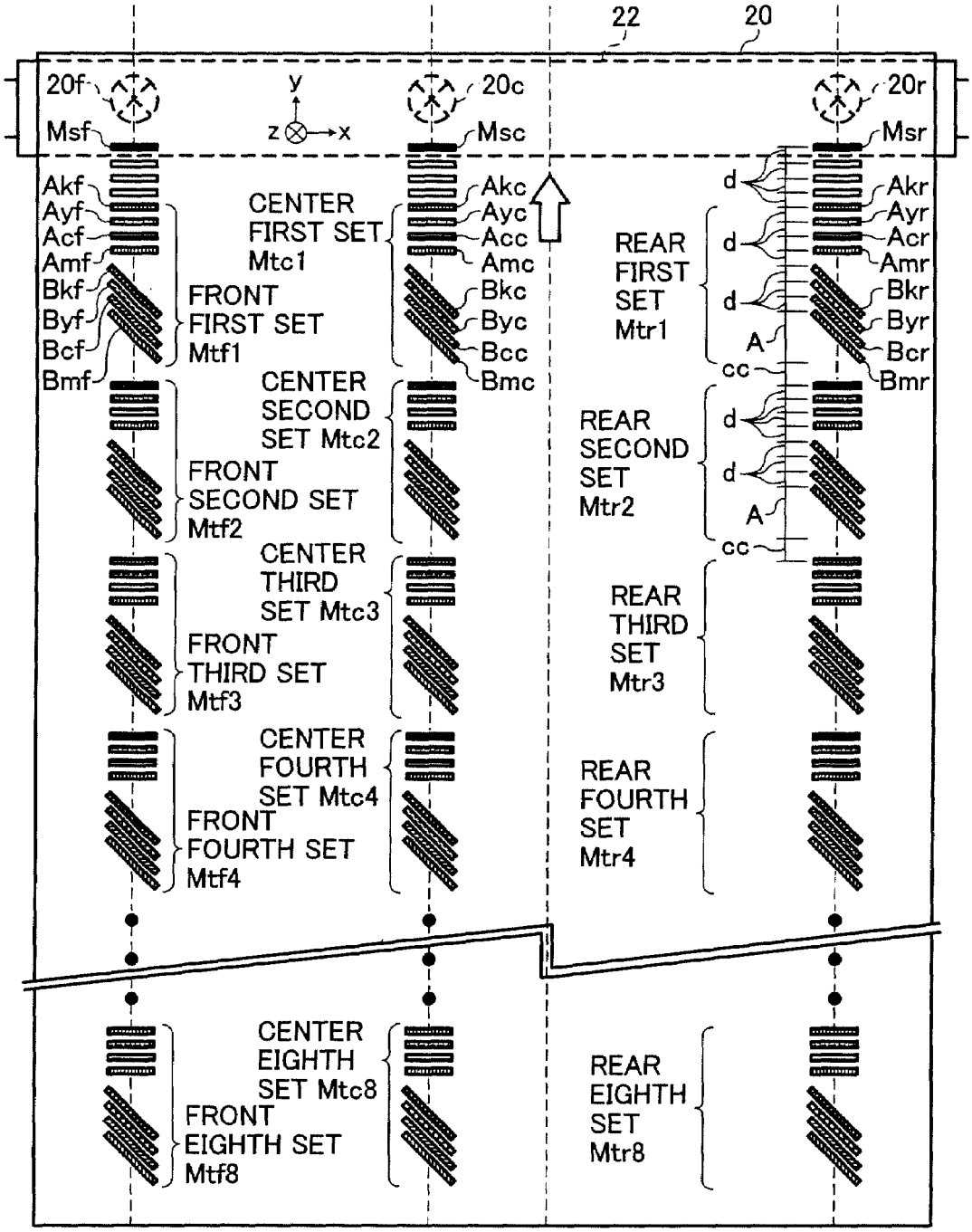
FIG. 7 is a view for explaining a group of mark patterns formed on an intermediate transfer belt.

Referring to FIG. 7, the control of color misregistration adjustment is described.

FIG. 7 is a view for explaining a group of mark patterns formed on an intermediate transfer belt, e.g., the intermediate transfer belt 20.

As previously described, color misregistration may be caused by positional deviation. Therefore, by reducing the positional deviation, the color misregistration can be reduced or prevented, if possible.

As shown in FIG. 7, in conducting the control of color misregistration adjustment, positional deviation detection images, which are also referred to as test patterns, are formed on the intermediate transfer belt 20.

In FIG. 7, a direction "x" represents a direction perpendicular to the travel direction of the intermediate transfer belt 20, which can be a horizontal scanning direction or width direction of the intermediate transfer belt 20. Further, in FIG. 7, a direction "y" represents the travel direction of the intermediate transfer belt 20, which can be a vertical scanning direction or vertical direction of the intermediate transfer belt 20.

The positional deviation detection images formed on the intermediate transfer belt 20 are read by optical sensors 20*r*, 20*f*, and 20*c*. The optical sensors 20*r*, 20*c*, and 20*f* serve as image detecting unit.

Detailed descriptions of the positional deviation detection images are illustrated below.

In a rear end part (rear) along the direction "x" of the intermediate transfer belt 20, a start mark Msr of black (BK) is formed followed by a space of four pitches (4xd) of mark pitch "d", and eight sets of mark sets Mtr1 to Mtr8 are sequentially formed within one-twentieths cycle of the intermediate transfer belt 20 at a set pitch or constant pitch of 7d+A+cc.

It is noted that three outline rectangular boxes shown in the area explaining the space of four pitches 4*d* in FIG. 7 are drawn for convenience. The actual image has no visible outline rectangular boxes in the area shown in FIG. 7.

In the printer 100 according to an exemplary embodiment of the present invention, as rear side detection images or test patterns, a start mark Msr and eight sets of mark sets Mtr1 to Mtr8 are formed within one cycle of the rear end part of the intermediate transfer belt 20, and the start mark Msr and the eight sets of mark sets Mtr1 to Mtr8 include a total of 65 marks.

The first mark set Mtr1 includes as a perpendicular mark group with a group of marks that are parallel with the direction "x":

first perpendicular mark Akr of black (BK);
second perpendicular mark Ayr of yellow (Y);
third perpendicular mark Acr of cyan (C); and
fourth perpendicular mark Amr of magenta (M).

The first mark set Mtr1 further includes as a diagonal mark group with a group of marks that form an angle of 45 degrees with respect to the direction "x":

first diagonal mark Bkr of black (BK);
second diagonal mark Byr of yellow (Y);
third diagonal mark Bcr of cyan (C); and
fourth diagonal mark Bmr of magenta (M).

The marks Akr to Amr and Bkr to Bmr are arranged at a mark pitch "d" in the direction "y."

The second to eight mark sets Mtr2 to Mtr8 are identical to the first mark set Mtr1, and the mark sets Mtr1 to Mtr8 are arranged at a clearance "cc" in the direction "y." Like the start mark Msr describe above, in a front end part (front) along the direction "x" of the intermediate transfer belt 20, a start mark Msf of black (BK) is formed followed by a space of four pitches (4xd) of mark pitch "d", and eight sets of mark sets Mtf1 to Mtf8 are sequentially formed within one-twentieths cycle of the intermediate transfer belt 20 at a set pitch or constant pitch of 7d+A+cc.

In the printer 100 according to an exemplary embodiment of the present invention, as front side positional deviation detection images or test patterns, a start mark Msf and eight sets of mark sets Mtf1 to Mtf8 are formed within one cycle of the front end part of the intermediate transfer belt 20, and the start mark Msf and the eight sets of mark sets Mtf1 to Mtf8 include a total of 65 marks.

The first mark set Mtf1 includes as a perpendicular mark group with a group of marks that are parallel with the direction "x":

first perpendicular mark Akf of black (BK);
second perpendicular mark Ayf of yellow (Y);
third perpendicular mark Acf of cyan (C); and
fourth perpendicular mark Amf of magenta (M).

The first mark set Mtf1 further includes as a diagonal mark group with a group of marks that form an angle of 45 degrees with respect to the direction "x":

first diagonal mark Bkf of black (BK);
second diagonal mark Byf of yellow (Y);
third diagonal mark Bcf of cyan (C); and
fourth diagonal mark Bmf of magenta (M).

The marks Akf to Amf and Bkf to Bmf are arranged at a mark pitch "d" in the direction "y".

The second to eight mark sets Mtf2 to Mtf8 are identical to the first mark set Mtf1, and the mark sets Mtf1 to Mtf8 are arranged at a clearance "cc" in the direction "y".

Like the start mark Msf described above, in a center part (center) along the direction "x" of the intermediate transfer belt 20, a start mark Msc of black (BK) is formed followed by a space of four pitches (4xd) of mark pitch "d", and eight sets of mark sets Mtc1 to Mtc8 are sequentially formed within one-twentieths cycle of the intermediate transfer belt 20 at a set pitch or constant pitch of 7d+A+cc.

In the printer 100 according to an exemplary embodiment of the present invention, as center positional deviation detection images or test patterns, a start mark Msc and eight sets of mark sets Mtc1 to Mtc8 are formed within one cycle of the center part of the intermediate transfer belt 20, and the start mark Msc and the eight sets of mark sets Mtc1 to Mtc8 include a total of 65 marks.

The first mark set Mtc1 includes as a perpendicular mark group with a group of marks that are parallel with the direction "x":

first perpendicular mark Akc of black (BK);
second perpendicular mark Ayc of yellow (Y);
third perpendicular mark Acc of cyan (C); and
fourth perpendicular mark Amc of magenta (M).

The first mark set Mtc1 further includes as a diagonal mark group with a group of marks that form an angle of 45 degrees with respect to the direction "x":

first diagonal mark Bkc of black (BK);
second diagonal mark Byc of yellow (Y);
third diagonal mark Bcc of cyan (C); and
fourth diagonal mark Bmc of magenta (M).

The marks Akc to Amc and Bkc to Bmc are arranged at a mark pitch "d" in the direction "y."

The second to eight mark sets Mtc2 to Mtc8 are identical to the first mark set Mtc1, and the mark sets Mtc1 to Mtc8 are arranged at a clearance "cc" in the direction "y".

The last character "r" in the reference names denoting the marks Msr, Akr to Amr, and Bkr to Bmr contained in these positional deviation detection images or test patterns represents that the mark belongs to the rear end part.

The last character "f" in the reference names denoting the marks Msf, Akf to Amf, and Bkf to Bmf contained in these positional deviation detection images or test patterns represents that the mark belongs to the front end part.

The last character "c" in the reference names denoting the marks Msc, Akc to Amc, and Bkc to Bmc contained in these positional deviation detection images or test patterns represents that the mark belongs to the center part.

These first mark sets of the eight mark sets belonging to the front end part, the rear end part, and the center part are collectively called "one mark set group."

Referring to FIGS. 8A, 8B, 9A, and 9B, structure and function of a process controller 110 of the printer 100 are described.

Figure 8A:
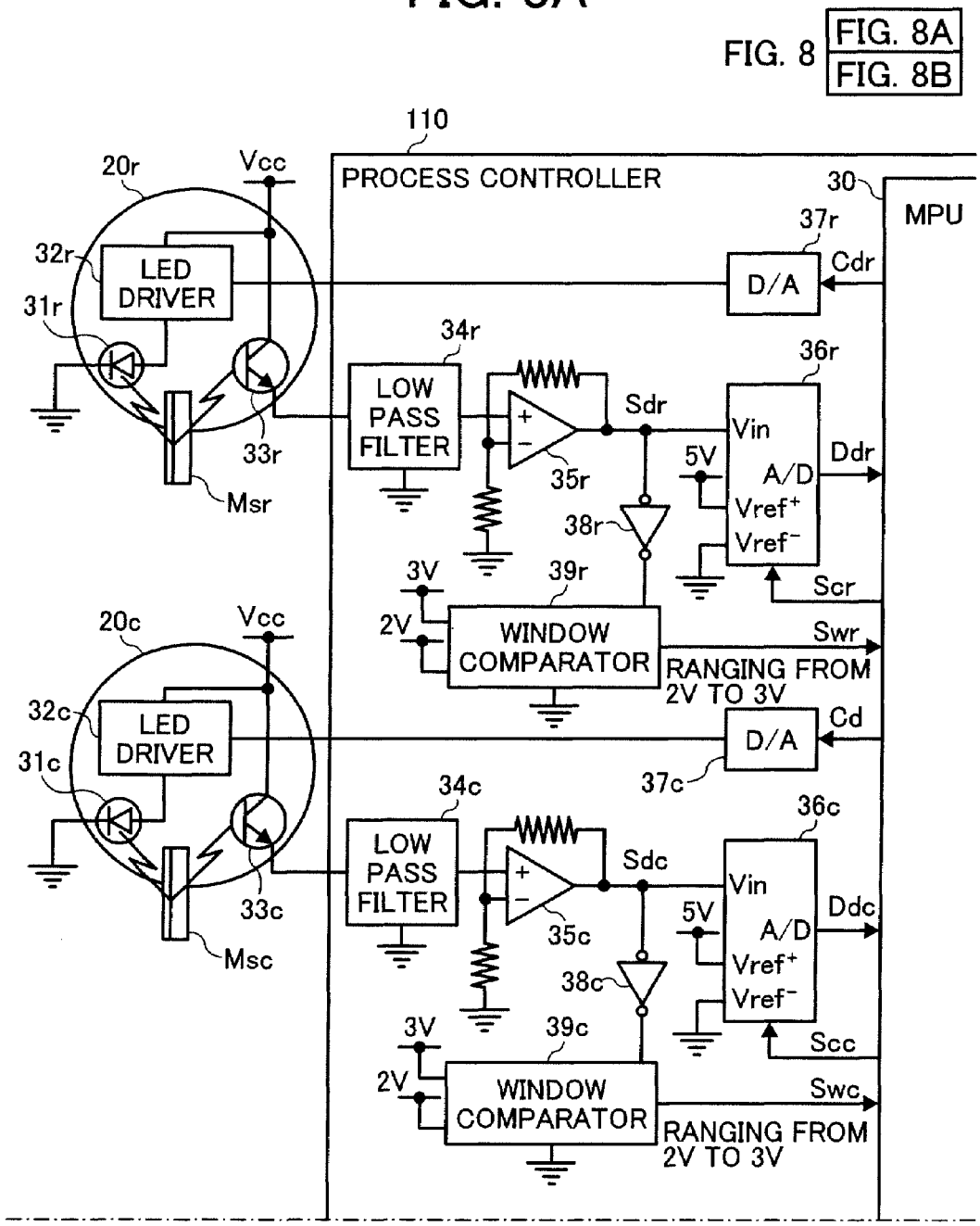
FIG. 8A is one part of a diagram for explaining a part of a control unit of the printer of FIG. 3.
Figure 8B:
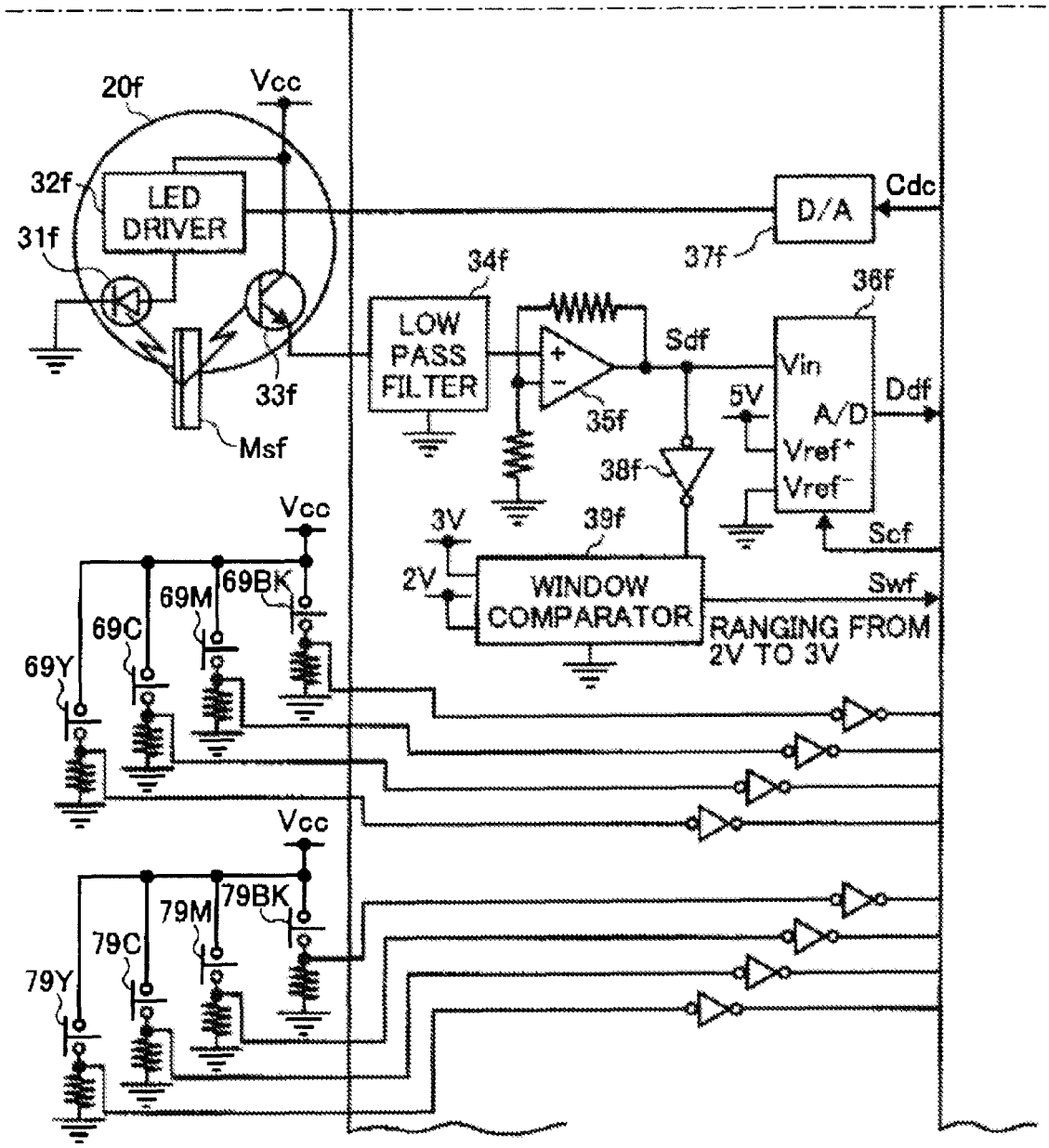
FIG. 8B is another part of the diagram of FIG. 8A.

FIGS. 8A and 8B show a diagram of a part of the process controller 110 of the printer 100.

Specifically, FIGS. 8A and 8B show micro switches 69BK, 69M, 69C, and 69Y for detecting attachment of the image processing devices 3BK, 3M, 3C, and 3Y (see FIG. 1), respectively, of respective colors, micro switches 79BK, 79M, 79C, and 79Y for detecting attachment of the developing devices 12BK, 12M, 12C, and 12BK (see FIG. 1) of respective colors, and the optical sensors 20*r*, 20*c*, and 20*f*, as well as electric circuits for reading detection signals thereof.

The process controller 110 includes a micro computer 30 that mainly includes a read-only memory or ROM, a random access memory or RAM, a central processing unit or CPU, a first-in first-out memory or FIFO memory for storing detection data, and so forth. Hereinafter, the micro computer 30 is referred to as an "MPU 30."

The MPU 30 serves as a control unit that conducts operations of positional deviation adjustment for reducing positional deviation generally caused due to replacement of image forming components or parts by a new image forming component or part, which can result in a reduction of occurrence of color misregistration or a reduction of frequency of a color misregistration adjustment.

In a mark detecting stage, the micro computer 30 supplies digital-to-analog converters or D/A converters 37*r*, 37*c*, and 37*f* with conduction data that specifies conduction currents of light emitting diodes (LEDs) 31*r*, 31*c*, and 31*f* of the optical sensors 20*r*, 20*c*, and 20*f* shown in FIG. 7.

The D/A converters 37*r*, 37*c*, and 37*f* send the conduction data to LED drivers 32*r*, 32*c*, and 32*f* after converting the conduction data into analog voltages.

These drivers 32*r*, 32*c*, and 32*f* energize the LEDs 31*r*, 31*c*, and 31*f* with currents that are proportional to the analog voltages from the D/A converters 37*r*, 37*c*, and 37*f*.

The laser light beams La, Lb, Lc, and Ld occurring at LEDs 31*r*, 31*c*, and 31*f* hit on the intermediate transfer belt 20 (see FIG. 7) after passing through a slit (not shown), and most of the laser light beams La, Lb, Lc, and Ld transmit to the intermediate transfer belt 20 and are reflected by one of the tension rollers 22, which is disposed on the right hand side of the transfer device 5 of the printer 100 in FIG. 3.

The reflected laser light beams La, Lb, Lc, and Ld transmit the intermediate transfer belt 20 and hit on transistors 33*r*, 33*c*, and 33*f* through another slit (not shown).

As a result, impedances between collector and emitter in the transistors 33*r*, 33*c*, and 33*f* become low, and emitter potentials of the transistors 33*r*, 33*c*, and 33*f* increase.

When the marks on the intermediate transfer belt 20 reach the positions opposing the LEDs 31*r*, 31*c*, and 31*f*, the marks block the light from the LEDs 31*r*, 31*c*, and 31*f*.

Accordingly, impedances between collector and emitter in the transistors 33*r*, 33*c*, and 33*f* increase, and emitter voltages of the transistors 33*r*, 33*c*, and 33*f*, or levels of detection signals of the optical sensors 20*r*, 20*c*, and 20*f* decrease.

Therefore, as described above, when the positional deviation detection images or test patterns are formed on the moving intermediate transfer belt 20, the detection signals of the optical sensors 20*r*, 20*c*, and 20*f* rise or fall.

A high level of detection signal means that the "mark is absent", while a low level of detection signal means that the "mark is present." In this way, the optical sensors 20*r*, 20*c*, and 20*f* constitute a mark detecting unit that detects each mark of rear side, each mark of center part, and each mark of front side on the intermediate transfer belt 20.

Therefore the optical sensors 20*r*, 20*c*, and 20*f* serve as image detecting unit for detecting a plurality of visible images or marks.

The detection signals of the optical sensors 20*r*, 20*c*, and 20*f* are passed through low-pass filters 34*r*, 34*c*, and 34*f* for removing high-frequency noise and the levels thereof are calibrated to 0V to 5V by amplifiers 35*r*, 35*c*, and 35*f* for level calibration, and then applied to analog-to-digital or A/D converters 36*r*, 36*c*, and 36*f*.

Figure 9A:
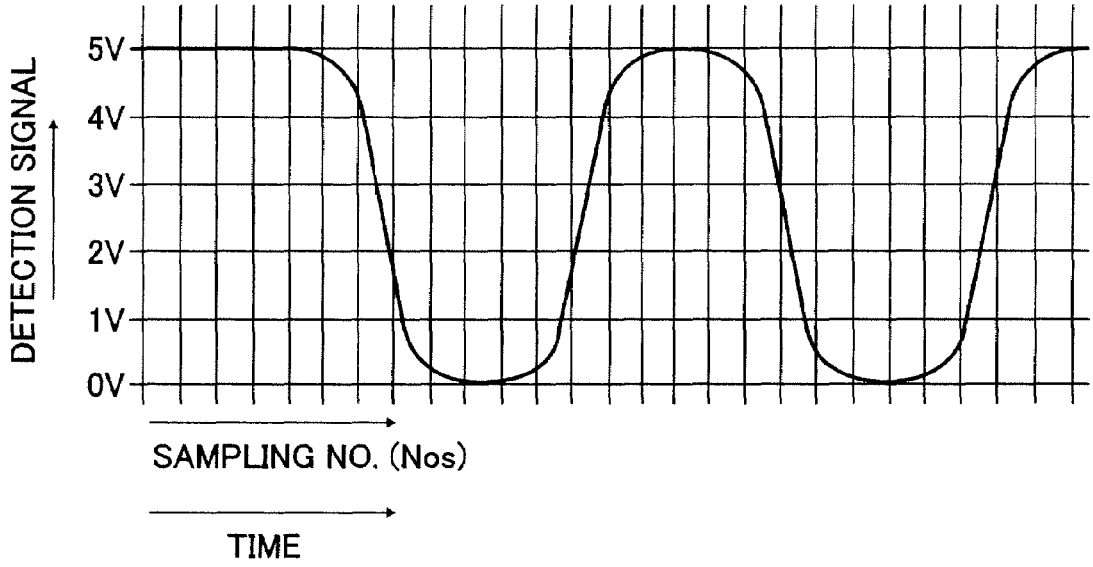
FIG. 9A is a timing chart of detection signals of the mark patterns.
Figure 9B:
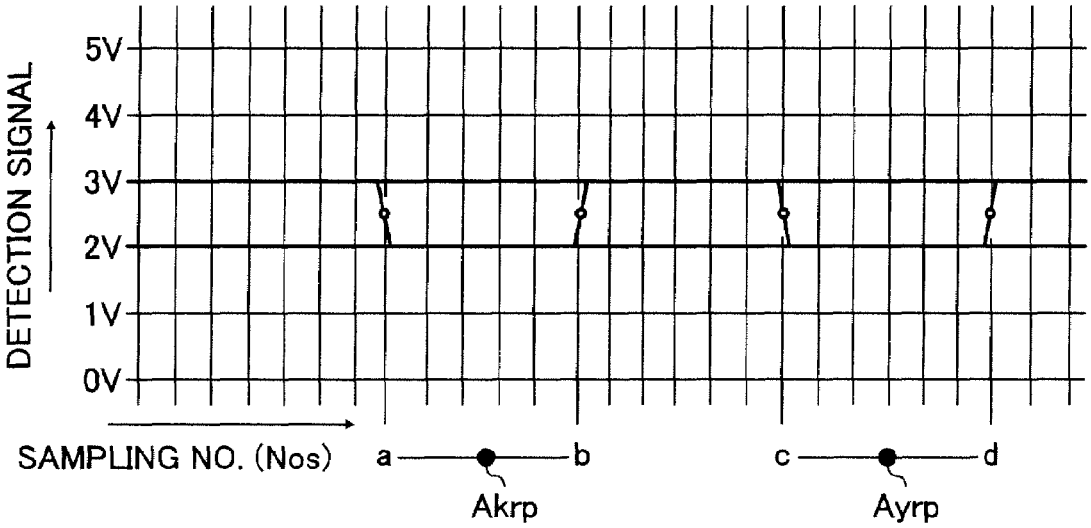
FIG. 9B is a timing chart representing only a range of the detection signals shown in FIG. 9A in which A/D conversion data is a written into a FIFO memory.

FIG. 9A is a timing chart of detection signals Sdr, Sdc, and Sdf of the mark patterns. FIG. 9B is a timing chart of level determination signals of low level L Swr, Swc, and Swf of the mark patterns.

The detection signals Sdr, Sdc, and Sdf have the wave forms as shown in FIG. 9A. In other words, at 5V the tension roller 22 is detected, and at 0V a mark is detected.

The part in which the signal falls from 5V to 0V means the leading end of a mark, and the part in which the signal rises from 0V to 5V means the trailing end of a mark.

The width of the mark is defined between the falling part and the raising part. These detection signals Sdr, Sdc, and Sdf are supplied to the A/D converters 36*r*, 36*c*, and 36*f* as shown in FIGS. 8A and 8B, as well as to window comparators 39*r*, 39*c*, and 39*f* through amplifiers 38*r*, 38*c*, and 38*f* shown in FIGS. 8A and 8B.

The A/D converters 36*r*, 36*c*, and 36*f* have sample hold circuits on their input sides in the interior thereof, and data latches (output latches) on their output sides. Upon reception of A/D conversion indicating signals Scr, Scc, and Scf from the MPU 30, the A/D converters 36*r*, 36*c*, and 36*f* hold the current detection signals Sdr, Sdc, and Sdf from the amplifiers 35*r*, 35*c*, and 35*f* and convert the current detection signals Sdr, Sdc, and Sdf to digital data and store in the data latches. Therefore, when it is necessary to read the detection signals Sdr, Sdc, and Sdf, the MPU 30 can supply the A/D converters 36*r*, 36*c*, and 36*f* with the A/D conversion indicating signals Scr, Scc, and Scf, and read digital data representing the levels of the detection signals Sdr, Sdc, and Sdf, which are detection data Ddr, Ddc, and Ddf.

The window comparators 39*r*, 39*c*, and 39*f* issue the level determination signals of low level L for signals Swr, Swc, and Swf when the detection signals from the amplifiers 38*r*, 38*c*, and 38*f* are at levels ranging from 2V to 3V. On the other hand, the window comparators 39*r*, 39*c*, and 39*f* issue level determination signals of high level H for signals Swr, Swc, and Swf when the detection signals from the amplifiers 38*r*, 38*c*, and 38*f* are out of the levels ranging from 2V to 3V.

FIG. 9B shows level determination signals of low level L for signals Swr, Swc, and Swf.

The MPU 30 can immediately recognize whether the detection signals Sdr, Sdc, and Sdf fall within the range by looking up these level determination signals Swr, Swc, and Swf.

Further, the MPU 30 captures from the micro switches 69BK to 69Y and 79BK to 79Y signals that represent an open/close status thereof.

Figure 10A:
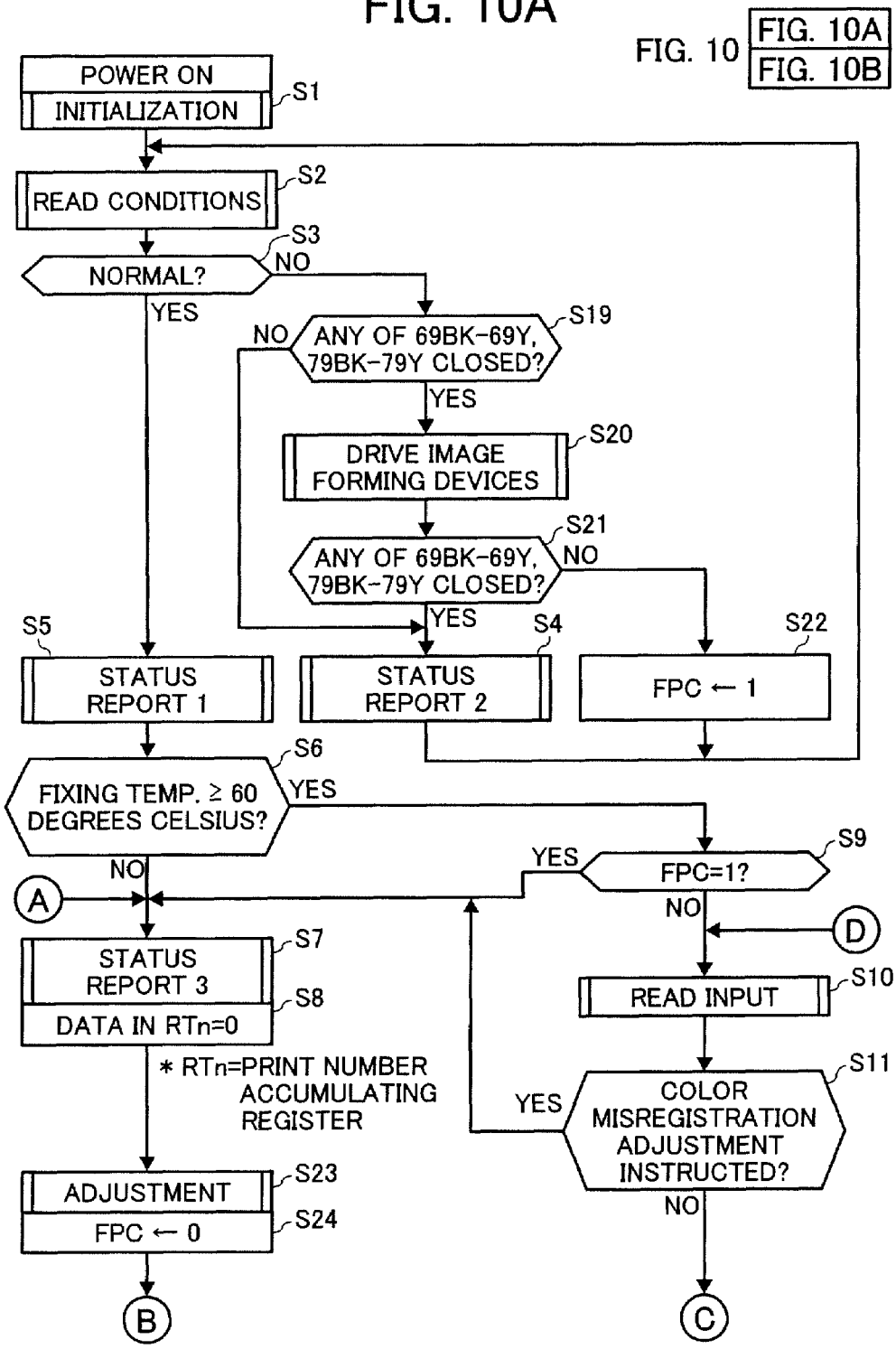
FIG. 10A is one part of a flowchart for explaining a part of control flow of the printer of FIG. 3.
Figure 10B:
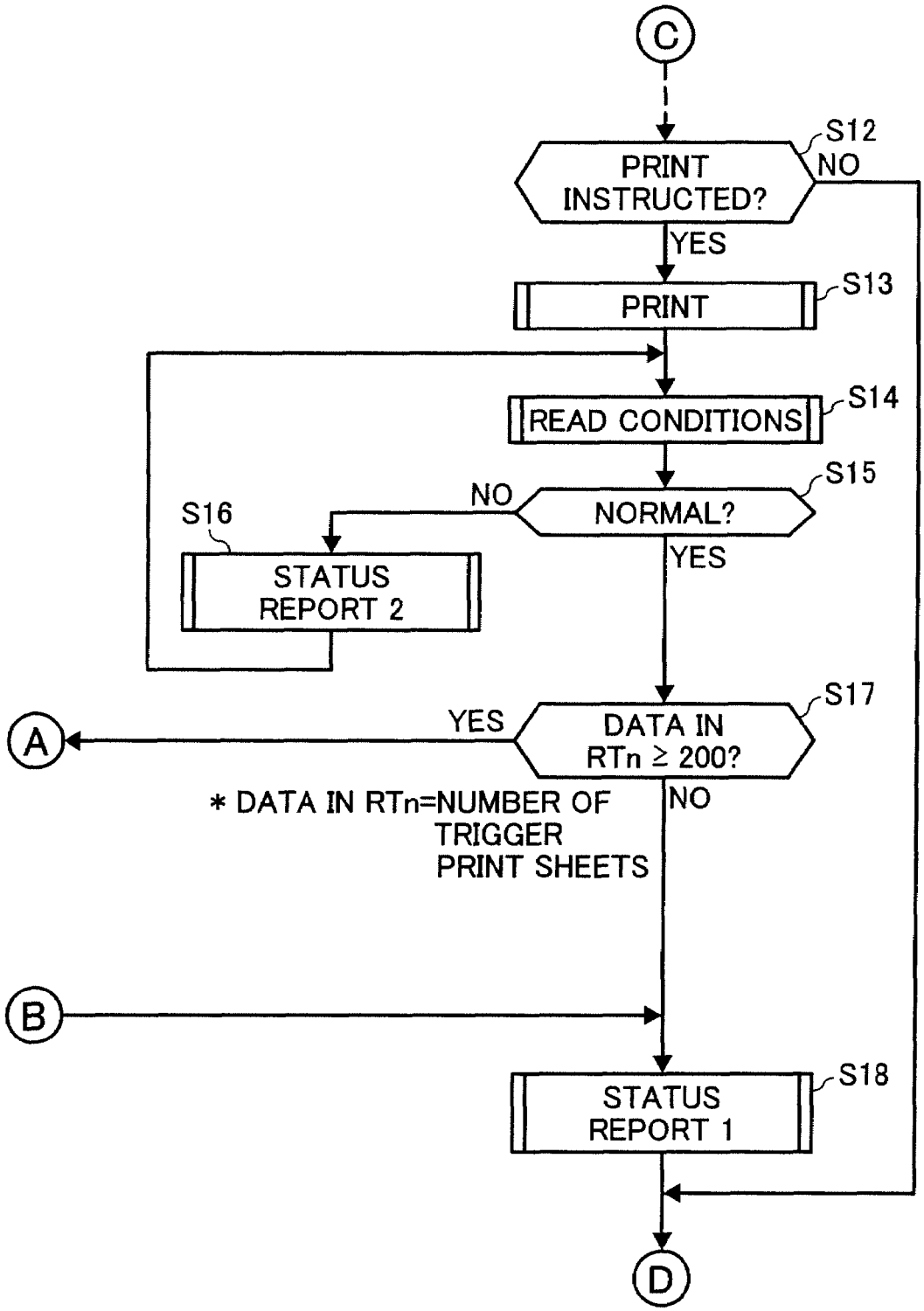
FIG. 10B is another part of the flowchart of FIG. 10A.

Referring to FIGS. 10A and 10B, a flowchart of a control flow of the MPU 30 of the printer 100 is described.

In step S1 in the flowchart of FIGS. 10A and 10B, when an operation voltage is applied upon turning on the power of the printer 100, the MPU 30 sets the signal level in the input/output port at a condition for standby state, and sets an internal register and a timer at conditions for standby state, which is an initialization operation.

After completing the initialization in step S1, the MPU 30 determines whether any trouble occurs in image formation by reading conditions of the mechanical parts and electric circuits of the printer 100 in steps S2 and S3.

When the condition is normal, the result of step S3 is YES, and the process goes to step S5.

When the condition is not normal, the result of step S3 is NO, and the process goes to step S19.

In step S19, the MPU 30 checks the open/close status of the micro switches 69BK to 69Y and 79BK to 79Y. When none of the micro switches 69BK to 69Y and 79BK to 79Y is closed (ON), the result of step S19 is NO, and the process goes to step S4.

In step S4, the MPU 30 makes an operation display board or operation panel inform of the abnormality as "status report 2", and the process goes back to step S2.

When any one of the micro switches 69BK to 69Y and 79BK to 79Y is closed (ON), the result of step S19 is YES, that is, an unit (e.g., any of the developing devices 12Y, 12C, 12M, and 12BK and the image processing devices 3Y, 3C, 3M, and 3BK) corresponding to the closed micro switch is not attached to the printer 100, or it is in the power ON state immediately after replacement of the unit by a new unit.

The micro switches 69BK to 69Y are switches that detect the presence/absence of attachment of four image processing devices 3Y, 3C, 3M, and 3BK including the charging device 11, the photoconductor 10, and the cleaning device 13 of each of the image processing devices 3Y, 3C, 3M, and 3BK to the main body 1 of the printer 100.

The micro switches 79BK to 79Y are switches that detect presence/absence of attachment of the developing devices 12Y, 12C, 12M, and 12BK of each of the image processing devices 3Y, 3C, 3M, and 3BK to the main body 1 of the printer 100.

When any one of micro switches 69BK to 69Y and 79BK to 79Y is closed (ON), the result of step S19 is YES, and the MPU 30 temporarily drives the four image forming devices 3Y, 3C, 3M, and 3BK that respectively form images on the photoconductors 10BK, 10M, 10C, and 10Y in step S20.

To be more specific, the intermediate transfer belt 20 is driven, and the charging rollers of the charging devices 11BK, 11M, 11C, and 11Y and the developing devices 12BK, 12M, 12C, and 12Y that respectively contact the photoconductors 10BK, 10M, 10C, and 10Y are rotated.

In step S21, the MPU 30 determines the open/close status of the micro switches 69BK to 69Y and 79BK to 79Y.

When any one of the micro switches 69BK to 69Y and 79BK to 79Y is closed (ON), the result of step S21 is YES, and the process goes to step S4.

When none of the micro switches 69BK to 69Y and 79BK to 79Y is closed (ON), the result of step S21 is YES, and the process goes to step S22.

Specifically, immediately after replacement of the image processing devices 3Y, 3C, 3M, and 3BK or the developing devices 12Y, 12C, 12M, and 12BK by new devices, the micro switch that is in the closed state is switched into the open state (unit attached) by the drive of the image forming devices 3Y, 3C, 3M, and 3BK.

On the other hand, when the unit is not attached to the printer 100, the micro switch remains in the closed state.

As a result of driving the image forming devices 3Y, 3C, 3M, and 3BK, when any one of the micro switches 69BK to 69Y and 79BK to 79Y that are closed is switched to the open state, the result of step S21 is NO, and the process proceeds to step S22.

In this case, for example, when the micro switches 69BK that detects the detachment of the image processing device 3BK of black (BK) is switched from closed to open, the MPU 30 clears the print number accumulating register RTn (one area on nonvolatile memory) corresponding to the image processing device 3BK of black (BK). In other words, the MPU 30 initializes the black color print accumulation number to zero, and writes a "1" indicating that the unit is replaced into a unit replacement register FPC in step S22. After step S22, the process goes back to step S2.

On the other hand, when no micro switch is switched to open, the result of step S21 is YES, and the process goes to step S4.

In this case, it is regarded that there is no unit attachment, and the MPU 30 makes an operation display board or an operation panel inform of the abnormality as "status report 2" in step S4.

Then the flow of condition reading, abnormality check and abnormality report described in steps S2 to S4 is repeated until no abnormality is detected.

The operation display board includes a displaying unit that includes a liquid display (not shown) and an operation unit that includes a keyboard. The operation display board receives input information by a general user and sends the information to the MPU 30.

As previously described, when the condition is normal in step S3, the process goes to step S5.

In step S5, the MPU 30 starts energizing the fixing unit 6, and checks whether the fixing temperature of the fixing unit 6 is at fixable temperature.

When the fixing unit 6 is not at the fixable temperature, the MPU 30 makes the operation board indicate "standby" as a status report 1, and when the fixing unit 6 is at the fixable temperature, the MPU 30 makes the operation display board indicate "print available."

After completion of step S5, the MPU 30 determines whether the fixing temperature is equal to or greater than 60 degrees Celsius in step S6.

When the fixing temperature of the fixing unit 6 is smaller than 60 degrees Celsius, the result of step S6 is NO, and the process goes to step S7.

In step S7, the MPU 30 determines that it is in power On state of the printer 100 after a long idling period (e.g., when the printer is first turned on in the morning: the environment inside the printer 100 largely varies), and makes the operation display board indicate "execution of color misregistration adjustment" as a status report 3.

Next, in step S8, the data stored in the print number accumulating register RTn of the MPU 30 is reset to zero.

After step S8, "adjustment" is executed in step S23, and the unit replacement register FPC is cleared in step S24.

The data, which indicates the number of print sheets, stored in the print number accumulating register RTn is counted up by one when each sheet is printed, according to a predetermined rule. Then, the process proceeds to step S18, as indicated by "B" in FIGS. 10A and 10B.

The details of the "adjustment" in step S23 will be described later.

When the fixing temperature of the fixing unit 6 is equal to or greater than 60 degrees Celsius, the result of step S6 is YES, and the process proceeds to step S9.

When the fixing temperatures of the fixing unit 6 is equal to or greater than 60 degrees Celsius, the lapse time from previously turning off the printer 100 is short. In this case, it can be expected that the internal environment of the printer 100 has changed little from the time between turning off and turning on the printer 100. However, when the image processing device 3 (i.e., the image processing devices 3Y, 3C, 3M, and 3BK) or the developing device 12 (i.e., the developing devices 12Y, 12C, 12M, and 12BK) of any one of colors has been replaced, the environment inside the printer 100 has largely changed. Therefore, also when the image processing device 3 or the developing device 12 has been replaced, the "adjustment" is executed.

When the fixing temperature of the fixing unit 6 is equal to or greater than 60 degrees Celsius, the result in step S6 is YES, and the process goes to step S9.

In step S9, the MPU 30 checks whether information representing unit replacement is generated in step S22 (the unit replacement register FPC is 1).

When information indicative of unit replacement is generated (the unit replacement register FPC is 1), the result of step S9 is YES, and steps S7 and S8, and the "adjustment" in steps S23 and S24, later described, are executed.

When the image processing device 3 or the developing device 12 has not been replaced, the result of step S9 is NO, and the process goes to step S10.

In step S10, the MPU 30 waits for an input by an operator via the operation display board and a command from the personal computer PC connected with the printer 100, and reads the input and command. After step S10, the process goes to step S11.

In step S11, the MPU 30 determines whether instructions for "color misregistration adjustment" is sent from the operator via the operation display board or the personal computer PC.

When the instructions are received, the result of step S11 is YES, and the process goes to step S7.

Specifically, upon reception of instructions for "color misregistration adjustment" from the operator via the operation display board or the personal computer PC, the MPU 30 executes steps S7 and S8, and the "adjustment" process in steps S23 and S24.

When the instruction is not received, the result of step S11 is NO, and the process proceeds to process C.

Process C starts at step S12. In step S12, the MPU 30 determines whether instructions to start copying or print instructions is sent or not.

When the print instructions are not received, the result of step S12 is NO, and the process goes to process D, where process D starts at step S10.

When the print instructions are received, the result of step S12 is YES, and the process goes to step S13.

Under the condition that the fixing temperature of the fixing unit 6 is at the fixable temperature, and each part of the printer 100 is ready, when the print instructions are given from the operation display board or a print start indication form the personal computer PC, the MPU 30 executes image formation of the specified number in step S13. After step S13, the process goes to step S14.

Every time image formation of one transfer sheet is completed and the transfer sheet is discharged, the MPU 30 increments the data of the print total number register, a color print accumulation number register PCn, and print accumulation number registers of BK, Y, C, and M that are allocated in the nonvolatile memory, respectively by one, when the image formation is color image formation.

When the image formation is monochrome image formation, the data of the print total number register, monochrome print accumulation number register, and the print accumulation number register of BK are respectively incremented by one.

The data of the print accumulation number registers of BK, Y, C, and M are initialized or cleared to a value (i.e. "0"), indicative that a respective color of the image processing device 3 or the developing device 12 is replaced by a new device.

Further, each time one transfer sheet with a printed image thereon is outputted and discharged, the print number accumulating register RTn is incremented (counted up) regardless of color image formation or monochrome image formation. However, the incremented value or a count up value is changed according to a predetermined rule, accordingly.

In step S14, the MPU 30 checks for the presence/absence of abnormality such as paper trouble every time one image is formed, while checking the presence/absence of abnormality by reading the developing density, fixing temperature, internal temperature of the printer 100, and conditions of other parts after completion of image formation of a predetermined number. Then, in step S15, the MPU 30 checks whether the above-described conditions are normal.

When the conditions are normal, the result of step S15 is YES, and the process proceeds to step S17.

When abnormality is found, the result of step S15 is NO, and the process proceeds to step S16.

In step S16, the abnormal condition is displayed on the operation display board as a status report 2, and steps S14 to S16 are repeated until no abnormality is found.

In step S17, the MPU 30 determines whether the data stored in the print number accumulating register RTn is equal to or greater than 200.

When the data stored in the print number accumulating register RTn is equal to or greater than 200, the result in step S17 is YES, and the process goes to step S7 so that steps S7 and S8 and the "adjustment" process in steps S23 and S24 are executed.

When the data stored in the print number accumulating register RTn is smaller than 200, the result of step S17 is NO, and the process goes to process A, where process A starts at step S18.

Specifically, when the result of step S17 is NO, the MPU 30 determines whether the fixing temperature of the fixing unit 6 is fixable temperature.

When the fixing temperature of the fixing unit 6 is not the fixable temperature, the operation display board is made to display "standby" as the status report 1 in step S18.

When the fixing temperature of the fixing unit 6 is the fixable temperature, the operation display board is made to display "printable" also as the status report 1 in step S18, and the process proceeds to step S10 for "input reading."

According to the control flow shown in FIGS. 10A and 10B, the MPU 30 executes the "adjustment" process (step S23) when (1) the power is turned ON at a fixing temperature of the fixing unit 6 of less than 60 degrees Celsius, (2) either of the BK, Y, C, and M units (the image processing devices 3Y, 3C, 3M, and 3BK or the developing devices 12Y, 12C, 12M, and 12BK) is replaced by a new unit, (3) instructions for color misregistration adjustment are made by the operation display board or the personal computer PC, or (4) the number of print sheets stored in the print number accumulating register RTn becomes equal to or greater than 200 immediately after a print job or during a serial print job.

Figure 11A:
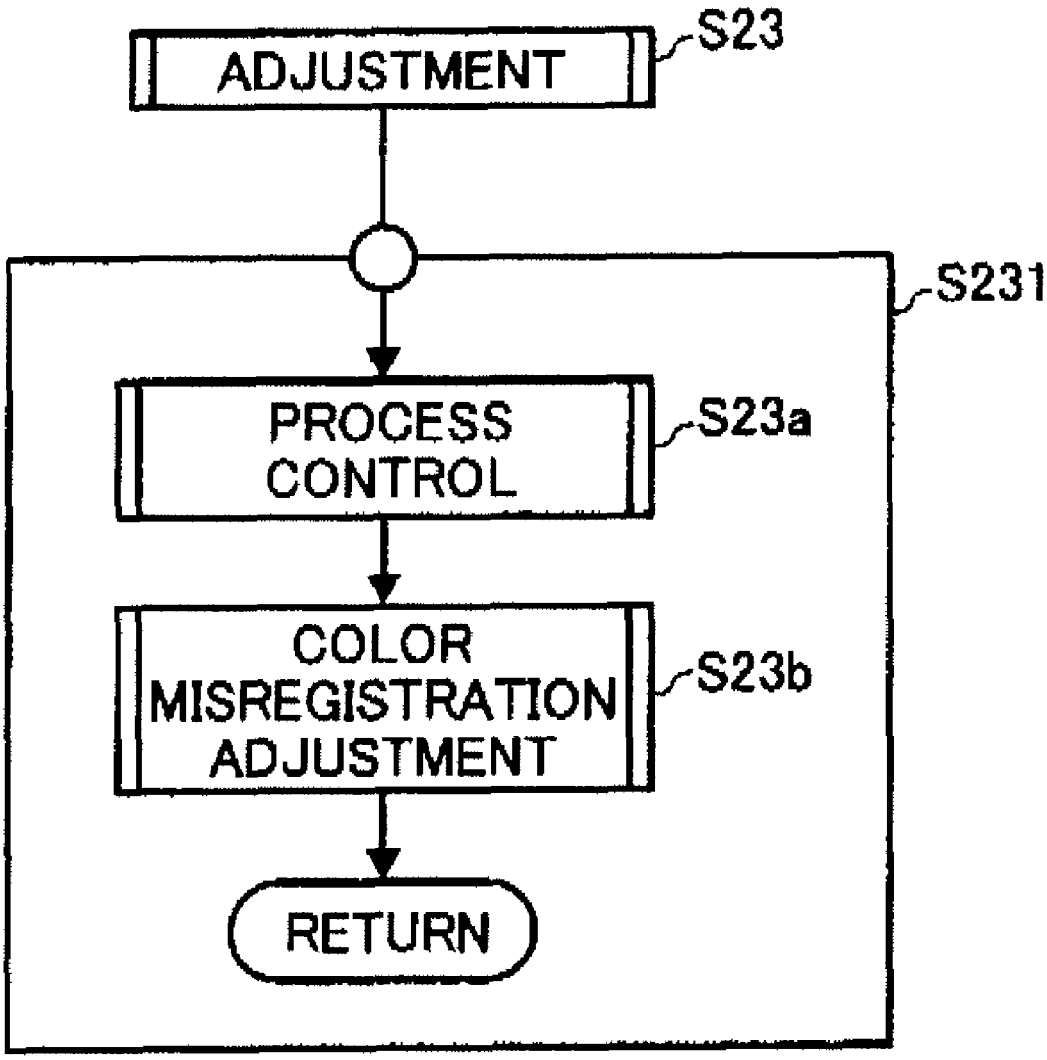
FIG. 11A is a flowchart for explaining an "adjustment"
Figure 11B:
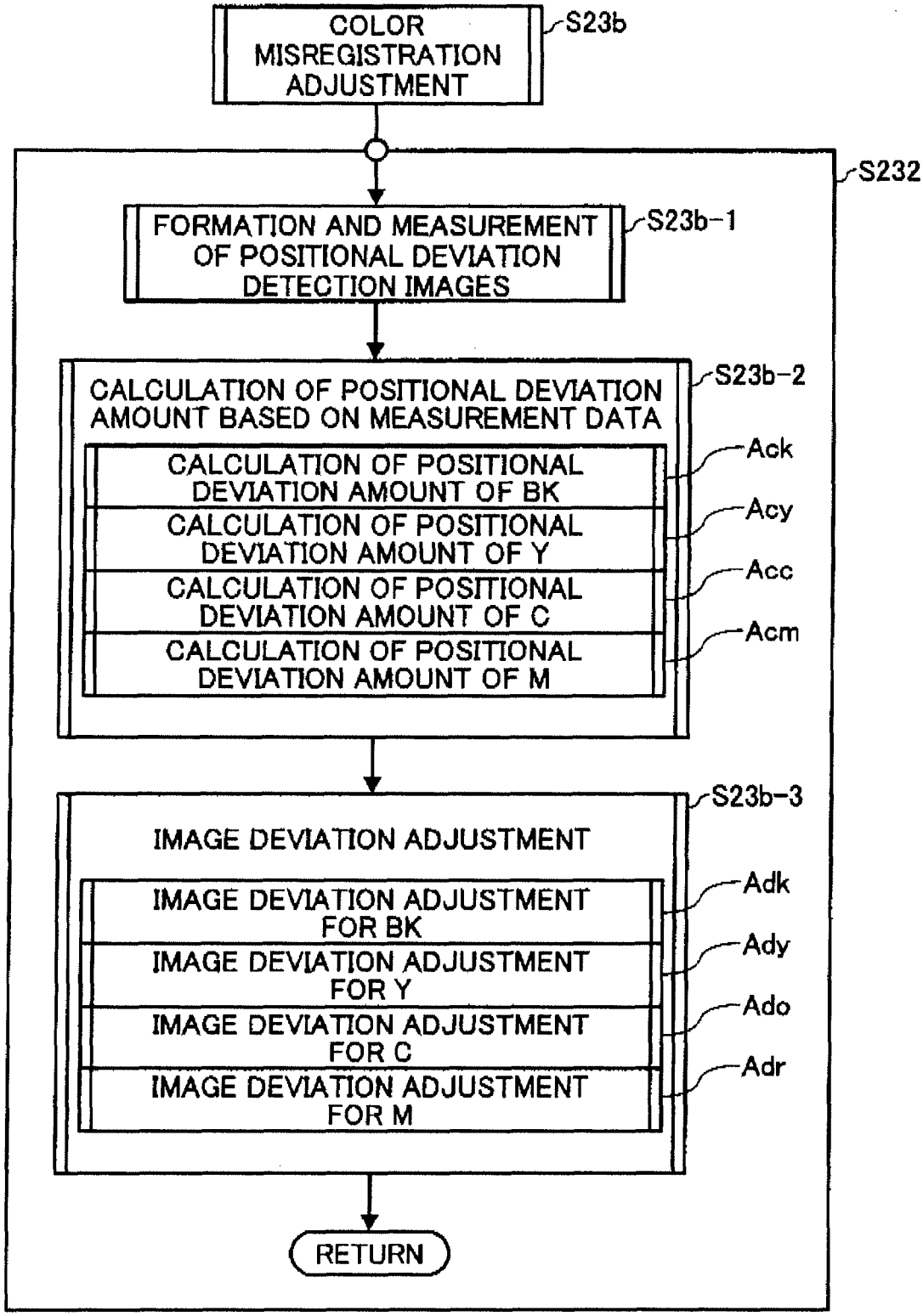
FIG. 11B is a flowchart for explaining a "color misregistration adjustment"

Referring to FIGS. 11A and 11B, flowcharts of performing the "adjustment" in the flowchart shown in FIGS. 10A and 10B are described.

FIG. 11A is a flowchart having steps inside box S231 for explaining the "adjustment" process. FIG. 11B is a flowchart having steps inside box S232 for explaining a "color misregistration adjustment" process.

The "adjustment" process (step S23) shown in the flowchart having steps inside box S231 of FIG. 11A will be described next.

First, the MPU 30 of the process controller 110 arranges and sets all the image forming conditions such as charging, exposure, development, and transfer at reference values in "process control" in step S23*a*. That is, the "process control" may be described as an image forming condition control.

In the "process control" in step S23*a*, the respective output voltages of the optical sensors 20*r*, 20*c*, and 20*f* under the condition in which the LEDs are turned to OFF are detected as Voffset.

Next, the MPU 30 provides the loads to the motors for the photoconductor 3, the intermediate transfer belt 20, the secondary transfer roller 25, and so forth, and the start up of the charging, development, and transfer biases according to respective predetermined image forming timings.

After a potential sensor (not shown) has detected the surface potential Vd of each photoconductor 10 that is uniformly charged under a predetermined condition, the charging bias of the charging unit 11 is adjusted based on the detection result.

Next, a voltage Vsg is adjusted. In the adjustment of the voltage Vsg, the intensity of each light emitting diodes of the optical sensors 20*r*, 20*c*, and 20*f* is adjusted such that the output voltage values Vsg_reg of the optical sensors 20*r*, 20*c*, and 20*f* that detect the background area of the intermediate transfer belt 20 may fall within a predetermined range, for example, within approximately 5.0V±0.2V. After the adjustment has been completed, each of the output voltage values are stored in a memory as Vsg_reg and Vsg_dif.

Next, the adjustment of potential setting is conducted.

Specifically, gradation pattern images of Y, C, M, and BK, each having different ten (10) gradations, are formed on the photoconductors 10Y, 10C, 10M, and 10BK, respectively. Each of the gradation pattern images of Y, C, M, and BK includes ten mark patterns for measuring image formation ability. The gradation pattern images of Y, C, M, and BK have the amount of toner adhesion different from each other.

The optical sensors 20*r*, 20*c*, and 20*f* detect these gradation pattern images of Y, C, M, and BK. The respective detection results are stored as Y-Vsp_dif-I, C-Vsp_dif-I, M-Vsp_dif-I, and BK-Vsp_reg-i. "i" represents a number in a range from 1 to 10.

At this time in the adjustment process, the output values of potential sensors with respect to the potentials of each gradation pattern image on each photoconductor 10 are read and stored in a substantially concurrent manner.

Next, the development potential that is a difference between the output values of the potential sensors previously stored and the development bias at the development of the pattern images is calculated. At the same time, the amount of toner adhesion of each mark pattern is calculated based on a predetermined calculation algorithm for the amount of toner adhesion.

Next, a development γ is calculated.

Specifically, a linear approximate equation representing a relationship of the development potential that has previously been obtained and the amount of toner adhesion of each reference patch is calculated. In the linear approximate equation, the slope is called a "development γ" and the x cut section is called a "development start voltage."

After the development γ has been calculated, a development potential that is necessary to obtain a target amount of toner adhesion is specified based on the development γ. Then, the photoconductor charging potential Vd, a development bias Vb, and optical writing intensity VL, which conform to the development potential are specified based on a predetermined potential table.

The laser emission power of the semiconductor laser is controlled, via a laser control circuit (not shown) that controls the optical writing device 4, to reach the maximum volume. Then, by obtaining the output value of the potential sensor, the residual potential of the photoconductor 10 is detected. When the residual potential is not zero, the photoconductor charging potential Vd, the development bias Vb, and the optical writing intensity VL that have previously been specified are calibrated by the value of the residual potential so as to provide the target potentials.

After the above-described calibration, a power supply circuit (not shown) is adjusted so that the photoconductor charging potentials Vd, provided by the charging unit 11, of respective colors can concurrently come to the respective target potential concurrently. Then, the laser emission power in the semiconductor laser is controlled via the laser control circuit so that the surface voltage VL of each photoconductor 10 can come to the target potentials. Further, the outputs of the power supply circuit are adjusted so that the development bias potential Vb of each developing unit 12 can come to the target potential.

After the above-described adjustments have completed, the respective adjusted values are stored as image forming conditions at the printing job. Thus, the "process control" is conducted in step S23*a*.

After the completion of the "process control" in step S23*a*, the "color misregistration adjustment process" is conducted in step S23*b*, as shown in the flowcharts of FIGS. 11A and 11B. The flowchart having steps inside box S232 of FIG. 11B shows the details of the operation flow of the "color misregistration adjustment."

First, in "formation and measurement of positional deviation detection images" in step S23*b*-1, the MPU 30 causes a positional deviation detection image signal generator (not shown) to supply the optical writing device 4 with a pattern signal in the image formation conditions (parameters) set in the "process control" (step S23*a*), and forms the start marks Msr, Msc, and Msf and eight sets of mark set group as shown in FIG. 7 as positional deviation detection images in each of the rear end part "r", the center part "c", and the front end part "f" of the intermediate transfer belt 20.

These marks are detected by the optical sensors 20*r*, 20*c*, and 20*f* and the resultant mark detection signals Sdr, Sdc, and Sdf are read in after being converted to digital data, i.e., mark detection data Ddr, Ddc, and Ddf by the A/D converters 36*r*, 36*c*, and 36*f*.

From these mark detection data Ddr, Ddc, and Ddf, the MPU 30 calculates position (distribution) of the middle points of each mark of the positional deviation detection images on the intermediate transfer belt 20.

The MPU 30 further calculates an average pattern (average value group of mark position) of the rear mark set group (eight sets of mark sets), an average pattern (average value group of mark position) of the center mark set group (eight sets of mark sets), and an average pattern (average value group of mark position) of the front mark set group (eight sets of mark sets). The details of the "formation and measurement of positional deviation detection images" performed in step S23*b*-1 will be described later.

After calculation of the average patterns, the MPU 30 calculates the deviation amount in the image processing unit 3 by each of the average patterns BK, Y, C, and M based on the average patterns in step S23*b*-2. Next, in step S23*b*-3, the MPU 30 performs the adjustment so that the deviation in image formation are removed based on the calculated deviation amounts.

Figure 12:
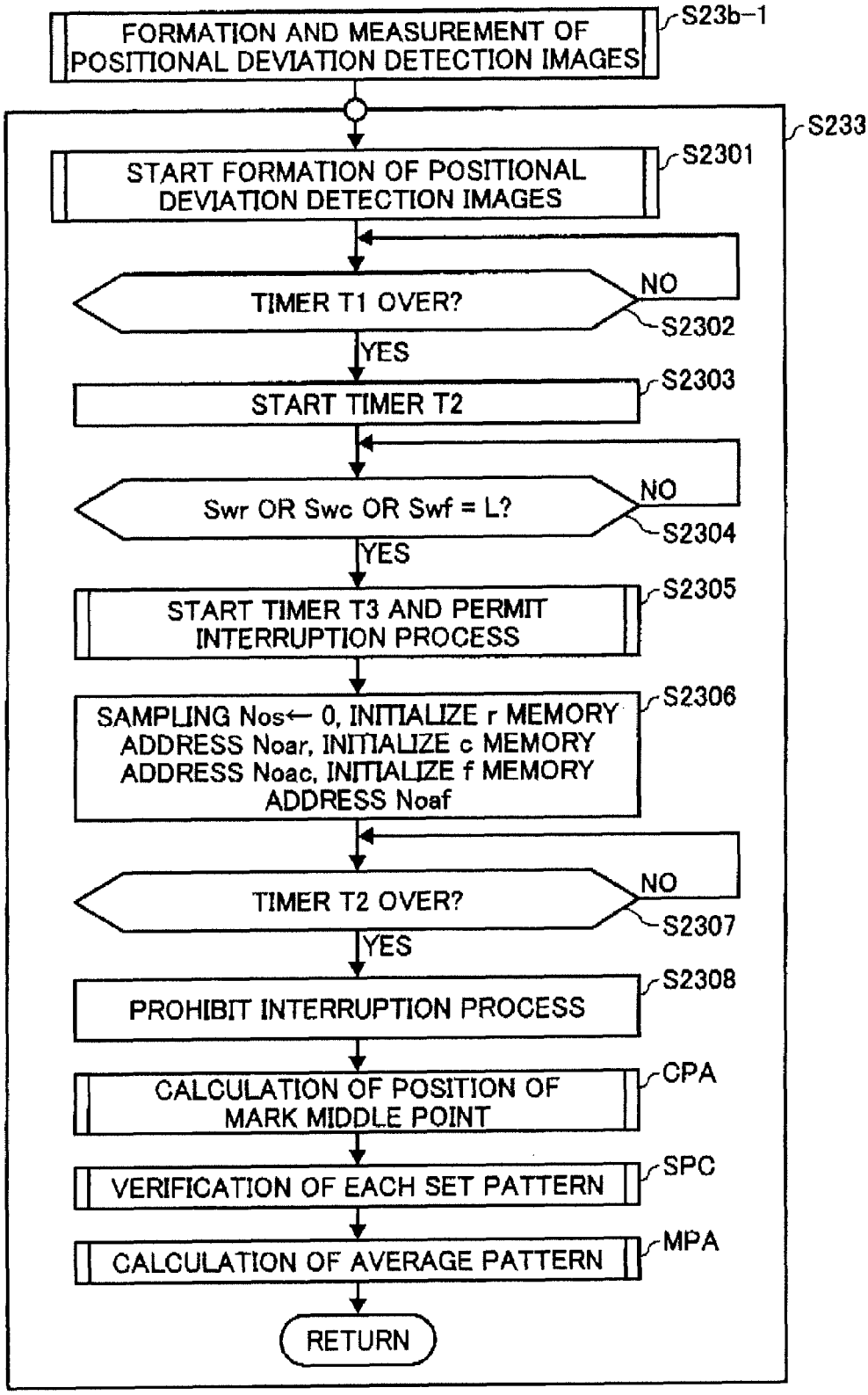
FIG. 12 is a flowchart for explaining a formation and a measurement of the mark pattern.

Referring to FIG. 12, the operations of formation and measurement of the mark pattern illustrated in the flowchart having steps inside box S233 is described. First, while the intermediate transfer belt 20 is rotating at a constant velocity, the MPU 30 simultaneously forms, on the surfaces of the rear end part "r", the center part "c", and the front end part "f" of the intermediate transfer belt 20, the start marks Msr, Msc, and Msf and eight sets of mark sets having a width "w" of the direction "y", a length "A" of the direction "x" a pitch "d", and a clearance "cc" between mark sets. In one embodiment, the transfer belt is rotating at 125 mm/sec, the width "w" is 1 mm, the length "A" is 20 mm, the pitch "d" is 3.5 mm, and the clearance "cc" is 9 mm.

To count the timing immediately before the start marks Msr, Msc, and Msf reach under the optical sensors 20*r*, 20*c*, and 20*f*, the MPU 30 starts a timer T1 having a time limit value of Tw1 in step S2301, and wait for the time Tw1 to elapse in step S2302.

Upon the elapse of time Tw1 of the timer T1, the MPU 30 starts a timer T2 having a time limit value of Tw2 to measure the timing at which the last marks in the mark set groups in the rear end part "r", the center part "c", and the front end part "f" of the intermediate transfer belt 20 finish passing through the optical sensors 20*r*, 20*c*, and 20*f* in step S2303.

Figure 13:
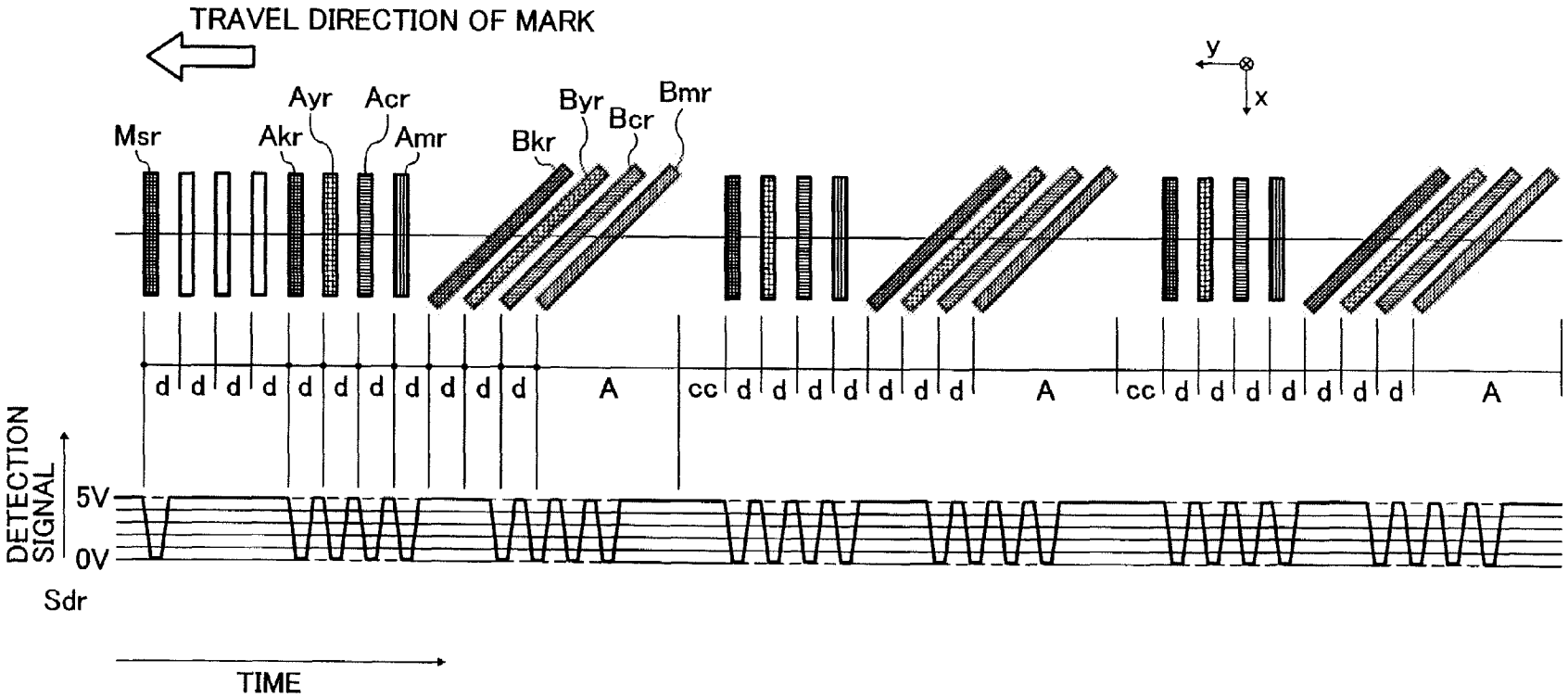
FIG. 13 is a view for explaining a relation between the mark pattern and level variations of detection signals Sdr, Sdc, and Sdf.

FIG. 13 is a view for explaining a relation between the mark pattern and level variations of the detection signals Sdr, Sdc, and Sdf.

As described above, when there is no mark of BK, Y, C, or M in the fields of the optical sensors 20*r*, 20*c*, and 20*f*, the detection signals Sdr, Sdc, and Sdf from the optical sensors 20*r*, 20*c*, and 20*f* are 5V. When there is a mark in the fields of the optical sensors 20*r*, 20*c*, and 20*f*, the detection signals Sdr, Sdc, and Sdf from the optical sensors 20*r*, 20*c*, and 20*f* are 0V.

Accordingly, the constant velocity movement of the intermediate transfer belt 20 results in the level variations in the detection signals Sdr, Sdc, and Sdf as shown in FIG. 13. The enlarged view in FIG. 9A shows a part of such level variation.

As shown in the flowchart of FIG. 12, in the course that the start marks Msr, Msc, and Msf arrive at the fields of the optical sensors 20*r*, 20c, and 20*f* and the detection signals Sdr, Sdc, and Sdf vary from 5V to 0V, the MPU 30 waits until the level determination signals Swr, Swc, and Swf, output from the window comparators 39*r*, 39c, and 39*f* of FIG. 8, changes from the H determination signal to the L determination signal indicating that the detection signals Sdr, Sdc, and Sdf are in a range of approximately 2V to approximately 3V.

As shown in FIG. 9B, since the L determination signal corresponds to the edge area of the mark, the "L" of the level determination signals Swr, Swc, and Swf means that at least one of the edges of the mark has arrived at the field of the optical sensors 20*r*, 20*c*, and 20*f*. In other words, in step S2304, the MPU 30 monitors whether the leading end of the start marks Msr, Msc, and Msf arrived at the optical sensors 20*r*, 20*c*, and 20*f*.

When at least one of the edges of the start marks Msr, Msc, and Msf has arrived at the field of the optical sensors 20*r*, 20*c*, and 20*f*, the MPU 30 starts a timer T3 having a short time limit value Tsp (e.g., 50 microseconds) in step S2305. The shorter the time limit value Tsp becomes, the more accurately the position of the middle point of a mark can be calculated. However, the contradictions of the data stored in memory increases. On the contrary, the longer the time limit value Tsp becomes, the smaller the amount of data is stored in memory. However, the position of the middle point of the mark cannot be calculated with high accuracy. Therefore, the time-limit value Tsp is determined in consideration of the memory capacity and accuracy of the position of middle point of mark.

In step S2305 in the flowchart of FIG. 12, the MPU 30 permits to execute the "interruption process", which may be represented by "TIP."

Figure 14:
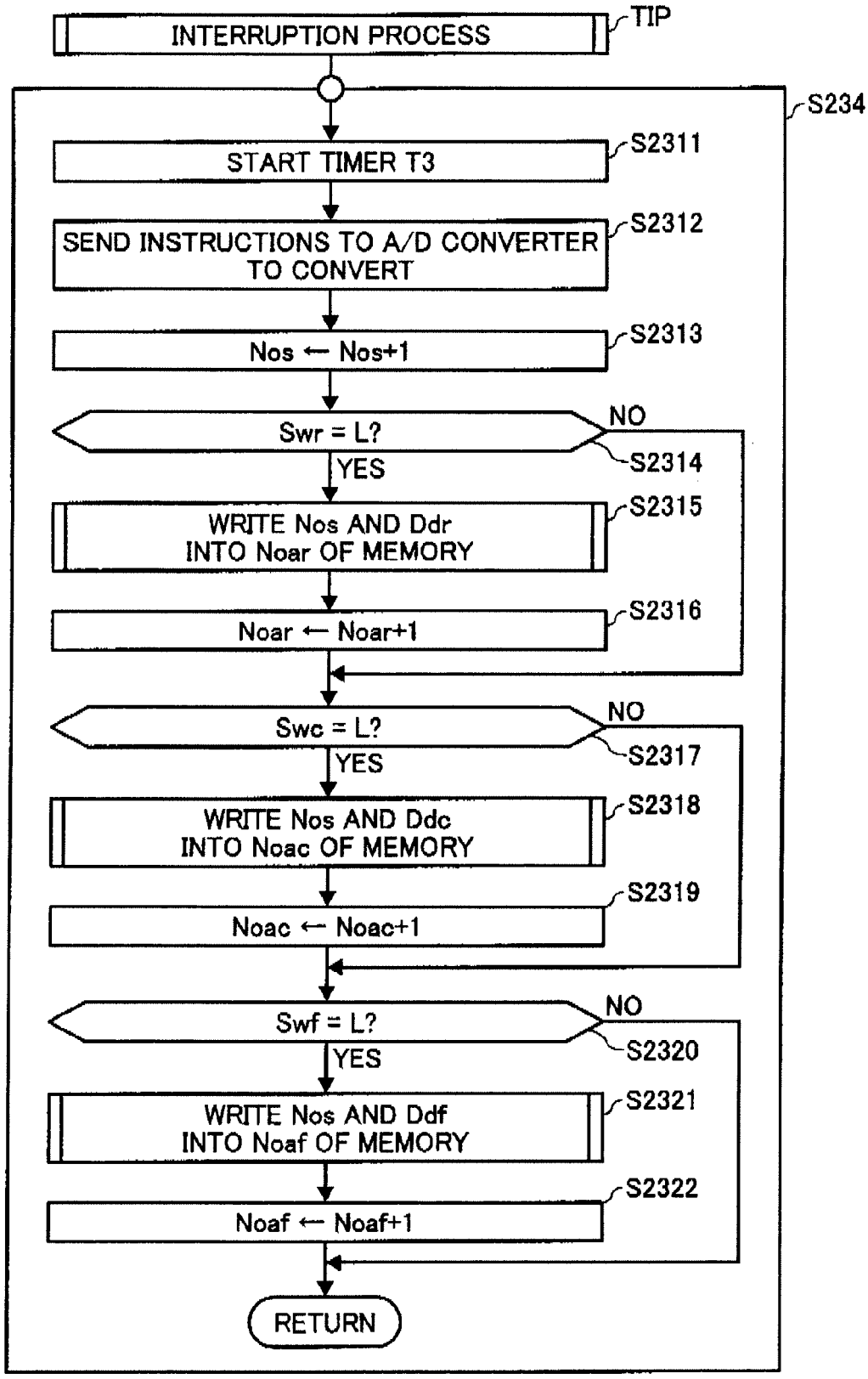
FIG. 14 is a flowchart for explaining an interruption process (TIP)

When the timer T3 reached the time limit (e.g., the time limit value Tsp has lapsed), the MPU 30 permits the execution of the "interruption process" (TIP) in step S2305 as shown in FIG. 14.

Next, the MPU 30 initializes sampling number value Nos of the sampling number register Nos to zero. In addition, in step S2306, a writing address Noar of an "r" memory (a data storage area of rear mark reading data), a writing address Noac of a "c" memory (a data storage area of center mark reading data), and a writing address Noaf of an "f" memory (a data storage area of front mark reading data) that are allocated to the FIFO memory of the MPU 30 are initialized to the start addresses.

Next, in step S2307, the MPU 30 determines whether the timer T2 has reached the time line Tw2. Specifically, the MPU 30 waits until all of the eight sets of test pattern finish passing through the fields of the optical sensors 20*r* and 20*f*.

Now, referring to FIG. 14, the detailed description of the "interruption process" will be provided. FIG. 14 shows a flowchart having steps inside box S234 for showing the operations of the "interruption process (TIP)".

In one embodiment, "interruption process" (TIP) is executed every time the timer T3 reaches the time limit Tsp.

In step S2311, the MPU 30 first starts the timer T3, and the process goes to step S2312. In step S2312, the MPU 30 instructs the A/D converters 36*r*, 36*c*, and 36*f* to conduct A/D conversion. For example, the voltages of the detection signals Sdr, Sdc, and Sdf from the amplifiers 35*r*, 35*c*, and 35*f* at that time are held and converted into digital data, and retained in the data latch.

In step S2313, the MPU 30 increments the sampling number value Nos, which is an of the sampling number register Nos that is A/D conversion instruction number, by one. As a result, the sampling number value Nos×the time limit value Tsp represents the lapse time from the time of detection of the leading edge of either one of the start marks Msr, Msc, and Msf, which is equal to the current position of the intermediate transfer belt 20 opposing the optical sensors 20*r*, 20*c*, and 20*f* in the sub-scanning direction, or the belt travel direction based on either one of the start marks Msr, Msc, and Msf.

In step S2314, the MPU 30 determines if the detection signal Swr from the window comparator 39*r* is L (the optical sensor 20*r* is detecting an edge part of the mark, and 2V≦Sdr≦3V). When the detection signal Swr from the window comparator 39*r* is L, the result of S2314 is YES, and the process goes to step S2315.

In step S2315, the sampling number value Nos of the sampling number register Nos and the A/D conversion data Ddr stored in the data latch (the digital value of the mark detection signal Sdr of the optical sensor 20*r*) are written as writing data into the address Noar of the "r" memory. Then, the process proceeds to step S2316.

In step S2316, the writing address of the "r" memory Noar is incremented by one, and the process goes to step S2317.

When the detection signal Swr from the window comparator 39*r* is not L, the result of S2314 is NO, and the process goes to step S2317.

Specifically, when the detection signal Swr from the window comparator 39*r* is H (Sdr<2V or 3V<Sdr), the MPU 30 does not write the A/D conversion data Ddr retained in the data latch into the "r" memory. This step helps reduction of the amount of data written to memory and simplification of subsequent data processing.

Next, as described above, the MPU 30 checks whether the detection signal Swc from the window comparator 39*c* is L (the optical sensor 20*c* is detecting an edge part of the mark, and 2V≦Sdc≦3V) in step S2317. When the detection signal Swc from the window comparator 39*c* is not L, the result of step S2317 is NO, and the process goes to step S2320, which will be described later. When the detection signal Swc from the window comparator 39*c* is L, the result of step S2317 is YES, and the process goes to step S2318.

In step S2318, the MPU 30 writes the sampling number value Nos of the sampling number register Nos and the A/D conversion data Ddc (the digital value of the mark detection signals Sdc of the optical sensor 20*c*) as writing data into the address Noac of the "c" memory. After step S2318 is completed, the process goes to step S2319.

In step S2319, the MPU 30 increments the writing address Noac of the "c" memory by one, and the process goes to step S2320. Next, in step S2320, the MPU 30 checks whether the detection signal Swf from the window comparator 39*f* is L (the optical sensor 20*f* is detecting the edge part of the mark, and 2V≦Sdc≦3V). When the detection signal Swf from the window comparator 39*f* is not L, the result of step S2320 is NO, and the process returns to step S2311 to repeat the procedure.

When the detection signal Swf from the window comparator 39*f* is L, the result of step S2320 is YES, and the process goes to step S2321.

In step S2321, the MPU 30 writes the sampling number value Nos of the sampling number register Nos and the A/D conversion data Ddf (the digital value of the mark detection signals Sdf of the optical sensor 20f) as writing data into the address Noaf of the "f" memory. After step S2321, the process goes to step S2322.

In step S2322, the MPU 30 increments the writing address Noaf of the "f" memory by one, and the process returns to step S2311 to repeat the procedure. Since such interruption process is repeatedly executed at a cycle of the time Tsp, when the mark detection signals Sdr, Sdc, and Sdf of the optical sensors 20*r*, 20*c*, and 20*f* vary up and down as shown in FIG. 9A, only digital data Ddr, Ddc, and Ddf of the detection signals Sdr, Sdc, and Sdf ranging between 2V and 3V shown in FIG. 9B is stored together with the sampling number value Nos in the "r" memory and the "f" memory that are allocated to the FIFO memory within the MPU 30.

From the sampling number value Nos stored in each memory (the "r/", "c", and "f/" memories), the position in the direction "y", the direction in which the intermediate transfer belt travels in, of each mark from the start mark can be described as follows: the time Tsp×the sampling number value Nos×the conveyance velocity of the intermediate transfer belt 20.

Referring back to FIG. 12, the operation of the formation and measurement of the mark pattern is further described. After the last mark of a mark set group (the last mark of the eighth set of mark sets) has passed the optical sensors 20*r*, 20*c*, and 20*f*, the timer T2 is over.

As shown in the flow of FIG. 12, when the timer T2 is over, the result of step S2307 is YES, and the process goes to step S2308. The interruption process is prohibited in step S2308, and the process goes to step or operation CPA.

In step CPA, the MPU 30 calculates position of a middle point of each mark based on the detection data Ddr, Ddc, and Ddf of the "r" memory, the "c" memory, and the "f" memory in the FIFO memory.

The position of the middle point of a mark may be evaluated in the following manner. As data to be written into the writing addresses Noar, Noac, and Noaf of the "r" memory, the "c" memory, and the "f" memory, respectively, plural sets of data ranging from 2V to 3V are respectively stored that correspond to the falling region where the level of the mark detection signal falls and that correspond to the subsequent rising region where the level rises. FIG. 9B shows the details of the data to be written into the writing addresses Noar, Noac, and Noaf of the "r" memory, the "c" memory, and the "f" memory, respectively.

From the sets of data corresponding to the first falling region of the BK mark, a middle position "a" is calculated, and from the sets of data corresponding to the rising region of the BK mark, a middle position "b" is calculated. Next, from the middle position "a" and the middle position "b", a middle point of the BK mark (the middle point Akrp) is calculated. Likewise, a middle position "c" of the falling region of the next mark, which is the Y mark, and a middle position "d" of the subsequent rising region are calculated from the sets of data corresponding to the respective regions, and then a middle point (the middle point Akrp) of the Y mark is calculated. The above-described processes are executed for each mark.

Figure 15:
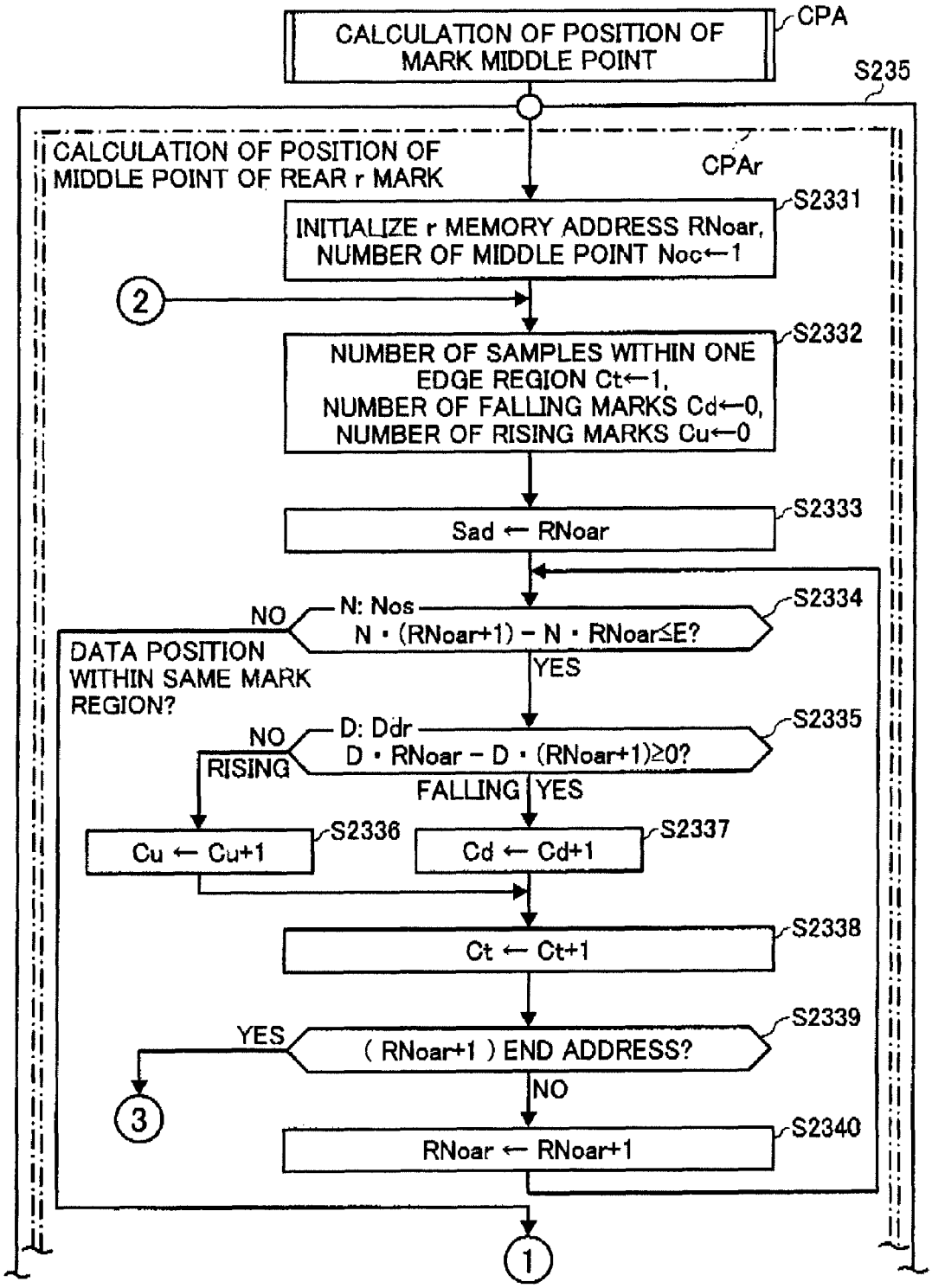
FIG. 15 is a flowchart for explaining one part of a "calculation of mark middle point position (CPA)"
Figure 16:
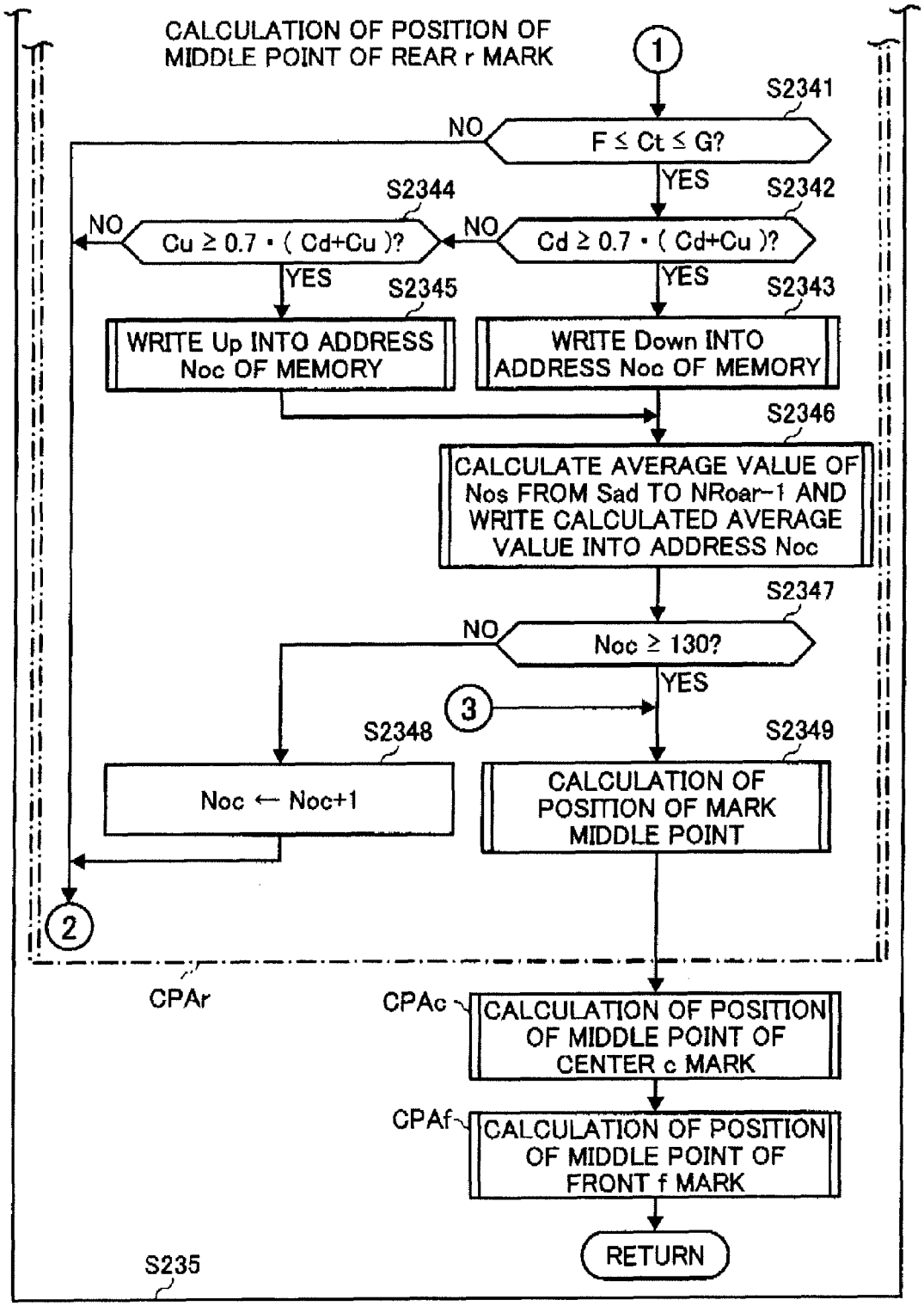
FIG. 16 is a flowchart for explaining another part of the "calculation of mark middle point position (CPA)"

Referring to FIGS. 15 and 16, a flowchart showing operations of the "calculation of position of mark middle point" (CPA) is described. FIG. 15 is a flowchart having steps inside box S235 for explaining one part of a "calculation of position of mark middle point" (CPA). FIG. 16 is the following part of the flowchart having steps inside box S235 of FIG. 15.

In step CPA, a "calculation of position of middle point of mark in the rear end part 'r' (CPAr)", a "calculation of position of middle point of mark in the center part 'c' (CPAc)", and a "calculation of position of middle point of mark in the front end part 'f' (CPAf)" are executed.

In the "calculation of position of middle point of mark in rear end part 'r' (CPAr)", the MPU 30 first initializes the reading address RNoar of the "r" memory allocated to the FIFO memory therein, and initializes the data of an edge middle point number register Noc at "1" that is indicative of the first edge, in step S2331. This edge middle point under a register Noc corresponds to "a", "b", "c", and "d" as shown in FIG. 9B. After step S2331, the process goes to step S2332.

In step S2332, the MPU 30 initializes data Ct of the sample number register within one edge region Ct at "1", and initializes data Cd and Cu of the falling number register Cd and the rising number register Cu at "0". After step S2332, the process goes to step S2333. In step S2333, the MPU 30 writes a reading address RNoar into an edge region data group leading address register Sad. The leading address registers are for the preparatory process for data processing of first edge region.

Next, the MPU 30 reads data from an address RNoar of the "r" memory. The data includes the position Nos in the direction "y": N·RNoar, detection level Ddr: D·RNoar. The position Nos in the direction "y", which is "N·RNoar", is obtained by multiplying the time Tsp by the sampling number value Nos and by the conveyance velocity of the intermediate transfer belt 20.

The MPU 30 also reads out data from the subsequent address RNoar+1. The data includes the position Nos in the direction "y": N·(RNoar+1), a detection level Ddr: D·(RNoar+1).

Next, in step S2334, the MPU 30 checks whether the difference of the directions "y" of both read data (N·(RNoar+1)−N·RNoar) is equal to or less than "E". For example, E=w/2=value corresponding to ½ mm on the same edge region. When the difference of position in the direction "y" of both read data (N·(RNoar+1)−N·RNoar) is greater than E, the result of step S2334 is NO, and the process proceeds to process 1 starting at step S2341, which will be described later.

When the difference of position in the direction "y" of both read data (N·(RNoar+1)−N·RNoar) is equal to or smaller than E, the result of step S2334 is YES, and the process proceeds to step S2335.

In step S2335, the MPU 30 checks whether the difference in detection level between these read data (D·RNoar−D·(RNoar+1)) is equal to or greater than zero. When the difference in the detection level between these data is equal to or greater than zero, the result of step S2335 is YES, and the process goes to step S2337.

In step S2337, the MPU 30 represents the falling trend, so that the data Cd of the falling number register Cd is incremented by one. The process then proceeds to step S2338.

On the other hand, when the difference in the detection level between these data is smaller than zero, the result of step S2335 is NO, and the process proceeds to step S2336. In step S2336, the MPU 30 represents the rising trend, so that data Cu of the rising number register Cu is incremented by one, and the process proceeds to step S2338.

In step S2338, the MPU 30 increments the data Ct of the sample number register within one edge Ct by one. After step S2338, the MPU 30 checks whether the memory reading address RNoar of the "r" memory is an end address of the "r" memory in S2339.

When the reading address RNoar of the "r" memory reading address is an end address of the "r" memory, the result of step s2339 is YES, and the process goes to step S2349. When the reading address RNoar of the "r" memory reading address is not an end address of the "r" memory, the result of step s2339 is NO, and the process goes to step S2340. In step S2340, the memory reading address RNoar is incremented by one, and the process (steps S2335 to S2340) are repeated.

On the other hand, as previously described, when the read data of the first edge region changes to the read data of the next edge region, the difference of position in the direction "y" of both read data (N·(RNoar+1)−N·RNoar) is greater than E in step S2334, the result of step S2334 is NO, and the process proceeds to process 1 starting at step S2341 in FIG. 16.

By proceeding to step S2341, it is determined that the MPU 30 has completed the checking of every sampling data of one mark edge (the leading edge or the trailing edge) region for falling and rising trends.

Next, in step S2341, the MPU 30 checks whether the sample number data Ct of the sample number register Ct within a single edge at this time is a corresponding value within a single edge region (ranging from 2V to 3V). In other words, the MPU 30 checks whether the relationship of $F \leqq Ct \leqq G$ is satisfied.

In step S2341, the symbol "F" represents a lower limit value of data written into the "r" memory when the leading edge or trailing edge of a properly formed mark is detected, and the symbol "G" represents an upper limit (set value) value of data written into the "r" memory when the leading edge or trailing edge of a properly formed mark is detected.

When the sample number data Ct satisfies the relationship of F≦Ct≦G, the result of step S2341 is YES, and it is regarded that data reading and storing are properly conducted, and the process goes to step S2342.

In step S2342, the MPU 30 checks whether the first edge is in a falling trend. More specifically, when the data Cd of the falling number register Cd is equal to or greater than 70% of the sum of the data Cd of the falling number register Cd and the data Cu of the rising number register Cu (Cd≧0.7 (Cd+Cu)), the result of step S2342 is YES, and the process goes to step S2343.

In step S2343, the MPU 30 writes information "DOWN" representing falling into the address to the edge No. of memory Noc. The process then proceeds to step S2346. On the other hand, when the data Cd of the falling number register Cd is smaller than 70% of the sum of the data Cd of the falling number register Cd and the data Cu of the rising number register Cu (Cd≧0.7(Cd+Cu)), the result of step S2342 is NO, and the process goes to step S2344.

In step S2344, the MPU 30 checks whether the first edge is in a rising trend. Specifically, when the data Cu of the rising number register Cu is equal to or greater than 70% of Cd+Cu of the rising number register Cu (Cu≧0.7(Cd+Cu)), the result of step S2344 is YES, and the process goes to step S2345.

In step S2345, the MPU 30 writes information "UP" that is indicative of the rising trend into the address to the edge No. of memory Noc. Then, the process goes to step S2346.

On the other hand, when the data Cu of the rising number register Cu is smaller than 70% of Cd+Cu of the rising number register Cu (Cu≧0.7(Cd+Cu)), the result of step S2344 is NO, and the process goes to process 2 starting at step S2332.

Next, in step S2346, the MPU 30 calculates an average value of the "y" position data of the first edge region, i.e., the middle point position of the edge region ("a" in FIG. 9B), and writes the average value into the address to the edge No. of memory Noc. After step S2346, the process goes to step S2347.

In step S2347, the MPU 30 checks whether the edge No. Nos is equal to or greater than 130. Namely, the MPU 30 checks whether the calculation of middle position of every mark in the leading edge region and the trailing edge region in the start mark Msr and eight sets of mark sets have been completed.

When the edge No. Nos is greater than 130, the result of step S2347 is NO, and the process goes to step S2348. Specifically, when the result of step S2347 is NO, the data of the edge middle point number register Noc is incremented by one representing the second edge (the trailing end of the mark Akr of BK), changing from 1 representing the first edge (the leading edge of the mark Akr of BK).

As to the second edge, the process of steps S2332 to S2346 is executed, and information that is indicative of the rising or falling and middle point position of the edge region ("b" in FIG. 9B) are written into the address to the edge No. of memory Noc.

The above-described process is repeated up to the edge region of the trailing end of the last mark (Bmr) of the eight sets of mark sets.

When the edge No. Nos is equal to or smaller than 130, the result of step S2347 is YES, and the process goes to step S2349. Thus, the result of step S2347 is YES upon completion of calculation of the middle position of each mark in the leading edge region and the trailing edge region for every start mark Msr and eight sets of mark sets. In addition, when the result of or the "r" memory reading address RNoar is an "r" end address, namely when reading of stored data from the "r" memory has completed, which is YES in step S2339, a mark middle point position is calculated based on the edge middle point position data (the "y" position data calculated in step S2346).

For calculating a mark middle point position, the address data addressing to the edge No. of memory Noc (falling/rising data and position data of edge middle point) is read out. Then, whether the positional difference between the middle point position of the previous falling edge region and the middle point position of the rising edge region following the falling edge region falls within the range corresponding to the width "w" in the "y" direction of the mark is checked.

When the positional difference between the middle point position of the previous falling edge region and the middle point position of the rising edge region following the falling edge region does not fall within the range corresponding to the width "w" in the "y" direction of the mark, these data are deleted.

When the positional difference between the middle point position of the previous falling edge region and the middle point position of the rising edge region following the falling edge region falls within the range corresponding to the width "w" in the "y"B direction of the mark, an average value of these data is determined, and written to the mark No. from the leading end in the memory as a middle point position of one mark.

When all of the mark formation, mark detection, and detection data processing are properly executed, the middle point position data for a total of 65 marks including the start mark Msr and eight sets of mark sets (8 marks/set □8=64 marks) is obtained in regard to the rear end part "r", and stored in the memory.

Next, the MPU 30 executes the "calculation of mark middle point position of center "c" (CPAc)" in the same manner as described in the "calculation of mark middle point position of rear "r" (CPAr)", and the measurement data in the memory is processed.

When all of the mark formation, mark measurement, and measurement data processing are properly executed, the middle point position data for a total of 65 marks including the start mark Msc and eight sets of mark sets (8 marks/set □8=64 marks) is obtained in regard to the center part "c", and stored in the memory.

Next, the MPU 30 executes the "calculation of mark middle point position of front 'f' (CPAf)" in the same manner as described in the "calculation of mark middle point position of rear 'r' (CPAr)", and the measurement data on the memory is processed.

When all the mark formation, mark measurement, and measurement data processing are properly executed, the middle point position data for a total of 65 marks including the start mark Msf and eight sets of mark sets (8 marks/set □8=64 marks) is obtained in regard to the front end part "f", and stored in the memory.

Upon completion of calculation of middle point position of mark in the manner as described above, the MPU 30 executes a "verification of each set pattern" in step SPC in the flowchart of FIG. 12.

By the "verification of each set pattern" in step SPC, the MPU 30 verifies whether the data group of the middle point position of mark written into the memory has a center point distribution corresponding to the mark distribution shown in FIG. 7.

Specifically, the MPU 30 deletes from the mark middle point position data group written into the memory, the data that is out of the mark distribution shown in FIG. 7 in set units. As a result, only the data sets (the position data group including 8 pieces of data per one set) that show the distribution pattern corresponding to the mark distribution shown in FIG. 7 are left.

When all the data is proper, eight sets of data in the rear end part "r", eight sets of data in the center part "c", and eight sets of data in the front end part "f" are left in the group of mark middle point position data written in the memory.

Next, the MPU 30 changes the middle point position data of the first mark (Akr) of each set that follows the second set, into the middle point position of the first mark (Akr) of the leading set (the first set) in the rear data set, and changes the middle point position data of the second to the eighth marks by the differential values corresponding to the changes. That is, the MPU 30 makes changes on the middle point position data group of each set that follows the second set in such a manner that the values are shifted in the "y" direction so that the middle point position of the leading mark of the first set.

The MPU 30 also changes the middle point position data in each set that follows the second set in the center part "c" and the front end part "f" in the same way as the rear end part "r".

After the "verification of each set pattern" (step SPC) has been completed, the MPU 30 executes a "calculation of average pattern" in step MPA in the flowchart of FIG. 12.

Figure 17:
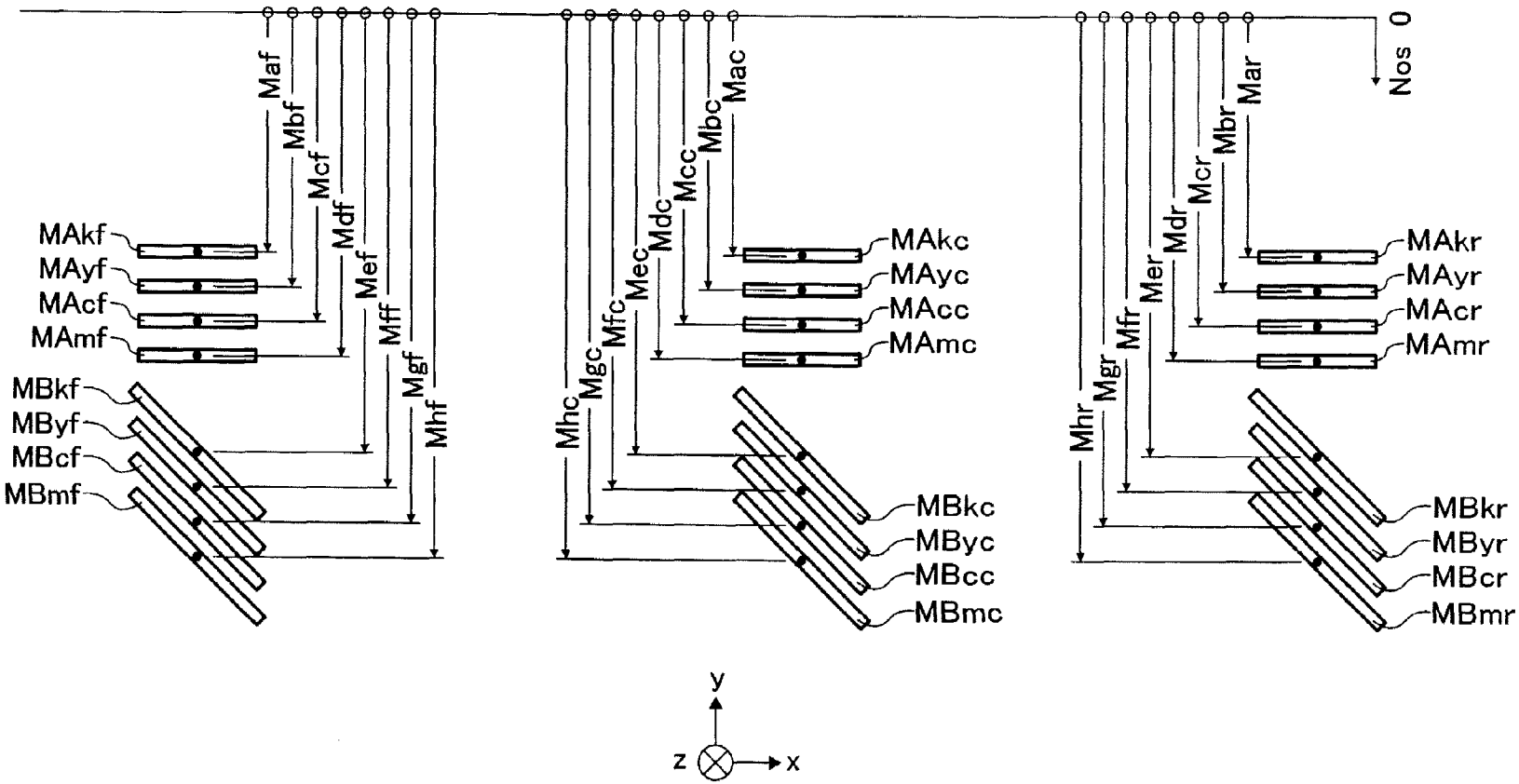
FIG. 17 is a view for explaining an assumed average position mark.

Referring to FIG. 17, a view of assumed average position marks is described for operations of the "calculation of average pattern" in step MPA.

In step MPA, the MPU 30 calculates average values, Mar to Mhr, of the middle point position data of each mark for each set in the rear end part "r" of the intermediate transfer belt 20. In a similar manner, the MPU 30 calculates average values, Mac to Mhc, of the middle point position data of each mark for each set in the center part "c", and average values, Maf to Mhf, of the middle point position data of each mark for each set in the front end part "f".

These average values represent middle point positions of hypothetical average position marks that distribute as shown in FIG. 17:

MAkr (representative of the rear perpendicular mark of BK);

MAyr (representative of the rear perpendicular mark of Y);

MAcr (representative of the rear perpendicular mark of C);

MAmr (representative of the rear perpendicular mark of M);

MBkr (representative of the rear diagonal mark of BK);

MByr (representative of the rear diagonal mark of Y);

MBcr (representative of the rear diagonal mark of C);

MBmr (representative of the rear diagonal mark of M);

MAkc (representative of the center perpendicular mark of BK);

MAyc (representative of the center perpendicular mark of Y); MAcc (representative of the center perpendicular mark of C);

MAmc (representative of the center perpendicular mark of M);

MBkc (representative of the center diagonal mark of BK);

MByc (representative of the center diagonal mark of Y);

MBcc (representative of the center diagonal mark of C);

MBmc (representative of the center diagonal mark of M);

MAkf (representative of the front perpendicular mark of BK);

MAyf (representative of the front perpendicular mark of Y);

MAcf (representative of the front perpendicular mark of C);

MAmf (representative of the front perpendicular mark of M);

MBkf (representative of the front diagonal mark of BK);

MByf (representative of the front diagonal mark of Y);

MBcf (representative of the front diagonal mark of C); and

MBmf (representative of the front diagonal mark of M).

After completion of step MPA for "calculation of average pattern" the process described in the flowchart of FIG. 12 completes.

Upon completion of the "formation and measurement of positional deviation detecting image" (step S23*b*-1) as described above, the MPU 30 executes a "calculation of deviation amount based on measurement data" (step S23*b*-2) as shown in FIG. 11B, and calculates an amount of color misregistration.

In the printer 100, the MPU 30 calculates color misregistration of Y, M, and C relative to BK. Based on the amounts of color misregistration of Y, M, and C relative to BK obtained in step S23*b*-2, the MPU 30 conducts image deviation adjustment for BK, Y, M, and C in step S23*b*-3.

Specifically, the MPU 30 calculates the amounts of skew adjustment of Y, M, and C relative to BK to adjust skews on Y, M, and C images relative to BK image. Also, the MPU 30 calculates the amounts of deviation in the direction "y" of Y, M, and C relative to BK to adjust image misregistrations in the direction "y". Further, the MPU 30 calculates the amounts of deviation in the direction "x" of Y, M, and C relative to BK to adjust image misregistrations in the direction "x".

Now, detailed features of the printer 100 according to the exemplary embodiment of the present invention are described.

As shown in FIG. 5, the optical writing device 4 (serving as an electrostatic latent image writing unit) includes various optical components and elements, such as lens and mirrors, for optically writing color images in a housing thereof.

The optical writing device 4 of FIG. 5 causes the polygon mirror unit 41 (including the two polygon mirrors 41*a* and 41*b* serving as a light deflecting units to separately deflect the plurality of laser light beams La, Lb, Lc, and Ld, so as to optically write respective electrostatic latent images on the photoconductors 10Y, 10C, 10M, and 10K that correspond to the plurality of laser light beams La, Lb, Lc, and Ld, respectively.

Alternatively, it is known there is a different type optical writing unit (not shown) that has various optical components and elements for each color in separate housings onto which respective polygon mirrors are mounted. However, respective polygon mirrors provided to the separate housings rotate separately. Thus, the optical writing unit having the separate housings may cause a misregistration in rotational phases of respective polygon mirrors provided to each housing thereof.

When the rotational phases of the respective polygon mirrors relatively deviate, the timings to start writing respective images onto the photoconductors 10Y, 10C, 10M, and 10K may also relatively deviate in the main scanning direction. Under this condition, images cannot be written in a correct manner.

To avoid this condition, the rotational phases of the polygon mirrors may need to be synchronized at the start of a print job. This synchronization, however, may cause the first copy printing time, which is a period of time from the receipt of a print job to the start of the print job, to be longer.

On the other hand, the previously described optical writing device 4 provided to the printer 100 includes the polygon mirror unit 41 in which the polygon mirrors 41*a* and 41*b* are integrally mounted. With such configuration, rotational phases of each color image can be constantly synchronized. Therefore, the polygon mirrors 41*a* and 41*b* of the polygon mirror unit 41 do not need to control the rotational phases.

The inventors of the present invention conducted tests by using optical writing units having the same configuration of the optical writing device 4 of the printer 100 and found the optical writing device 4 having the polygon mirrors in the same space (e.g., the polygon mirrors 41*a* and 41*b* in the polygon mirror unit 41) may cause color misregistration during a serial printing operation more frequently when compared to the optical writing unit having the polygon mirrors in the separate housings.

For example, when the polygon motor PM keeps rotating during a serial printing job, the temperature in the optical writing device 4 increases. Therefore, color misregistration may occur along with the increase of temperature.

Further, with the configuration of the optical writing device 4 of FIG. 5, the distances from the polygon motor PM to the optical writing components or parts for each color may not be equal. Therefore, different temperatures between the optical writing components for each color can easily be obtained.

Accordingly, the degree of expansion and contraction of the optical writing components along with the change of temperature during the serial printing job, and the color misregistration can easily occur.

The inventors used a testing machine having the same configuration of the printer 100 of FIG. 3 and conducted a serial printing operation with a test image. In the serial printing operation, 1000 sheets of A3-size paper were conveyed along a longitudinal direction in a substantially continuous manner without performing the color misregistration adjustment. The temperature inside the testing machine of the optical writing device 4 and a motor bearing temperature of the polygon motor PM were measured by optical sensors.

Figure 18:
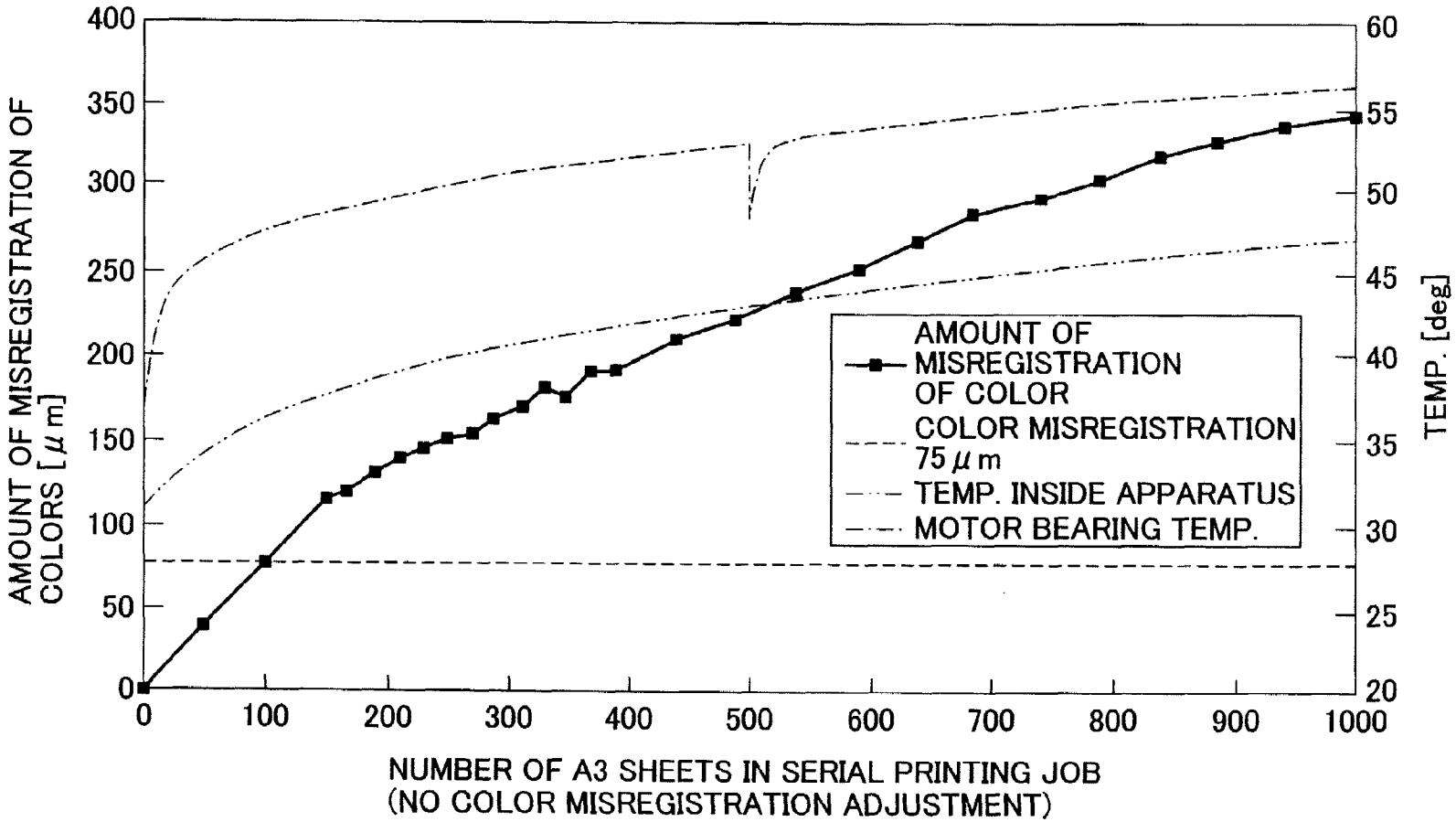
FIG. 18 is a graph showing a relationship of amounts of color misregistration, the number of a serial printing operation, the temperature of an image writing device, and the motor bearing temperature when no color misregistration adjustment is performed.

Each amount of color misregistration on the printed 1000 sheets was examined with a microscope. The test results are shown in the graph of FIG. 18. According to one embodiment of the present invention, A3-size paper is the possible maximum output size for the testing machine.

In FIG. 18, the motor bearing temperature sharply dropped, then rapidly rose at the point of outputting 500 sheets of A3-size paper. This phenomenon occurred because the serial printing operation was stopped for loading another 500 sheets to the sheet feeding cassette 2, which can load approximately 500 sheets of A3-size paper at one time. It should be noted that the color misregistration adjustment was forcedly conducted immediately before the test with the testing machine to adjust the amount of color misregistration to an initial value.

As shown in the graph of FIG. 18, the first sheet of A3-size paper was printed with substantially no color misregistration since the point of printing the first sheet was immediately after the completion of the color misregistration adjustment. The amount of color misregistration is indicated by a solid line in FIG. 18.

An alternate long and two short dashes line shown in the graph of FIG. 18 indicates the temperature inside the testing machine. The temperature inside the testing machine was approximately 31 degrees Celsius at the point of printing the first sheet.

An alternate long and short dash line shown in the graph of FIG. 18 indicates the motor bearing temperature. The motor bearing temperature was approximately 36 degrees Celsius at the point of printing the first sheet.

During the serial printing operation of 1000 sheets of A3-size paper, both the temperature inside the testing machine (i.e., the printer 100) and the motor bearing temperature gradually increased along with the increase of the number of printed sheets.

At the point that the 1000th sheet was printed out, the temperature inside the testing machine (i.e., the printer 100) reached approximately 47 degrees Celsius and the motor bearing temperature reached approximately 55 degrees Celsius. Accordingly, the intermittent increases of the temperatures were caused due to the continuous rotations of the polygon motor PM.

As the optical components or parts in the optical writing device 4 expanded by heat along with the increase of the temperature inside the testing machine or the printer 100, the amount of color misregistration also gradually increased. Consequently, at the completion of the serial printing operation of 1000 A3 sheets, the printer 100 produced the color misregistration by the amount of approximately 300 μm.

In one embodiment, an allowable range of color misregistration of a mass-production machine for a general user is set to approximately 75 μm. The color misregistration, approximately 300 μm produced by the printer 100, was substantially four times greater than the allowable range of such printer for the general user.

Actually, general users use A3-size paper less frequently than A4-size paper. Furthermore, general users rarely perform a serial printing operation with 1000 sheets of A3-size paper. However, according to the results of the test conducted by the inventors of the present invention, in a case in which 1000 sheets of A3-size paper are serially printed without conducting the color misregistration adjustment, the amount of approximately 300 μm of color misregistration may occur.

After the completion of the serial printing operation of 1000 sheets, the inventors let the testing machine for cool down for several hours, and then started to run another serial printing operation of a few sheets. After the second serial printing operation, the inventors found a very small amount of color misregistration was produced even though the color misregistration adjustment had not been conducted after the first serial printing operation. The amount of color misregistration was reduced because the temperatures of the optical components cooled down to the normal temperatures and the expansion and contraction of the optical components also returned to the substantially initial degrees.

Next, the inventors conducted another test in which the color misregistration adjustment was performed after the completion of printing every 200 sheets of A3-size paper while conducting the serial printing operation of 1000 sheets of A3-size paper.

The frequency of the color misregistration adjustment (by every 200 sheets) was determined according to the setting of generally used printers. Specifically, in printers for general purpose use, when the value of print number accumulating register RTn reaches 200 or greater in step S17 in the flowchart of FIG. 10B, the adjustment in step S23 of FIG. 10A is conducted.

Figure 19:
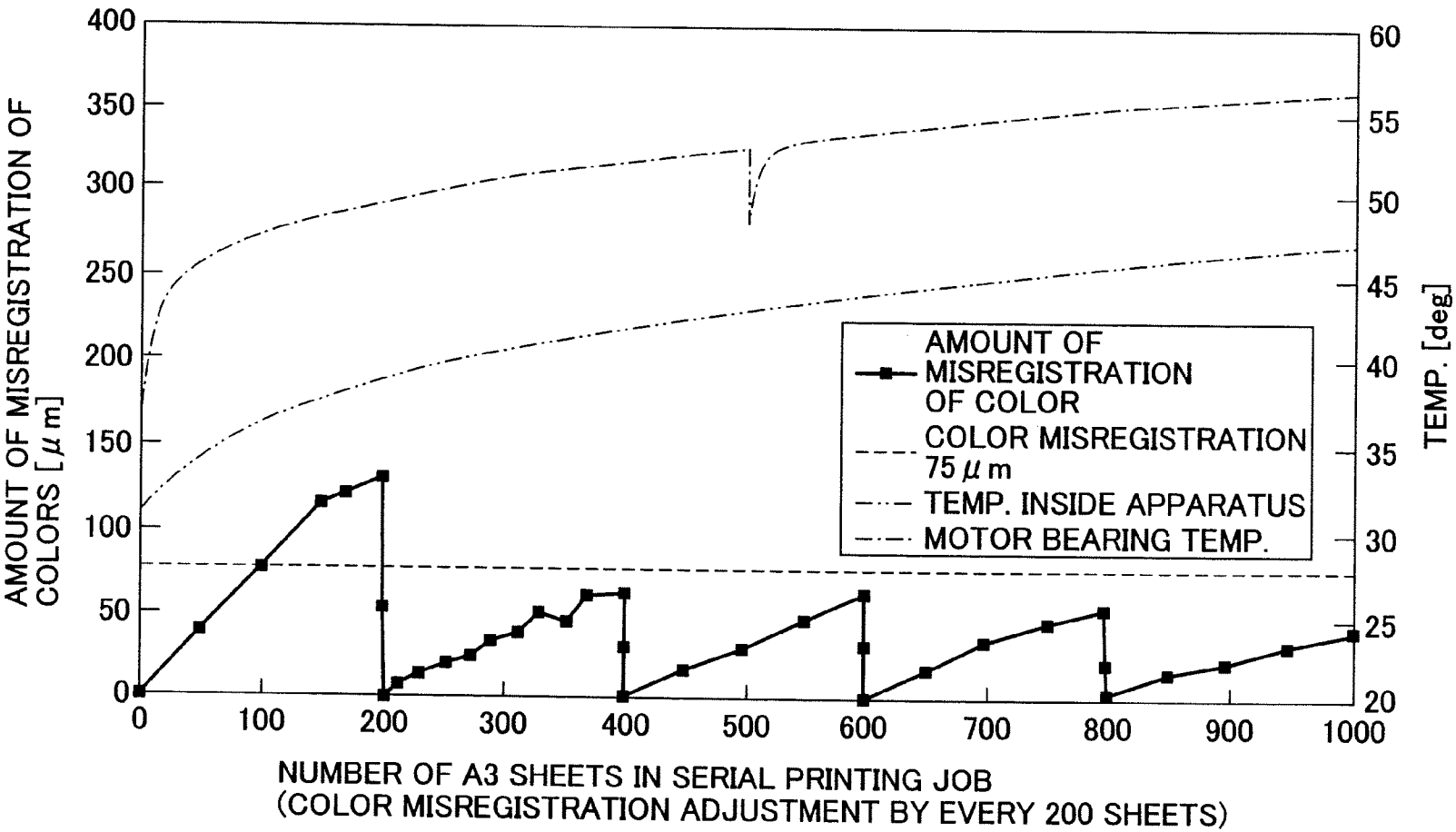
FIG. 19 is a graph showing a relationship of amounts of color misregistration, the number of a serial printing operation, the temperature of an image writing device, and the motor bearing temperature when the color misregistration adjustment is performed per 200 print sheets.

The results of the above-described test are shown in a graph in FIG. 19. As shown in FIG. 19, the color misregistration adjustment for every 200 sheets reduced the amount of color misregistration, which generally increases with the increase of number of printout sheets. According to the graph in FIG. 19, the amount of color misregistration was reduced to substantially zero after the color misregistration adjustment was executed by every 200 sheets of A3-size paper.

However, in a serial printing operation from the first sheet through the 200th sheet, the amount of color misregistration increased up to approximately 130 μm due to a sharp temperature change, which largely surpassed the allowable range, 75 μm, of a general use printer.

In the testing machine used in this test, the length of axis line direction of each photoconductor 10 (i.e., the photoconductors 10Y, 10C, 10M, and 10BK) and the width of the intermediate transfer belt 20 are made to be slightly greater than the short side length (297 mm) of A3-size paper. That is, the testing machine can form an image on an area having a length in the main scanning direction thereof corresponding at the maximum to the short side length of an A3-size paper or the long side length of an A4-size paper.

When A4-size paper is to be printed, each sheet of A4-size paper is conveyed with the short side thereof along with the sheet travel direction. Accordingly, the A4-size paper can be printed in half the time taken for the A3-size paper.

Next, the inventors further conducted another test in which the color misregistration adjustment was performed after the completion of printing every 100 sheets of A3-size paper while conducting the serial printing operation of 1000 sheets of A3-size paper.

In this test, the frequency of the color misregistration adjustment was set to every 100 sheets since a print out time taken for 100 A3-size sheets corresponds to a print out time taken for 200 A4-size sheets. Therefore, the results of this test were expected to be substantially equal to the results of the serial printing job of 2000 sheets of A4-size paper.

Figure 20:
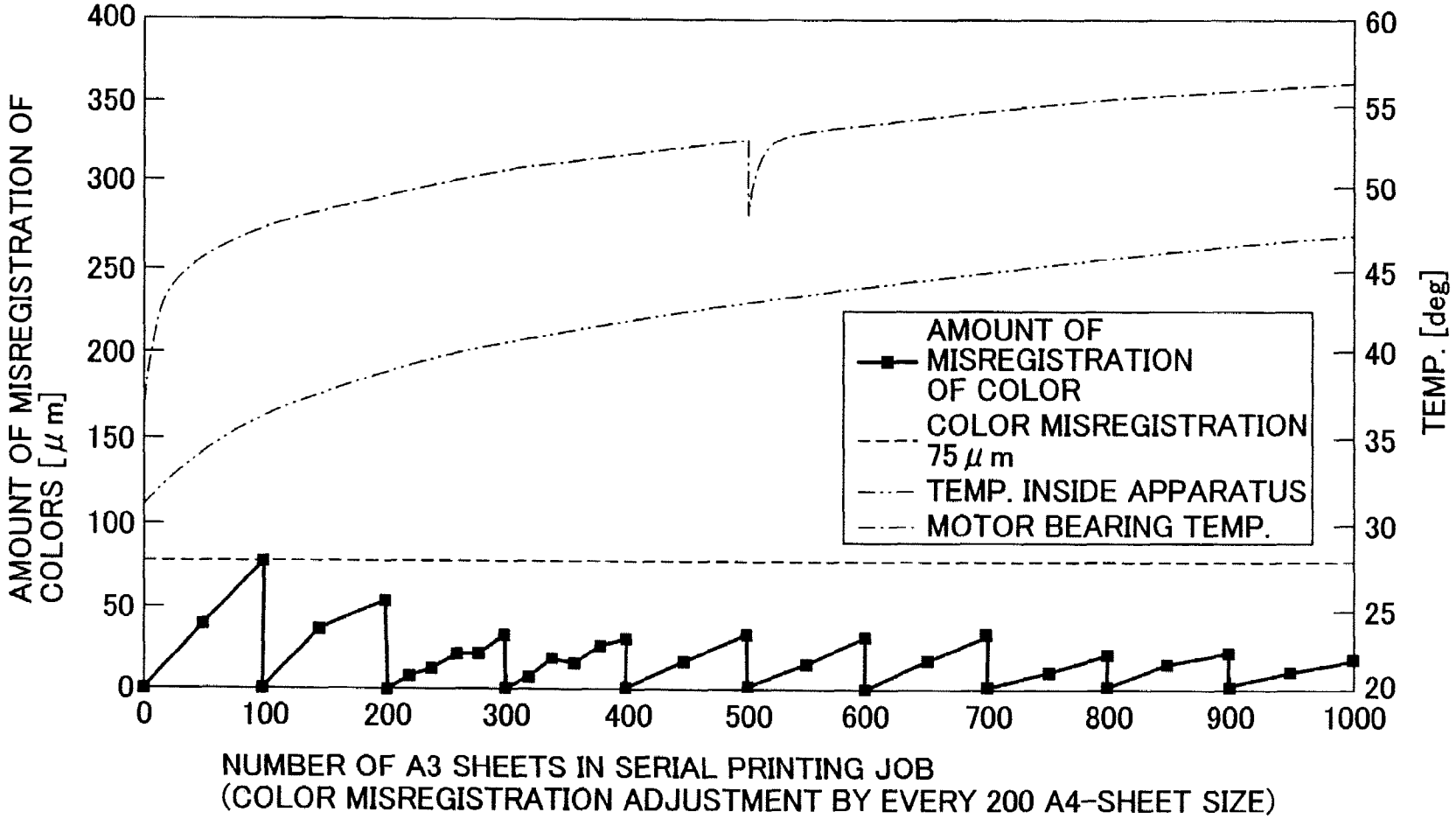
FIG. 20 is a graph showing a relationship of amounts of color misregistration, the number of a serial printing operation, the temperature of an image writing device, and the motor bearing temperature when the color misregistration adjustment is performed per 100 print sheets.

The results of the above-described test is shown in a graph of FIG. 20. As shown in FIG. 20, by conducting the color misregistration adjustment by every 100 sheets, the amount of color misregistration that generally increased along with the increase of the number of printout sheets was reduced to substantially zero. As a result, the amount of color misregistration throughout the serial printing operation of 1000 sheets of A3-size paper was kept below the allowable range of 75 μm.

Accordingly, when the color misregistration adjustment is conducted each time the data of the print number accumulating register RTn becomes 100, the amount of color misregistration can be kept within the allowable range even during a serial printing operation of a large amount of A3-size paper.

However, the color misregistration adjustment by every 100 sheets may be frequently conducted. The frequent occurrence of the color misregistration adjustment may frequently stop a printer (e.g., the printer 100) by force and cause users to wait for a predetermined period that can cause the users to have sense of dissatisfaction or frustration.

To avoid such inconvenience to users, the number of sheets to trigger the color misregistration adjustment may need to be set up to 150 sheets. A number greater than 150 sheets may possibly cause the users' dissatisfaction or frustration with the printouts.

In addition, even when the number of sheets to trigger the color misregistration adjustment is equal to or smaller than 150, the amount of the color misregistration can exceed the allowable range, as shown in the graph of FIG. 19.

After conducting the above-described different tests, the inventors assumed that one sheet of A3-size paper can take twice as much time as one sheet of A4-size paper. That is, the test result shown in FIG. 20, which was conducted under the condition that the number of sheets to trigger the color misregistration adjustment was set to 100 sheets of A3-size paper, is expected to be substantially equal to the result of a test in which the number of sheets to trigger the color misregistration adjustment is set to 200 sheets of A4-size paper.

In the case in which the trigger number is set to 200 sheets of A4-size paper, which is most frequently used, the values representing the number of sheets for the serial printing operation may be half of the values indicated in the horizontal axis of the graph shown in FIG. 20. Specifically, even when the trigger number of print sheets is set to 200 for A4-size paper, 2000 sheets of A4-size paper can be serially printed while keeping the amount of color misregistration within the allowable range. In addition, since the color misregistration adjustment is conducted by every 200 sheets, the number of times for users to wait may also be within the allowable range.

To enable the above-described condition, the MPU 30 that serves as a counting unit of the printer 100 can adjust or change a count up value to be added to the number of print sheets to trigger the color misregistration adjustment (data in the print number accumulating register RTn), which is incremented by one each time one sheet is printed, according to the size of a recording medium (e.g., A3-size paper or A4-size paper). The count up value is a predetermined number to be added to the number of print sheets so as to adjust the number of print sheets by incrementing by the count up value according to the detection result of the paper size detection sensor set 90.

Specifically, the printer 100 shown in FIG. 3 includes the paper size detection sensor set 90 that includes a plurality of transmission type photosensors.

The paper size detection sensor set 90 is disposed at the lower part of the main body 1, including a lower board 90*a* and an upper board 90*b* arranged to vertically sandwich the sheet feeding cassette 2.

A plurality of detection holes (not shown) are arranged at the bottom plate of the sheet feeding cassette 2. A plurality of light emitting elements are disposed on the lower board 90*a* of the pair of paper size detection sensor 90, and a plurality of light receiving elements are disposed on the upper board 90*b*.

When the plurality of light emitting elements of the lower board 90*a* emit respective light beams, the light beams may reach the plurality of detection holes corresponding to the light beams.

Some light beams may hit a recording sheet S accommodated in the sheet feeding cassette 2 to be blocked. The other light beams may pass through the plurality of corresponding detection holes and reach the plurality of light receiving elements of the upper board 90*b* to be received.

The plurality of light receiving elements may output the voltage according to the amount of received light to the MPU 30 via the A/D converter (e.g., the A/D converters 36*r*, 36*c*, and 36*f*). Based on the voltage value, the MPU 30 may specify the size and orientation of a recording sheet S set in the sheet feeding cassette 2 according to a combination of light receiving elements with received light, among the plurality of light receiving elements of the upper board 90*b*. That is, the MPU 30 may specify the length in a sheet travel direction or a sheet conveying direction of the recording sheet S.

Thus, in one embodiment of the present invention, the pair of paper size detection sensors 90 serve as a paper length detecting unit for detecting the length in the sheet travel direction of a recording sheet S.

The printer 100 further includes a manual sheet feeding tray 92 on one side of the main body 1 of the printer 100, which is a right-hand side of the printer 100 in FIG. 3.

In FIG. 3, the manual sheet feeding tray 92 can be opened and closed in a face-up manner around a lower portion thereof, as indicated by a bidirectional arrow shown in FIG. 3. The manual sheet feeding tray 92 in FIG. 3 is placed in the closed position.

A recording sheet S can be set on the manual sheet feeding tray 92 in the open position with respect to the housing 1 and conveyed into the printer 100 to use as the recording medium. The recording sheet S may be conveyed to the manual sheet feeding tray 92 toward the pair of registration rollers 28, and pass by the paper detection sensor 91.

After the paper detection sensor 91 has detected the leading edge of the recording sheet S, the MPU 30 detects the length in the sheet travel direction of the recording sheet S based on a time period for which the paper detection sensor 91 detects the recording sheet S from the leading edge to the trailing edge. Hereinafter, the length in the sheet travel direction of the recording sheet S is referred to as a "sheet travel size."

Accordingly, in one embodiment, the printer 100 has another paper length detecting unit formed in the combination of the paper detection sensor 91 and the MPU 30. These paper length detecting units are used for the purpose of monitoring the compatibility of paper size and image size.

Figure 21:
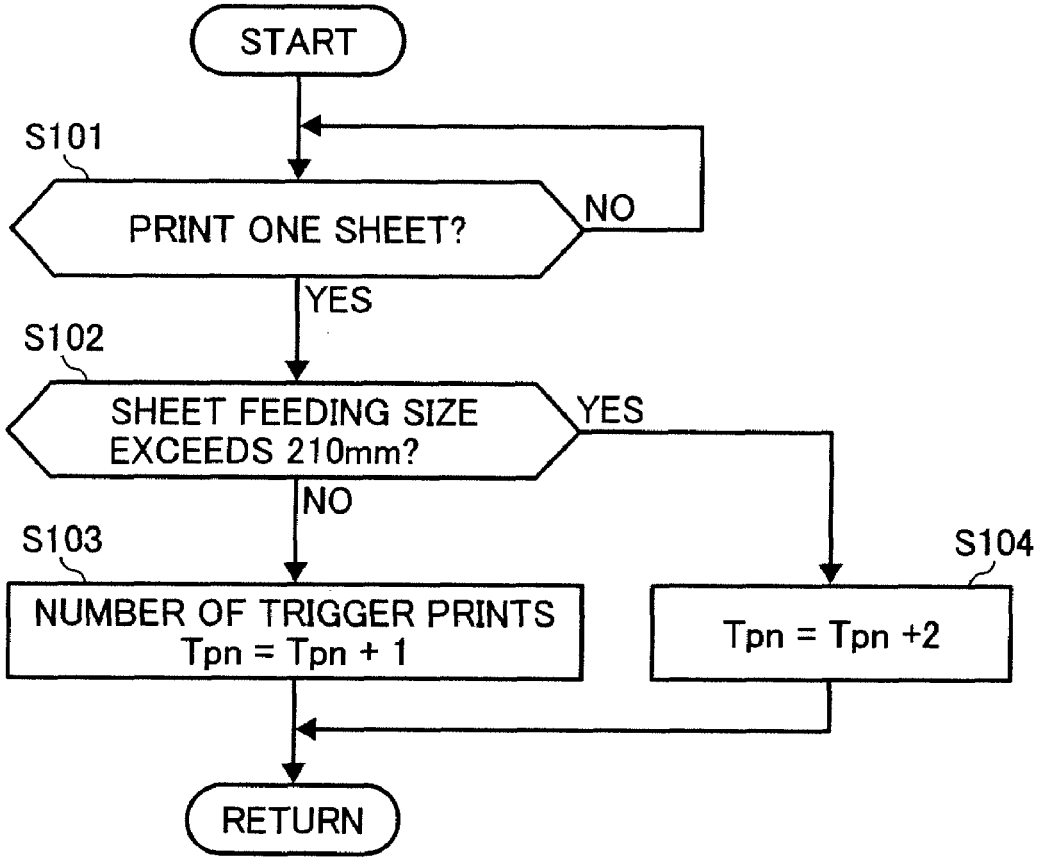
FIG. 21 is a flowchart showing a count up operation of counting the number of print sheets.

Referring to FIG. 21, a flowchart of the procedures of a count up operation performed in the printer 100 according to an exemplary embodiment of the present invention is described.

In the flowchart of FIG. 21, the MPU 30 serving as a counting unit of the printer 100 performs the count up operation for counting up the data (i.e., the number of print sheets) stored in the print number accumulating register RTn.

According to one embodiment, the count up operation is conducted regardless of the number of print sheets. That is, the count up operation is conducted when the printer 100 performs the printing operation both for one recording sheet and for a plurality of recording sheets.

When the printer 100 starts the printing operation, the MPU 30 determines whether the printer 100 prints one recording sheet in step S101. When the printer 100 has not printed one recording sheet yet, the result of step S101 is "NO", and the process repeats step S101. When the printer 100 prints one recording sheet in step S101, the process goes to step S102.

In step S102, the MPU 30 determines whether the sheet feeding size of the recording sheet exceeds 210 mm, which is the length in the short side of A4-size paper. Hereinafter, in the flowchart of FIG. 21, the recording sheet is referred to as a "recording sheet S."

In addition, a recording sheet of A4-size paper may serve as a reference size sheet since A4-size paper is the most frequently used paper in the printer 100 according to one exemplary embodiment of the present invention. When the sheet feeding size of the recording sheet S is equal to or smaller than 210 mm, the result of step S102 is "YES", and the process goes to step S103.

In step S103, the MPU 30 increments or counts up the number of trigger print sheets Tpn by one, as expressed by the equation, "Tpn=Tpn+1." The number of trigger print sheets Tpn is the data stored in the print number accumulating register RTn.

In addition, the number of trigger print sheets Tpn is incremented by one by the MPU 30 when a recording sheet having the same or smaller length of the short side of A4-size paper is conveyed. Therefore, "one" or "1" is regarded as a reference count value in this case.

After step S103, the procedure returns to the start of the flowchart.

When the sheet feeding size of the recording sheet S exceeds 210 mm, the process goes to step S104.

In step S104, the MPU 30 increments or counts up the number of trigger print sheets Tpn by two, as expressed by the equation, "Tpn=Tpn+2." After step S104, the procedure returns to the start of the flowchart.

Specifically, when the sheet feeding size of a recording sheet S exceeds the length of the short side of A4-size paper, such as B4-size paper in the portrait orientation or A3-size paper in the portrait orientation, the MPU 30 changes or adjusts the count up value from "1" to "2" so that the timing of the color misregistration adjustment for B4-size or A3-size paper can be arranged to conduct earlier than the timing of the color misregistration adjustment for A4-size paper.

When the recording sheet S having the sheet feeding size exceeding the length of the short side of A4-size paper is printed, the inside temperature of the optical writing device 4 may increase for each of the above-described recording sheet S.

With the above-described configuration, the count up value of the number of print sheets may be increased according to the increase of the inside temperature of the optical writing device 4. Thereby, the printer 100 can conduct the color misregistration adjustment at an optimal timing for the recording sheet S having each sheet feeding size, according to the increase of the inside temperature of the optical writing device 4, without counting the time period of driving the optical writing device 4.

The printer 100, according to an exemplary embodiment of the present invention, keeps the frequency of forcing users to wait and the frequency of conducting the color misregistration adjustment, without increasing the costs for separately installing a temperature sensor or a counting unit for counting the time period of driving the optical writing device 4.

In the above-described count up operation, the MPU 30 increments by two for the recording sheet S having the sheet feeding size exceeding 210 mm. For example, the count up value for a recording sheet S having the sheet feeding size exceeding the short side of A4-size paper is multiplied with an integer number (i.e., two in this case) when compared with the count up value for a recording sheet S having the sheet feeding size equal to or smaller than the short side of A4-size paper.

Alternatively, in another embodiment, the count up value is set to a value according to the ratio of the recording sheet S having the sheet feeding size equal to or smaller than 210 mm with respect to a recording sheet having the sheet feeding size exceeding 210 mm. The sheet feeding size equal to or smaller than 210 mm is hereinafter referred to as an "A4 short-side size."

For example, a recording sheet of B4-size paper in the portrait orientation has the sheet feeding size of 364 mm. Therefore, the count up value of the B4-size paper in the portrait orientation can be set to 1.73 based on a calculation of 364/210=1.73.

By setting a count up value according to the sheet feeding size, etc. with respect to the A4 short-side size, an appropriate count up operation can be conducted for each sheet feeding size. Therefore, the color misregistration adjustment is conducted at a more optimal timing.

However, a counted value for such count up operation, which is the data stored in the print number accumulating register RTn, may have many digits. Therefore, it may be necessary to increase the capacity of the print number accumulating register RTn, which can cause an increase in cost.

In the printer 100 according to an exemplary embodiment of the present invention, however, the counted value has three digits, which can decrease the cost. The number of trigger print sheets Tpn that represents the number of sheets to print out may be equally indicated as the number of recording sheets S conveyed to the transfer device 5.

Different count up operations of the printer 100, according to other exemplary embodiments of the present invention, will next be described.

Since the printer 100 uses the same components for the following different count up operations as the count up operation previously shown in the flowchart of FIG. 21, the details of the components of the printer 100 are omitted.

Figure 22:
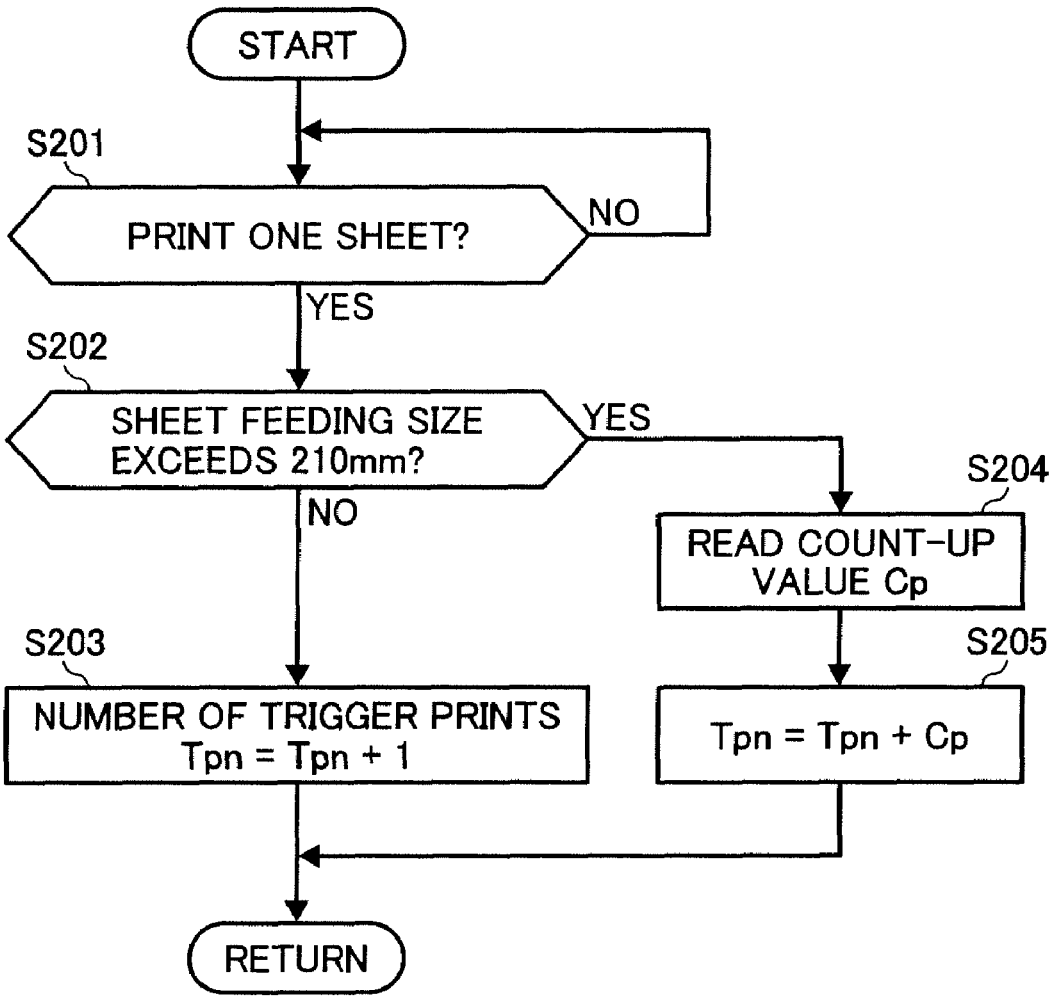
FIG. 22 is a flowchart showing a count up operation of counting the number of print sheets according to an exemplary embodiment of the present invention.

Referring to FIG. 22, a flowchart of the procedures of one of the different count up operations is described.

As previously described, the printer 100 constantly sets the count up value of the number of trigger print sheets Tpn to "1" for a recording sheet having the sheet feeding size of A4 short-side size. At the same time, the printer 100 allows users to change or customize the setting of a count up value for recording sheets having the sheet feeding size other than A4 short-side size. Users can change or customize the setting by inputting any number or figure via an operation display part (not shown). In one embodiment, the value input from the operation display part is stored into a nonvolatile memory of the MPU 30. In another embodiment, when performing the count up operation by using a variable or customized number for printing a recording sheet having the sheet feeding size other than A4 short-side size, the MPU 30 also serves as an amount setting unit.

In the flowchart of FIG. 22, the MPU 30 performs the count up operation with respect to the data stored in the print number accumulating register RTn. When the printer 100 starts the printing operation, the MPU 30 determines whether the printer 100 prints one recording sheet S in step S201.

When the printer 100 prints one recording sheet S in step S201, the result of step S201 is "YES", and the process goes to step S202. When the printer 100 has not printed one recording sheet S yet, the result of step S201 is "NO", and the process repeats step S201.

In step S202, the MPU 30 determines whether the sheet feeding size of the recording sheet S exceeds 210 mm, which is the length in the short side of A4-size paper. When the sheet feeding size of the recording sheet S is equal to or smaller than 210 [mm], the result of step S202 is "NO", and the process goes to step S203.

In step S203, the MPU 30 increments or counts up the number of trigger print sheets Tpn by one, as expressed by the equation, "Tpn=Tpn+1." The number of trigger print sheets Tpn is the data stored in the print number accumulating register RTn. After step S203, the procedure returns to the start of the flowchart. When the sheet feeding size of the recording sheet S exceeds 210 mm, the result of step S202 is "YES", and the process goes to step S204.

In step S204, the MPU 30 reads a count up value Cp corresponding to the sheet feeding size of the recording sheet S from the nonvolatile memory. The process next proceeds to step S205. In step S205, the MPU 30 increments or counts up the number of trigger print sheets Tpn according to the count up value Cp obtained in step S204, which is expressed by the equation, "Tpn=Tpn+Cp." After step S205, the procedure returns to the start of the flowchart.

As described above, the printer 100 can cause users to customize or freely change or adjust the count up value of the number of trigger print sheets Tpn according to the sheet feeding size of the recording sheet S.

Accordingly, the printer 100 can adjust a balance between a production of high quality images and a reduction of users' waiting times due to the color misregistration adjustment.

Figure 23:
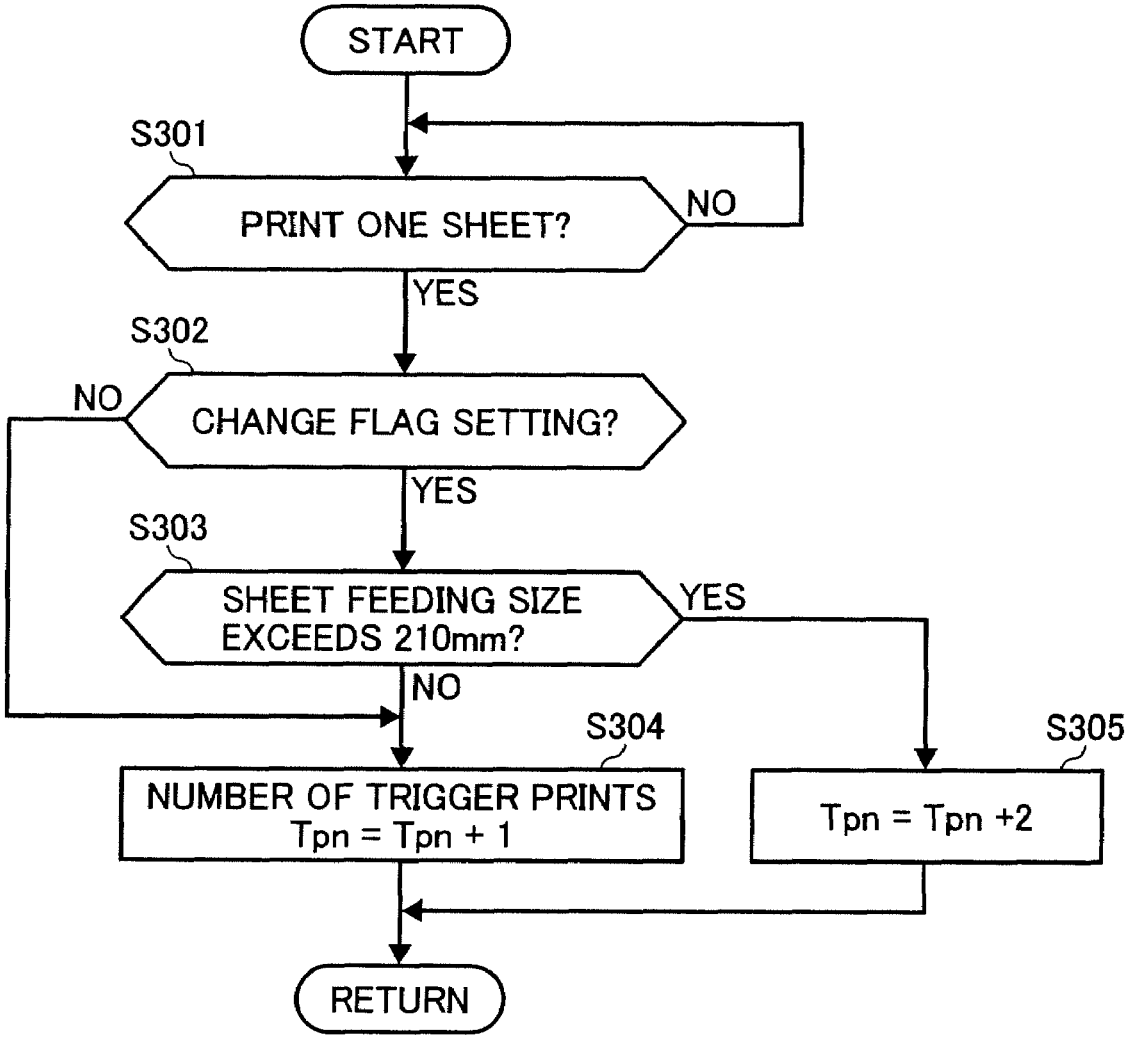
FIG. 23 is a flowchart showing a count up operation of counting the number of print sheets according to a different exemplary embodiment of the present invention.

Referring to FIG. 23, a flowchart of the procedures of another one of the different count up operations is described.

The printer 100 allows users to select one of two operation modes. That is, users can select one of a count up operation mode (or a count up mode) or a non count up operation mode. Specifically, the count up value of the number of trigger print sheets Tpn can be changed according to the sheet feeding size of the recording sheet S in the count up operation mode, and the count up value of the number of trigger print sheets Tpn remains unchanged in the non count up operation mode.

The selection may be conducted by inputting the value on the operation display part (not shown). That is, in one embodiment, the operation display part serves as a mode selecting unit. When the count up operation mode is selected, the MPU 30 sets a flag that is a control parameter.

In the flowchart of FIG. 23, the MPU 30 of the printer 100 performs the count up operation with respect to the number of trigger print sheets Tpn.

When the printer 100 starts the printing operation, the MPU 30 determines whether the printer 100 prints one recording sheet S in step S301. When the printer 100 prints one recording sheet S in step S301, the result of step S301 is "YES", and the process goes to step S302. When the printer 100 has not printed one recording sheet S yet, the result of step S301 is "NO", and the process repeats step S301.

In step S302, the MPU 30 determines whether the flag is set or not. That is, the MPU 30 determines in step S302 whether or not to change the number of trigger print sheets Tpn.

When the flag is set, the result of step S302 is "YES", and the process proceeds to step S303. When the flag is not set, the result of step S302 is "NO", and the process goes to step S304.

In step S303, the MPU 30 determines whether the sheet feeding size of the recording sheet S exceeds 210 mm. When the sheet feeding size of the recording sheet S is equal to or smaller than 210 mm, the result of step S303 is "NO", and the process goes to step S304.

In step S304, which is under the condition that the flag is set and that the sheet feeding size of the recording sheet S is equal to or smaller than 210 mm, the MPU 30 increments or counts up the number of trigger print sheets Tpn by one, as expressed by the equation, "Tpn=Tpn+1", regardless of the sheet feeding size of the recording sheet S. After step S304, the procedure returns to the start of the flowchart.

When the sheet feeding size of the recording sheet S exceeds 210 mm, the result of step S303 is "YES", and the process goes to step S305. In step S305, the MPU 30 increments or counts up the number of trigger print sheets Tpn by two, as expressed by the equation, "Tpn=Tpn+2." After step S305, the procedure returns to the start of the flowchart.

As described above, in one embodiment, the printer 100 provides the selectable operation modes so that users can select the operation mode, one of which has a priority to the production of high quality images having a less amount of color misregistration and the other of which has a priority to the reduction of the frequency of users' waiting times due to the color misregistration adjustment.

The present invention is further applicable to a recording sheet having the length in the unit of "inch", for example, a legal size sheet or a letter size sheet.

When a printer according to a modified exemplary embodiment of the present invention forms an image on a recording sheet having a size in inch, a different size paper, for example a letter size sheet, can be printed.

Specifically, the printer has a configuration in which the size in an axial direction of each photoconductor (e.g., the photoconductors 10Y, 10C, 10M, and 10BK) and the width of an intermediate transfer belt (e.g., the intermediate transfer belt 20) correspond to recording sheets having the length in the unit of "inch."

In the printer having the above-described configuration, a recording sheet of letter-size paper may be most frequently used to print. Therefore, in one embodiment, a recording sheet of letter-size paper serves as a reference size sheet in the printer according to the modified exemplary embodiment of the present invention.

Figure 24:
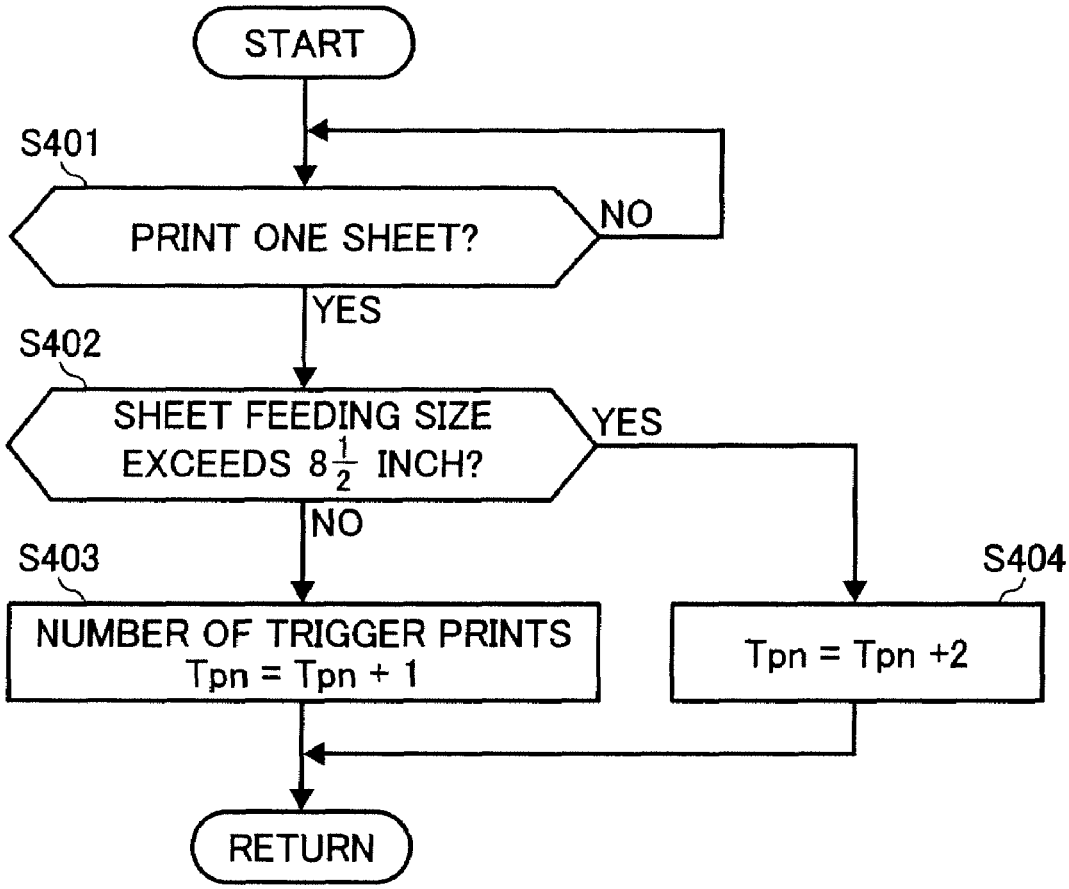
FIG. 24 is a flowchart showing a count up operation of counting the number of print sheets according to a further different exemplary embodiment of the present invention.

Referring to FIG. 24, a flowchart of the procedures of a count up operation for recording sheets in the unit of "inch" is described. In the flowchart of FIG. 24, the MPU 30 performs the count up operation with respect to the number of trigger print sheets Tpn.

When the printer according to the modified exemplary embodiment of the present invention starts the printing operation, the MPU 30 determines whether the printer prints one recording sheet in step S401. When the printer has not printed one recording sheet S yet, the result of step S401 is "NO", and the process repeats step S401.

When the printer prints one recording sheet S in step S401, the result of step S401 is "YES", and the process goes to step S402. In step S402, the MPU 30 determines whether the sheet feeding size of the recording sheet S exceeds 8 and ½ inch, which is the length in the short side of letter-size paper.

When the sheet feeding size of the recording sheet S is equal to or smaller than 8 and ½ inch, the result of step S402 is "NO", and the process goes to step S403. In step S403, the MPU 30 increments or counts up the number of trigger print sheets Tpn by one, as expressed by the equation, "Tpn=Tpn+1." The number of trigger print sheets Tpn is the data stored in the print number accumulating register RTn.

After step S403, the procedure returns to the start of the flowchart of FIG. 24. When the sheet feeding size of the recording sheet S exceeds 8 and ½ inch, the result of step S402 is "YES", and the process goes to step S404.

In step S404, the MPU 30 increments or counts up the number of trigger print sheets Tpn by two, as expressed by the equation, "Tpn=Tpn+2." After step S404, the procedure returns to the start of the flowchart of FIG. 24.

Similar to the case in which a recording sheet S having A4-size paper is most frequently used, when the recording sheet S having the sheet feeding size exceeding the length of the short side of letter-size paper is printed, the inside temperature of the optical writing device 4 may increase for each of the above-described recording sheet S.

With the above-described configuration, according to one embodiment, the count up value of the number of print sheets is increased according to the increase of the inside temperature of the optical writing device 4. Therefore, the printer according to the modified exemplary embodiment of the present invention can conduct the color misregistration adjustment at an optimal timing for the recording sheet S having each sheet feeding size, according to the increase of the inside temperature of the optical writing device 4, without counting the time period of driving the optical writing device 4.

As an alternative to the printer 100 employing an indirect transfer method, an image forming apparatus employing a direct transfer method can be applied to the above-described exemplary embodiments of the present invention.

Figure 25:
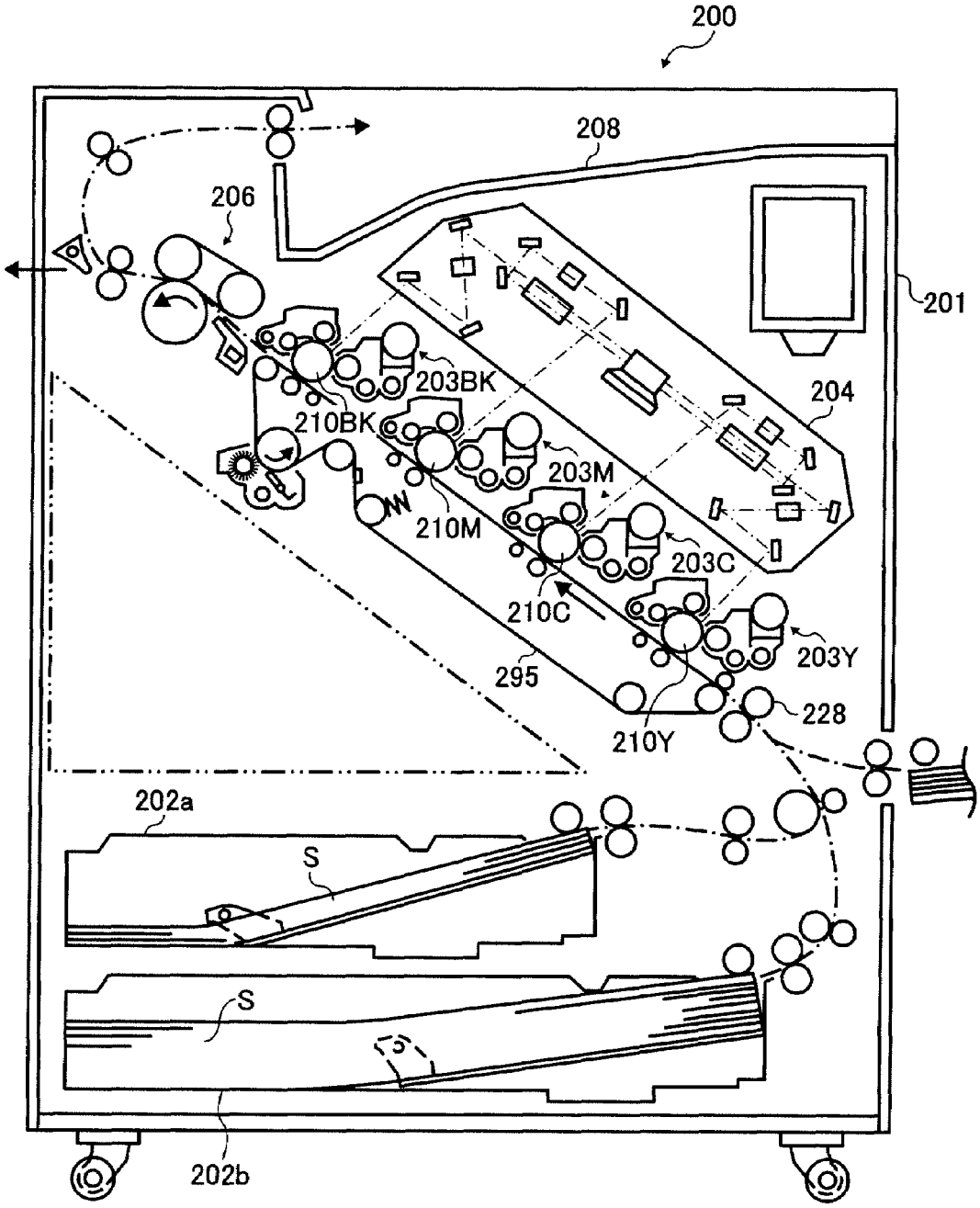
FIG. 25 is a schematic configuration of an image forming apparatus with a direct transfer method.

Referring to FIG. 25, a schematic configuration of an image forming apparatus 200 having a direct transfer method according to one exemplary embodiment of the present invention is described. In FIG. 25, the image forming apparatus 200 includes a main body 201 and sheet feeding cassettes 202*a* and 202*b*.

The main body 201 of the image forming apparatus 200 includes a pair of registration rollers 228, image processing devices 203Y, 203C, 203M, and 203BK, a sheet conveying belt 295, a fixing device 208, and an optical writing device 204.

The image processing devices 203Y, 203C, 203M, and 203BK form images of yellow (Y) toner image, cyan (C) toner image, magenta (M) images, and black (BK) images, respectively.

The sheet conveying belt 295 that serves as a transfer member is disposed facing the image processing devices 203Y, 203C, 203M, and 203BK, and conveys a recording sheet S serving as recording medium by carrying the recording sheet S thereon.

The structure and functions of the image processing devices 203Y, 203C, 203M, and 203BK in the image forming apparatus 200 are basically same as those of the image processing devices 3Y, 3C, 3M, and 3BK in the printer 100. Therefore, the detailed description of the image processing devices 203Y, 203C, 203M, and 203BK are omitted.

The main body 201 further includes a sheet discharging tray 208 for a stack of printed sheets. When the image forming operation is started, the recording sheet S accommodated in one of the sheet feeding cassettes 202*a* and 202*b* is selectively fed and conveyed toward the pair of registration rollers 228 and is stopped before the pair of registration rollers 228.

Concurrently, toner images of respective colors are formed on the respective surfaces of photoconductors 210Y, 210C, 210M, and 210BK.

In synchronization of rotation at a predetermined timing of the pair of registration rollers 228, the recording sheet S is again conveyed to the sheet conveying belt 295.

Then, the toner images formed on the photoconductors 210Y, 210C, 210M, and 210BK are sequentially transferred onto the recording sheet S carried by the sheet conveying belt 295 in an overlaying manner.

When the transfer sheet S passes through the fixing device 206, the overlaid toner image on the transfer sheet S is fixed thereto. The transfer sheet S is then discharged to the sheet discharging tray 208.

As described above, the printer according to an exemplary embodiment of the present invention includes the MPU 30 to multiply the count up value with an integer number of the reference count up value when the length of the recording sheet S in the sheet travel direction exceeds the short side of a recording medium of A4-size paper or a reference size sheet, according to the detection result obtained by the pair of paper size detection sensors 90 or the combination of the paper detection sensor 91 and the MPU 30.

With the above-described configuration, the printer can reduce the amount of memory by causing the number of trigger prints Tpn to have three digits, resulting in saving the capacity of data memory.

In the printer according to an exemplary embodiment of the present invention, the MPU 30 includes functions as follows: the length of each of the photoconductors 10Y, 10C, 10M, and 10BK in a direction perpendicular to the surface travel direction thereof has a unit of "mm" and corresponds to the short side of a recording sheet of A3-size paper; a recording sheet of A4-size paper is regarded as a reference sheet; and the reference value is multiplied by two when the recording sheet S exceeds the short side of the A4-size paper according to the detection result obtained by the pair of paper size detection sensors 90 or the combination of the paper detection sensor 91 and the MPU 30. With the above-described configuration, the increase of the data memory capacity caused by changing the count up value in each paper size can be avoided.

In the printer according to an exemplary embodiment of the present invention, the MPU 30 alternatively includes functions as follows: the length of each of the photoconductors 10Y, 10C, 10M, and 10BK in a direction perpendicular to the surface travel direction thereof has a unit of "inch"; a recording sheet of letter-size paper is regarded as a reference sheet; and the reference count value is multiplied by two when the recording sheet S exceeds the short side of the letter-size paper according to the detection result obtained by the pair of paper size detection sensors 90 or the combination of the paper detection sensor 91 and the MPU 30.

With the above-described configuration, similar to the configuration employing a reference sheet of A4-size paper, the increase of the data memory capacity caused by changing the count up value in each paper size can be avoided.

Further, in the printer according to an exemplary embodiment of the present invention, the MPU 30 serves as an amount setting unit, with which a user inputs a variable number of the count up value according to the detection result obtained by the pair of paper size detection sensors 90 or the combination of the paper detection sensor 91 and the MPU 30. According to the input result, the MPU 30 may change the count up value.

With the above-described configuration, a user can freely change the count up value with respect to the recording sheet S of each size. Accordingly, a production of high quality images and a reduction of the number of waits for user can be adjusted.

Further, the printer according to an exemplary embodiment of the present invention includes a count up operation mode to change the count up value according to the detection result obtained by the pair of paper size detection sensors 90 or the combination of the paper detection sensor 91 and the MPU 30, and a non count up operation mode to keep the count up value unchanged. The user can select one of the count up operation mode or the non count up operation mode according to the input result to the MPU 30.

Accordingly, with the above-described configuration, users can select one of a priority to the production of high quality images and a priority to the reduction of the frequency of users' waiting times.

Further, in the printer according to an exemplary embodiment of the present invention, the MPU 30 clears a counted value to zero each time the counted value has reached a predetermined value. For example, the MPU 30 clears the number of print sheets to trigger the color misregistration adjustment, which is the data in the print number accumulating register RTn, to zero when the counted value reaches a predetermined value.

With the above-described configuration, the number of trigger print sheets Tpn from the most previous color misregistration adjustment can easily be obtained without performing a calculation of subtracting the total number of print sheets at the color misregistration adjustment from the current total number of print sheets, which can speed up the calculation for obtaining the number of trigger print sheets Tpn.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

The invention claimed is:

1. An image forming apparatus, comprising:

a plurality of image bearing members configured to bear respective images thereon;

a transfer device configured to transfer the respective images formed on the plurality of image bearing members, including a transfer member in a form of a closed loop, and configured to receive the respective images on one of a surface of the transfer member and a recording medium carried by the transfer member;

an image detecting unit configured to detect the respective images conveyed on the transfer member;

a paper length detecting unit configured to detect a length of the recording medium in a sheet travel direction;

a counting unit configured to count a number of recording media including the recording medium conveyed to the transfer device by changing a count up value each time a recording medium is conveyed to the transfer device according to a detection result obtained by the paper length detecting unit, and to add a value to the count value of the number of recording media conveyed to the transfer device according to an internal temperature of the image forming apparatus; and a control unit configured to control an image forming timing with respect to the plurality of image bearing members based on a detection timing of one of the respective images detected by the image detecting unit and to perform a positional deviation adjustment each time a count value of the number of recording media obtained by the counting unit increases by a predetermined amount, so as to reduce an amount of a positional deviation of the image caused when the image is superimposed on the transfer member or on the recording medium.

2. The image forming apparatus according to claim 1, further comprising:

an optical writing device configured to optically write the respective images on the plurality of image bearing members; and a developing device configured to separately develop the respective images corresponding to respective visible toner images.

3. The image forming apparatus according to claim 2, wherein:

the count value obtained when a reference size sheet having a predetermined size is conveyed toward the transfer member with a short side of the reference size sheet along a sheet travel direction is regarded as a reference count value; and the counting unit is configured to determine the count value by multiplying the reference count up value with an integer when a length of the recording medium in the sheet travel direction exceeds the short side of the reference sheet according to the detection result by the paper length detecting unit.

4. The image forming apparatus according to claim 3, wherein:

the reference sheet includes an A4-size paper; and the counting unit is configured to determine the count value by multiplying the reference count value by two when a length of the recording medium in the sheet travel direction exceeds the short side of the A4-size paper according to the detection result by the paper length detecting unit.

5. The image forming apparatus according to claim 3, wherein:

the reference sheet includes a letter-size paper; and the counting unit is configured to determine the count value by multiplying the reference count value by two when a length of the recording medium in the sheet travel direction exceeds the short side of the letter-size paper according to the detection result by the paper length detecting unit.

6. The image forming apparatus according to claim 2, further comprising:

an amount setting unit configured to allow a user to input a variable amount of the count value according to the detection result obtained by the paper length detecting unit, wherein the counting unit is configured to change the count value by an amount obtained according to the input result of the amount setting unit.

7. The image forming apparatus according to claim 2, further comprising:

a mode selecting unit configured to allow a user to select one of a count operation mode for performing a count operation to change the count value according to the detection result obtained by the paper length detecting unit and a non count operation mode for performing a count operation to keep the count value unchanged, wherein the counting unit is configured to select the operation mode according to an input result corresponding to the user's selection of one of the operation modes.

8. The image forming apparatus according to claim 2, wherein:

the counting unit is configured to clear the count of the number of recording media to zero each time the count value reaches a predetermined value.

9. The image forming apparatus according to claim 2, wherein:

the control unit configured to controllably form with the positional deviation adjustment a plurality of patterns on the plurality of respective image bearing members, transfer the plurality of patterns onto the transfer member, and adjust image forming conditions based on the detection result obtained by the image detecting unit.

10. The image forming apparatus according to claim 2, wherein:

the optical writing device is configured to include a light deflecting unit configured to deflect light separately with respect to plurality of image bearing members.

11. A computer readable storage medium encoded with computer executable instructions, which when executed by an image forming apparatus, cause the image forming apparatus to perform a method comprising:

transferring respective images formed on a plurality of image bearing members to a transfer member included thereof;

detecting the respective images conveyed on the transfer member;

detecting a length of a recording medium in a sheet travel direction;

counting a number of recording media including the recording medium conveyed to the transfer member;

controlling an image forming timing with respect to the plurality of image bearing members based on a detection timing of one of the detected respective images;

changing a count value of the number of recording media conveyed to the transfer member each time a recording medium is conveyed to the transfer member according to a result of the detecting of the length of the recording medium in the sheet travel direction;

adding a value to the count value of the number of recording media conveyed to the transfer member according to an internal temperature of the image forming apparatus; and performing a positional deviation adjustment each time the count of the number of recording media determined by the counting step is increased by a predetermined amount.

12. The computer readable storage medium according , to claim 11, wherein:

the count value obtained when a reference size sheet having a predetermined size is conveyed toward the transfer member with a short side of the reference size sheet along a sheet travel direction is regarded as a reference count value; and the counting step includes determining the count value by multiplying the reference count value with an integer when a length of the recording medium in the sheet travel direction exceeds the short side of the reference sheet according to the result of the detecting step.

13. The computer readable storage medium according to claim 11, further comprising:

receiving, through an input, a variable amount of the count value according to the result of the detecting of the length of the recording medium in the sheet travel direction, wherein the counting step includes changing the count value by an amount obtained according to the input.

14. The computer readable storage medium according to claim 11, further comprising:

selecting, through an input, one of a count operation mode for performing a count operation to change the count value according to the result of the detecting of the length of the recording medium and a non count operation mode for performing a count up operation that keeps the count value unchanged, wherein the counting step includes selecting the operation mode according to the input.

15. The computer readable storage medium according to claim 11, wherein:

the controlling step includes controllably forming with the positional deviation adjustment a plurality of patterns on the plurality of respective image bearing members, transferring the plurality of patterns onto the transfer member, and adjusting image forming conditions based on the result of the detecting of the image.

16. A method of image forming, implemented on an image forming apparatus, comprising:

transferring respective images formed on a plurality of image bearing members to a transfer member included thereof;

detecting the respective images conveyed on the transfer member;

detecting a length of a recording medium in a sheet travel direction;

counting a number of recording media including the recording medium conveyed to the transfer member;

controlling an image forming timing with respect to the plurality of image bearing members based on a detection timing of one of the detected respective images;

changing a count value of the number of recording media conveyed to the transfer member each time a recording medium is conveyed to the transfer member according to a result of the detecting of the length of the recording medium in the sheet travel direction;

adding a value to the count value of the number of recording media conveyed to the transfer member according to an internal temperature of the image forming apparatus; and performing a positional deviation adjustment each time the count of the number of recording media determined by the counting step is increased by a predetermined amount.

17. The method according to claim 16, wherein:

the count value obtained when a reference size sheet having a predetermined size is conveyed toward the transfer member with a short side of the reference size sheet along a sheet travel direction is regarded as a reference count value; and the counting step includes determining the count up value by multiplying the reference count value with an integer when a length of the recording medium in the sheet travel direction exceeds the short side of the reference sheet according to the result of the detecting step.

18. The method according to claim 16, further comprising:

receiving, through an input, a variable amount of the count value according to the result of the detecting of the length of the recording medium in the sheet travel direction, wherein the counting step includes changing the count value by an amount obtained according to the input.

19. The method according to claim 16, further comprising:

selecting, through an input, one of a count operation mode for performing a count operation to change the count value according to the result of the detecting of the length of the recording medium and a non count operation mode for performing a count operation to keep the count value unchanged, wherein the counting step selects the operation mode according to the input.

20. The method according to claim 16, wherein:

the controlling step includes controllably forming with a positional deviation adjustment a plurality of patterns on the plurality of respective image bearing members, transferring the plurality of patterns onto the transfer member, and adjusting image forming conditions based on the result of the detecting of the image.

* * * * *